US011076658B2

(12) United States Patent
Schneider et al.

(10) Patent No.: US 11,076,658 B2
(45) **Date of Patent: *Aug. 3, 2021**

(54) BOX LACING CHANNEL FOR AUTOMATED FOOTWEAR PLATFORM

(71) Applicant: NIKE, Inc., Beaverton, OR (US)

(72) Inventors: Summer L. Schneider, Beaverton, OR (US); Narissa Chang, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/793,068

(22) Filed: Feb. 18, 2020

(65) Prior Publication Data

US 2020/0253336 A1 Aug. 13, 2020

Related U.S. Application Data

(63) Continuation of application No. 15/460,117, filed on Mar. 15, 2017, now Pat. No. 10,602,805.

(Continued)

(51) Int. Cl.
*A43C 7/00* (2006.01)
*A43C 11/16* (2006.01)

(Continued)

(52) U.S. Cl.
CPC ..... *A43C 11/165* (2013.01); *A43B 3/001* (2013.01); *A43B 3/0005* (2013.01); *A43B 13/14* (2013.01);

(Continued)

(58) Field of Classification Search
CPC ..... A43C 11/165; A43C 7/00; A43C 1/00; A43B 3/0005
See application file for complete search history.

(56) References Cited

U.S. PATENT DOCUMENTS 3,197,155 A 7/1965 Yut
5,929,332 A 7/1999 Brown (Continued)

FOREIGN PATENT DOCUMENTS

CN 109310182 2/2019
DE 2900077 7/1980

(Continued)

OTHER PUBLICATIONS

"International Application Serial No. PCT US2017 022586, International Search Report dated Jun. 22, 2017", 4 pgs.

(Continued)

*Primary Examiner* — Sang K Kim
(74) *Attorney, Agent, or Firm* — Schwegman Lundberg & Woessner, PA

(57) ABSTRACT

A footwear lacing apparatus can comprise a housing structure, a spool and a drive mechanism. The housing structure can comprise a first inlet, a second inlet, and a lacing channel extending between the first and second inlets. The lacing channel can comprise a spool receptacle located between the first and second inlets, a first relief area located between the spool receptacle and the first inlet, and a second relief area located between the spool receptacle and the second inlet. The first and second relief areas can be linearly tapered between the spool receptacle and the first and second inlets, respectively. The spool can be disposed in the spool receptacle of the lacing channel. The drive mechanism can be coupled with the spool and adapted to rotate the spool to wind or unwind a lace cable extending through the lacing channel and through the spool.

23 Claims, 37 Drawing Sheets

Related U.S. Application Data

(60) Provisional application No. 62/308,648, filed on Mar. 15, 2016.

(51) Int. Cl.

| | |
|---|---|
| ***A43B 3/00*** | (2006.01) |
| ***B65H 59/00*** | (2006.01) |
| ***B65H 69/00*** | (2006.01) |
| ***B65H 75/14*** | (2006.01) |
| ***B65H 75/44*** | (2006.01) |
| ***A43B 13/14*** | (2006.01) |
| ***A43C 1/00*** | (2006.01) |
| ***B65H 59/38*** | (2006.01) |
| ***B65H 75/30*** | (2006.01) |

(52) U.S. Cl.

CPC ..... *A43C 1/00* (2013.01); *A43C 7/00* (2013.01); *B65H 59/00* (2013.01); *B65H 59/38* (2013.01); *B65H 69/00* (2013.01); *B65H 75/14* (2013.01); *B65H 75/141* (2013.01); *B65H 75/148* (2013.01); *B65H 75/30* (2013.01); *B65H 75/4486* (2013.01)

(56) References Cited

U.S. PATENT DOCUMENTS

| | | | |
|---|---|---|---|
| 5,934,599 | A | 8/1999 | Hammerslag |
| 6,691,433 | B2 | 2/2004 | Liu |
| 7,591,050 | B2 | 9/2009 | Hammerslag |
| 7,752,774 | B2 | 7/2010 | Ussher |
| 8,752,200 | B2 | 6/2014 | Varshavsky et al. |
| 8,935,860 | B2 | 1/2015 | Torres |
| 10,602,805 | B2 | 3/2020 | Schneider et al. |
| 2002/0095750 | A1 | 7/2002 | Hammerslag |
| 2003/0150135 | A1 | 8/2003 | Liu |
| 2003/0204938 | A1 | 11/2003 | Hammerslag |
| 2005/0198867 | A1 | 9/2005 | Labbe |
| 2007/0169378 | A1 | 7/2007 | Sodeberg et al. |
| 2014/0070042 | A1 | 3/2014 | Beers et al. |
| 2014/0094728 | A1 | 4/2014 | Soderberg et al. |
| 2015/0250268 | A1 | 9/2015 | Alt et al. |
| 2017/0265581 | A1 | 9/2017 | Chang |
| 2017/0265586 | A1 | 9/2017 | Schneider et al. |
| 2017/0265591 | A1 | 9/2017 | Schneider |
| 2017/0265593 | A1 | 9/2017 | Schneider et al. |
| 2017/0265594 | A1 | 9/2017 | Walker et al. |
| 2017/0267485 | A1 | 9/2017 | Schneider et al. |
| 2018/0343977 | A1 | 12/2018 | Riccomini et al. |
| 2019/0116937 | A1 | 4/2019 | Avar et al. |

FOREIGN PATENT DOCUMENTS

| | | |
|---|---|---|
| EP | 1421867 | 5/2004 |
| JP | 2013525007 | 6/2013 |
| JP | 2019512324 | 5/2019 |
| KR | 100953398 | 4/2010 |
| WO | 2017161044 | 9/2017 |

OTHER PUBLICATIONS

"International Application Serial No. PCT US2017 022586, Written Opinion dated Jun. 22, 2017", 6 pgs.

"International Application Serial No. PCT US2017 022586, International Preliminary Report on Patentability dated Sep. 27, 2018", 8 pgs.

"Chinese Application Serial No. 201780029858.2, Notification on Correction of Deficiencies mailed Nov. 28, 2018", 1 pg.

"U.S. Appl. No. 15/460,117, Restriction Requirement dated Feb. 28, 2019", 6 pgs.

"U.S. Appl. No. 15/460,117, Response filed Apr. 29, 2019 to Restriction Requirement dated Feb. 28, 2019", 8 pgs.

"U.S. Appl. No. 15/460,117, Non Final Office Action dated Jun. 5, 2019", 13 pgs.

"European Application Serial No. 17767474.4, Response filed Apr. 24, 2019 to Communication Pursuant to Rules 161 and 162 dated Nov. 5, 2018", 9 pgs.

"U.S. Appl. No. 15/460,117, Examiner Interview Summary dated Aug. 12, 2019", 3 pgs.

"European Application Serial No. 17767474.4, Extended European Search Report dated Oct. 23, 2019", 9 pgs.

"U.S. Appl. No. 15/460,117, Response filed Nov. 5, 2019 to Non-Final Office Action dated Jun. 5, 2019", 17 pgs.

"U.S. Appl. No. 15/460,117, Notice of Allowance dated Nov. 18, 2019", 7 pgs.

"European Application Serial No. 17767474.4, Response filed Apr. 7, 2020 to Extended European Search Report dated Oct. 23, 2019", 11 pgs.

"Japanese Application Serial No. 2018-549151, Notification of Reasons for Refusal dated Apr. 6, 2021", w English Translation, 12 pgs.

1100

Motion profile tables:

- We define a table of "moves".
- A motion profile is a collection of these moves.
- An autolace or a button press creates a series of these motion profiles.
- We control to a profile and demand a current to support it.
- This would be the spool motion profile.
- We would have a multiplier for the gear reduction (so we can change it quickly if needed).

| Move (spool) | Accel (deg/s/s) | Vel (deg/s) | Dec (deg/s/s) | Angle (deg) |
|---|---|---|---|---|
| Home to Comfort | 100 | 400 | 200 | 550 |
| Segment | 400 | 100 | 400 | 30 |
| Comfort to Performance | 100 | 400 | 200 | 550 |
| Relax | 50 | 5 | 50 | -5 |
| Return to home | 100 | 400 | 200 | 550 |
| Find home | 100 | 10 | | |
| Untangle 1 | | | | |

FIG. 11B

Motion profile tables:

- We define a table of "moves".
- A motion profile is a collection of these moves.
- An autolace or a button press creates a series of these motion profiles.
- We control to a profile and demand a current to support it.
- This would be the spool motion profile.
- We would have a multiplier for the gear reduction (so we can change it quickly if needed).

BOX LACING CHANNEL FOR AUTOMATED FOOTWEAR PLATFORM

This application is a continuation of U.S. patent application Ser. No. 15/460,117, filed Mar. 15, 2017, which application claims the benefit of priority to U.S. Provisional Application Ser. No. 62/308,648, entitled "DRIVE MECHANISM FOR AUTOMATED FOOTWEAR PLATFORM," filed on Mar. 15, 2016, the contents of which are incorporated by reference herein in their entireties.

The following specification describes various aspects of a motorized lacing system, motorized and non-motorized lacing engines, footwear components related to the lacing engines, automated lacing footwear platforms, and related assembly processes. The following specification also describes various aspects of systems and methods for a modular spool assembly for a lacing engine.

BACKGROUND

Devices for automatically tightening an article of footwear have been previously proposed. Liu, in U.S. Pat. No. 6,691,433, titled "Automatic tightening shoe", provides a first fastener mounted on a shoe's upper portion, and a second fastener connected to a closure member and capable of removable engagement with the first fastener to retain the closure member at a tightened state. Liu teaches a drive unit mounted in the heel portion of the sole. The drive unit includes a housing, a spool rotatably mounted in the housing, a pair of pull strings and a motor unit. Each string has a first end connected to the spool and a second end corresponding to a string hole in the second fastener. The motor unit is coupled to the spool. Liu teaches that the motor unit is operable to drive rotation of the spool in the housing to wind the pull strings on the spool for pulling the second fastener towards the first fastener. Liu also teaches a guide tube unit that the pull strings can extend through.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

FIG. 11A-11D are diagrams illustrating a motor control scheme for a motorized lacing engine, according to some example embodiments.

Figure 1:
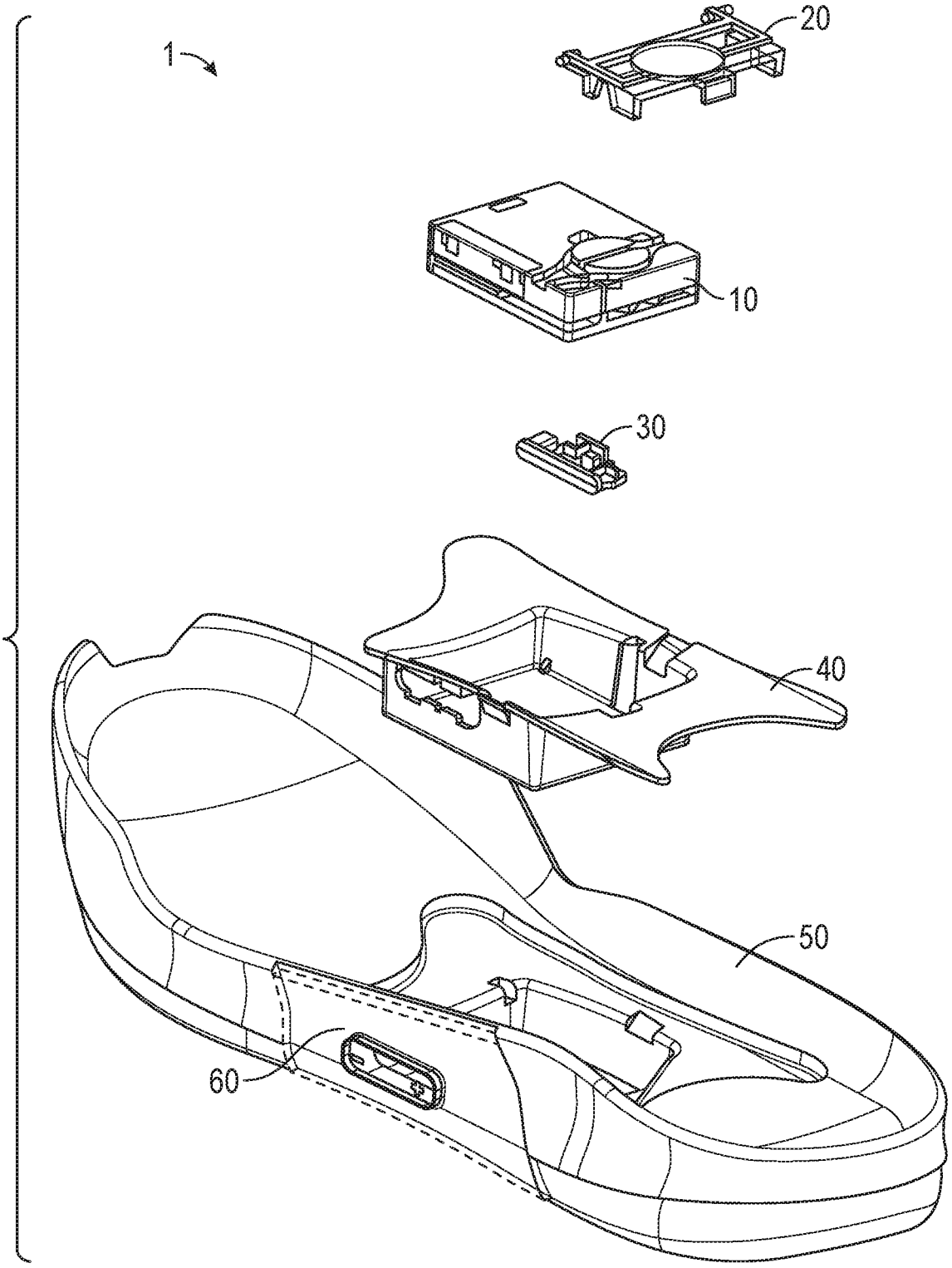
FIG. 1 is an exploded view illustration of components of a motorized lacing system, according to some example embodiments.

The headings provided herein are merely for convenience and do not necessarily affect the scope or meaning of the terms used.

DETAILED DESCRIPTION

The concept of self-tightening shoe laces was first widely popularized by the fictitious power-laced Nike® sneakers worn by Marty McFly in the movie Back to the Future II, which was released back in 1989. While Nike® has since released at least one version of power-laced sneakers similar in appearance to the movie prop version from Back to the Future II, the internal mechanical systems and surrounding footwear platform employed do not necessarily lend themselves to mass production or daily use. Additionally, previous designs for motorized lacing systems comparatively suffered from problems such as high cost of manufacture, complexity, assembly challenges, lack of serviceability, and weak or fragile mechanical mechanisms, to highlight just a few of the many issues. The present inventors have developed a modular footwear platform to accommodate motorized and non-motorized lacing engines that solves some or all of the problems discussed above, among others. The components discussed below provide various benefits including, but not limited to: serviceable components, interchangeable automated lacing engines, robust mechanical design, reliable operation, streamlined assembly processes, and retail-level customization. Various other benefits of the components described below will be evident to persons of skill in the relevant arts.

The motorized lacing engine discussed below was developed from the ground up to provide a robust, serviceable, and inter-changeable component of an automated lacing footwear platform. The lacing engine includes unique design elements that enable retail-level final assembly into a modular footwear platform. The lacing engine design allows for the majority of the footwear assembly process to leverage known assembly technologies, with unique adaptions to standard assembly processes still being able to leverage current assembly resources.

In an example, a footwear lacing apparatus can comprise a housing structure, a spool and a drive mechanism. The housing structure can comprise a first inlet, a second inlet, and a lacing channel extending between the first and second inlets. The lacing channel can comprise a spool receptacle located between the first and second inlets, a first relief area located between the spool receptacle and the first inlet, and a second relief area located between the spool receptacle and the second inlet. The first and second relief areas can be linearly tapered between the spool receptacle and the first and second inlets, respectively. The spool can be disposed in the spool receptacle of the lacing channel. The drive mechanism can be coupled with the spool and adapted to rotate the spool to wind or unwind a lace cable extending through the lacing channel and through the spool.

The automated footwear platform discussed herein can include a housing structure for a footwear lacing apparatus. The housing structure can comprise a body, an internal compartment and a lacing channel. The body can comprise a top surface, a bottom surface, a first sidewall connecting the top surface and the bottom surface, and a second sidewall connecting the top surface and the bottom surface. The internal compartment can be between the top and bottom surfaces and the first and second sidewalls. The lacing channel can extending from the first sidewall to the second sidewall. The lacing channel can comprise a first inlet in the first sidewall, a second inlet in the second sidewall, a spool receptacle located between the first and second inlets, a first relief area located between the spool receptacle and the first inlet, and a second relief area located between the spool receptacle and the second inlet. The first and second relief areas can be linearly tapered between the spool receptacle and the first and second inlets, respectively.

A method of unwinding a spool in a footwear lacing apparatus can comprise rotating a spool with a drive mechanism to reduce tension in a lace cable wrapped around the spool, pushing lace cable from the spool into a lacing channel within a housing of the footwear lacing apparatus, collecting lace cable within relief areas of the lacing channel, and permitting lace cable to loosely exit the lacing channel from the relief areas to unwind the lace cable from the spool.

This initial overview is intended to introduce the subject matter of the present patent application. It is not intended to provide an exclusive or exhaustive explanation of the various inventions disclosed in the following more detailed description.

Automated Footwear Platform

The following discusses various components of the automated footwear platform including a motorized lacing engine, a mid-sole plate, and various other components of the platform. While much of this disclosure focuses on a motorized lacing engine, many of the mechanical aspects of the discussed designs are applicable to a human-powered lacing engine or other motorized lacing engines with additional or fewer capabilities. Accordingly, the term "automated" as used in "automated footwear platform" is not intended to only cover a system that operates without user input. Rather, the term "automated footwear platform" includes various electrically powered and human-power, automatically activated and human activated mechanisms for tightening a lacing or retention system of the footwear.

FIG. 1 is an exploded view illustration of components of a motorized lacing system for footwear, according to some example embodiments. The motorized lacing system 1 illustrated in FIG. 1 includes a lacing engine 10, a lid 20, an actuator 30, a mid-sole plate 40, a mid-sole 50, and an outsole 60. FIG. 1 illustrates the basic assembly sequence of components of an automated lacing footwear platform. The motorized lacing system 1 starts with the mid-sole plate 40 being secured within the mid-sole. Next, the actuator 30 is inserted into an opening in the lateral side of the mid-sole plate opposite to interface buttons that can be embedded in the outsole 60. Next, the lacing engine 10 is dropped into the mid-sole plate 40. In an example, the lacing system 1 is inserted under a continuous loop of lacing cable and the lacing cable is aligned with a spool in the lacing engine 10 (discussed below). Finally, the lid 20 is inserted into grooves in the mid-sole plate 40, secured into a closed position, and latched into a recess in the mid-sole plate 40. The lid 20 can capture the lacing engine 10 and can assist in maintaining alignment of a lacing cable during operation.

In an example, the footwear article or the motorized lacing system 1 includes or is configured to interface with one or more sensors that can monitor or determine a foot presence characteristic. Based on information from one or more foot presence sensors, the footwear including the motorized lacing system 1 can be configured to perform various functions. For example, a foot presence sensor can be configured to provide binary information about whether a foot is present or not present in the footwear. If a binary signal from the foot presence sensor indicates that a foot is present, then the motorized lacing system 1 can be activated, such as to automatically tighten or relax (i.e., loosen) a footwear lacing cable. In an example, the footwear article includes a processor circuit that can receive or interpret signals from a foot presence sensor. The processor circuit can optionally be embedded in or with the lacing engine 10, such as in a sole of the footwear article.

In an example, a foot presence sensor can be configured to provide information about a location of a foot as it enters footwear. The motorized lacing system 1 can generally be activated, such as to tighten a lacing cable, only when a foot is appropriately positioned or seated in the footwear, such as against all or a portion of the footwear article's sole. A foot presence sensor that senses information about a foot travel or location can provide information about whether a foot is fully or partially seated, such as relative to a sole or relative to some other feature of the footwear article. Automated lacing procedures can be interrupted or delayed until information from the sensor indicates that a foot is in a proper position.

In an example, a foot presence sensor can be configured to provide information about a relative location of a foot inside of footwear. For example, the foot presence sensor can be configured to sense whether the footwear is a good "fit" for a given foot, such as by determining a relative position of one or more of a foot's arch, heel, toe, or other component, such as relative to the corresponding portions of the footwear that are configured to receive such foot components. In an example, the foot presence sensor can be configured to sense whether a position of a foot or a foot component has changed relative to some reference, such as due to loosening of a lacing cable over time, or due to natural expansion and contraction of a foot itself.

In an example, a foot presence sensor can include an electrical magnetic, thermal, capacitive, pressure, optical, or other sensor device that can be configured to sense or receive information about a presence of a body. For example, an electrical sensor can include an impedance sensor that is configured to measure an impedance characteristic between at least two electrodes. When a body such as a foot is located proximal or adjacent to the electrodes, the electrical sensor can provide a sensor signal having a first value, and when a body is located remotely from the electrodes, the electrical sensor can provide a sensor signal having a different second value. For example, a first impedance value can be associated with an empty footwear condition, and a lesser second impedance value can be associated with an occupied footwear condition.

An electrical sensor can include an AC signal generator circuit and an antenna that is configured to emit or receive radio frequency information. Based on proximity of a body relative to the antenna, one or more electrical signal characteristics, such as impedance, frequency, or signal amplitude, can be received and analyzed to determine whether a body is present. In an example, a received signal strength indicator (RSSI) provides information about a power level in a received radio signal. Changes in the RSSI, such as relative to some baseline or reference value, can be used to identify a presence or absence of a body. In an example. WiFi frequencies can be used, for example in one or more of 2.4 GHz, 3.6 GHz, 4.9 GHz, 5 GHz, and 5.9 GHz bands. In an example, frequencies in the kilohertz range can be used, for example, around 400 kHz. In an example, power signal changes can be detected in milliwatt or microwatt ranges.

A foot presence sensor can include a magnetic sensor. A first magnetic sensor can include a magnet and a magnetometer. In an example, a magnetometer can be positioned in or near the lacing engine 10. A magnet can be located remotely from the lacing engine 10, such as in a secondary sole, or insole, that is configured to be worn above the outsole 60. In an example, the magnet is embedded in a foam or other compressible material of the secondary sole. As a user depresses the secondary sole such as when standing or walking, corresponding changes in the location of the magnet relative to the magnetometer can be sensed and reported via a sensor signal.

A second magnetic sensor can include a magnetic field sensor that is configured to sense changes or interruptions (e.g., via the Hall effect) in a magnetic field. When a body is proximal to the second magnetic sensor, the sensor can generate a signal that indicates a change to an ambient magnetic field. For example, the second magnetic sensor can include a Hall effect sensor that varies a voltage output signal in response to variations in a detected magnetic field. Voltage changes at the output signal can be due to production of a voltage difference across an electric signal conductor, such as transverse to an electric current in the conductor and a magnetic field perpendicular to the current.

In an example, the second magnetic sensor is configured to receive an electromagnetic field signal from a body. For example. Varshavsky et al., in U.S. Pat. No. 8,752,200, titled "Devices, systems and methods for security using magnetic field based identification", teaches using a body's unique electromagnetic signature for authentication. In an example, a magnetic sensor in a footwear article can be used to authenticate or verify that a present user is a shoe's owner via a detected electromagnetic signature, and that the article should lace automatically, such as according to one or more specified lacing preferences (e.g., tightness profile) of the owner.

In an example, a foot presence sensor includes a thermal sensor that is configured to sense a change in temperature in or near a portion of the footwear. When a wearer's foot enters a footwear article, the article's internal temperature changes when the wearer's own body temperature differs from an ambient temperature of the footwear article. Thus the thermal sensor can provide an indication that a foot is likely to present or not based on a temperature change.

In an example, a foot presence sensor includes a capacitive sensor that is configured to sense a change in capacitance. The capacitive sensor can include a single plate or electrode, or the capacitive sensor can include a multiple-plate or multiple-electrode configuration. Capacitive-type foot presence sensors are described at length below.

In an example, a foot presence sensor includes an optical sensor. The optical sensor can be configured to determine whether a line-of-sight is interrupted, such as between opposite sides of a footwear cavity. In an example, the optical sensor includes a light sensor that can be covered by a foot when the foot is inserted into the footwear. When the sensor indicates a change in a sensed lightness condition, an indication of a foot presence or position can be provided.

In an example, the housing structure 100 provides an air tight or hermetic seal around the components that are enclosed by the housing structure 100. In an example, the housing structure 100 encloses a separate, hermetically sealed cavity in which a pressure sensor can be disposed. See FIG. 17 and the corresponding discussion below regarding a pressure sensor disposed in a sealed cavity.

Figure 2A:
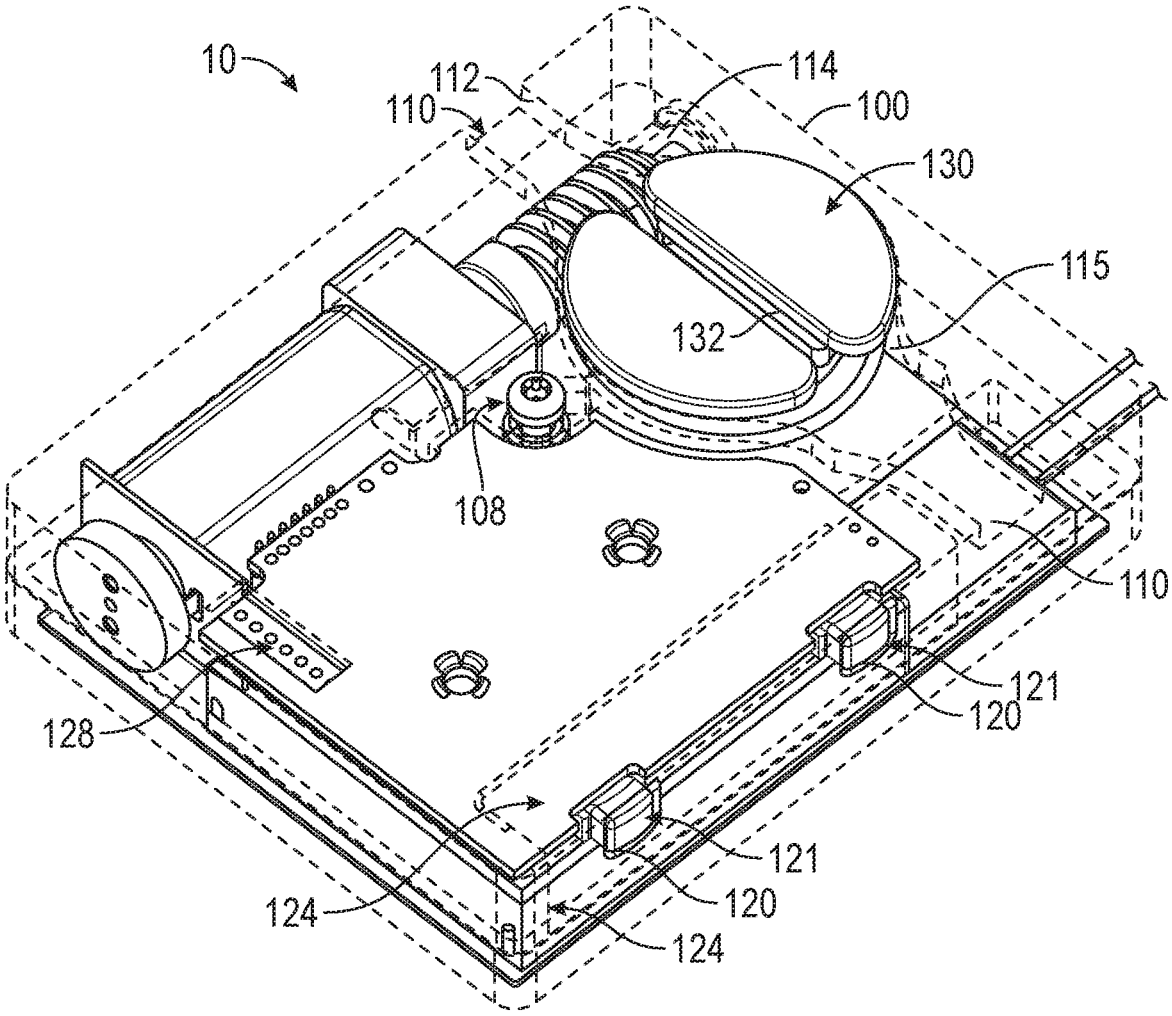
FIGS. 2A-2N are diagrams and drawings illustrating a motorized lacing engine, according to some example embodiments.
Figure 2B:
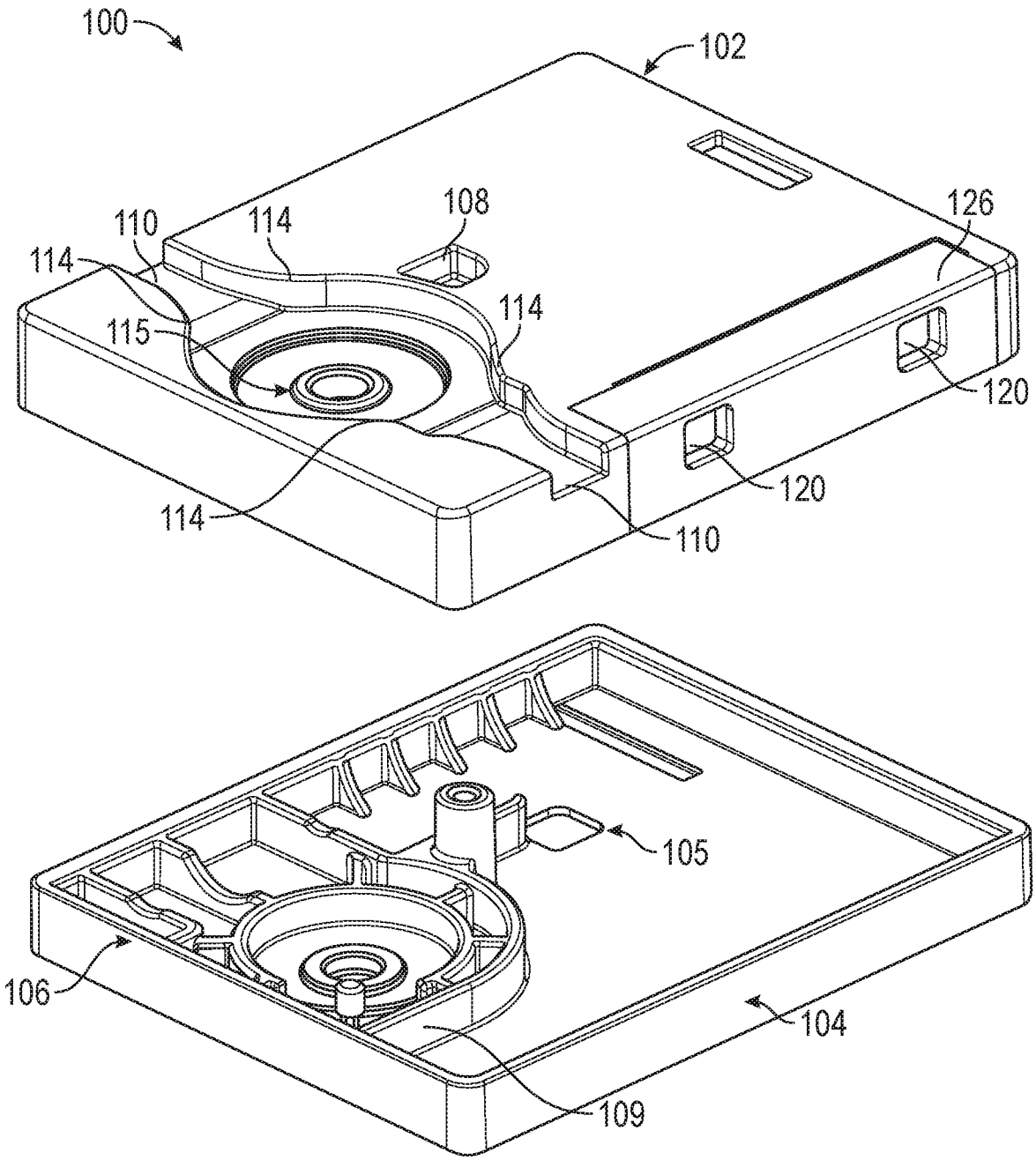
Figure 2C:
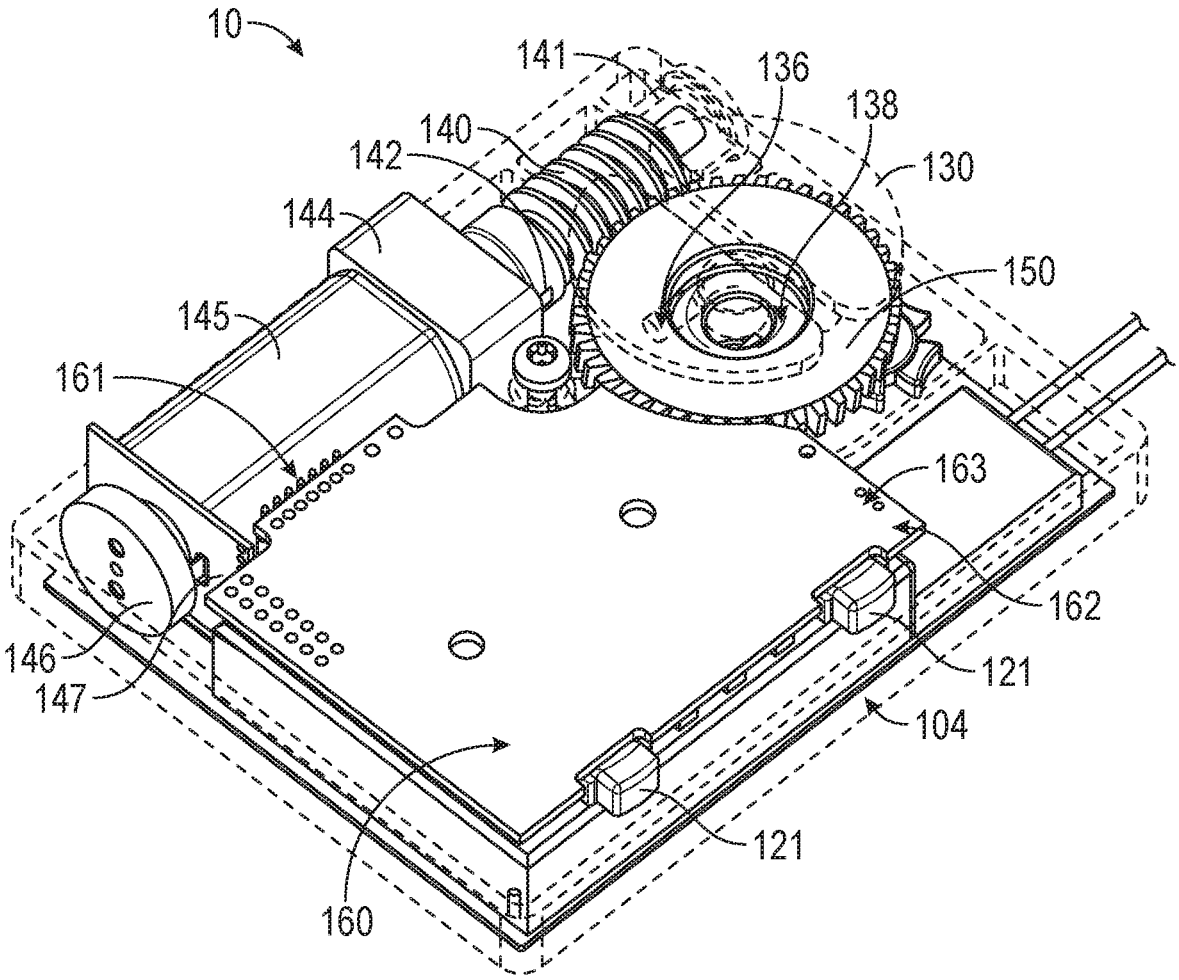
Figure 2D:
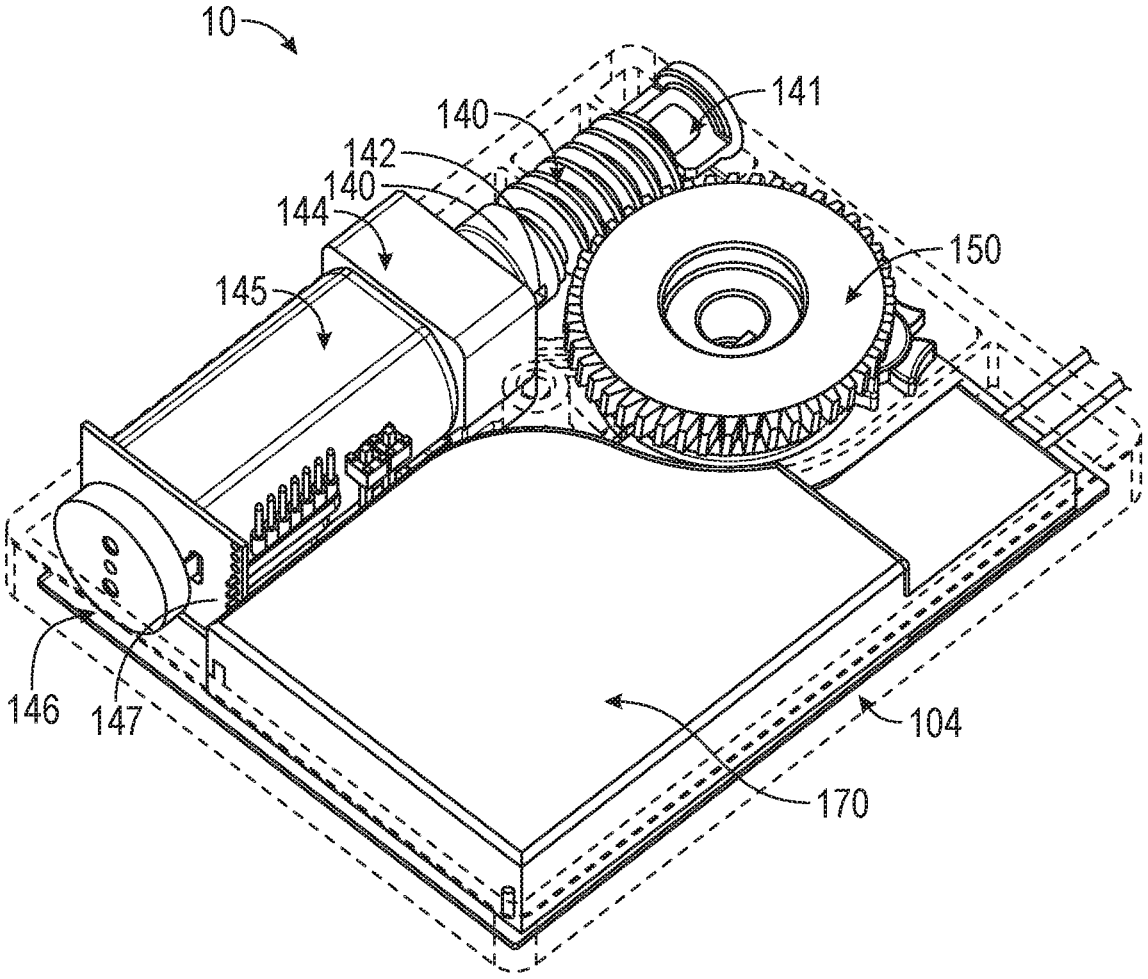
Figure 2E:
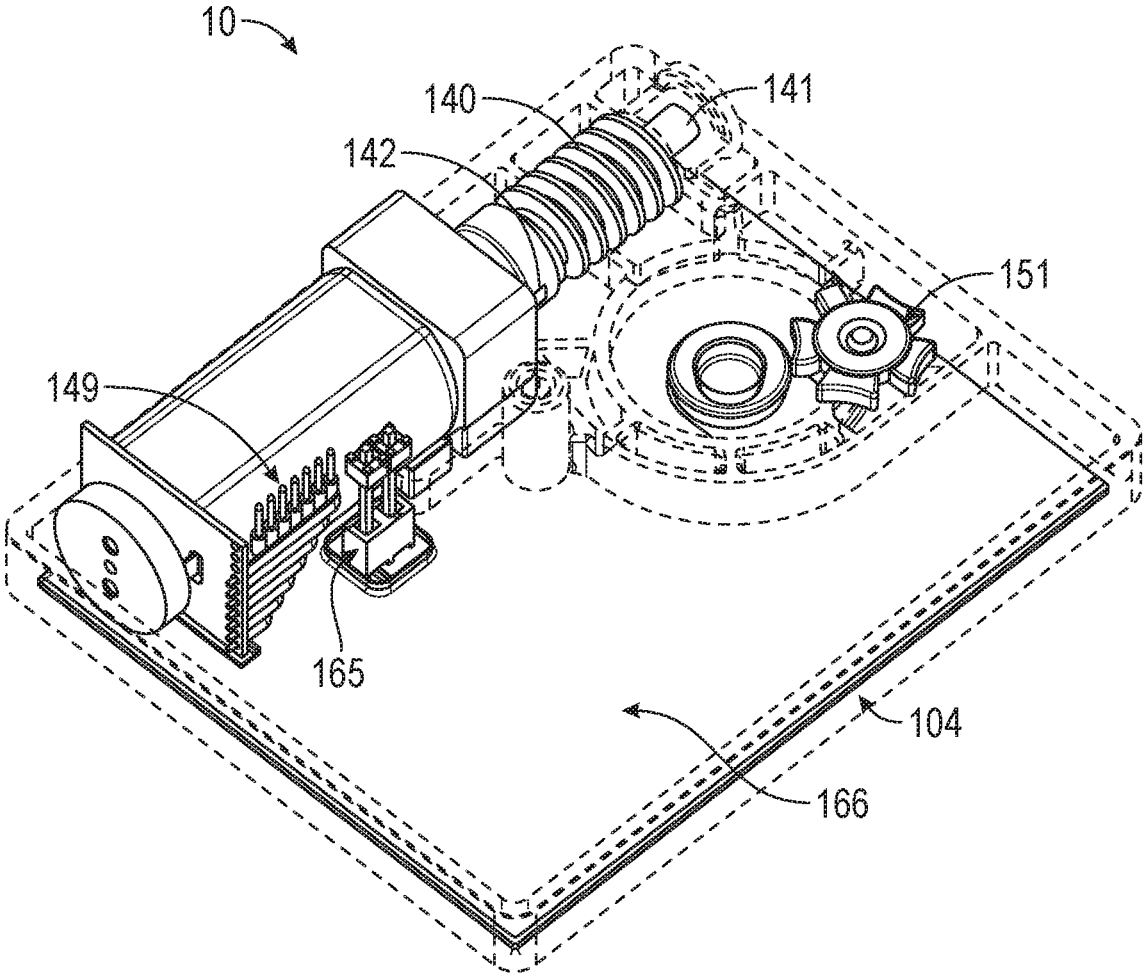
Figure 2F:
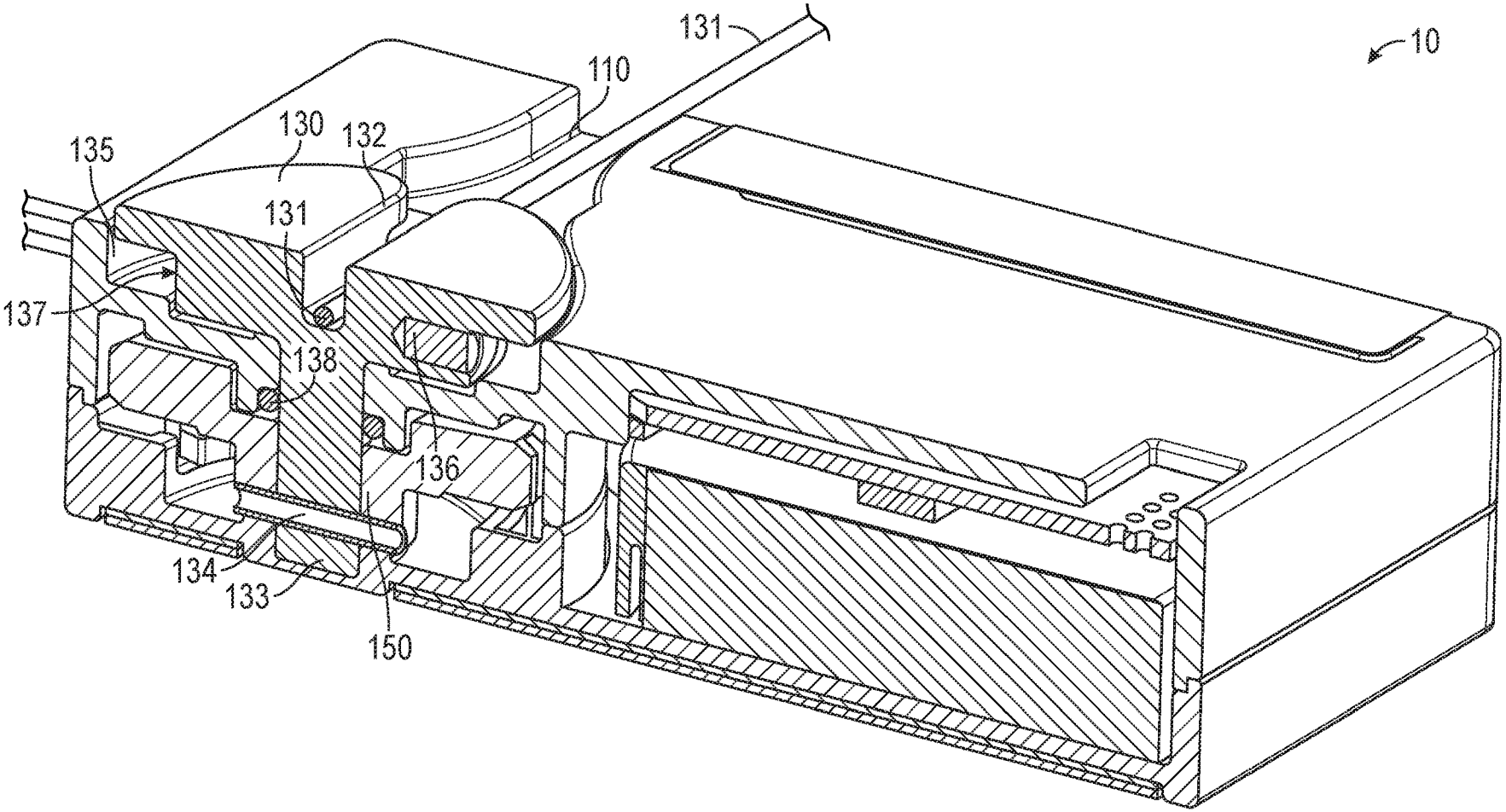
Figure 2G:
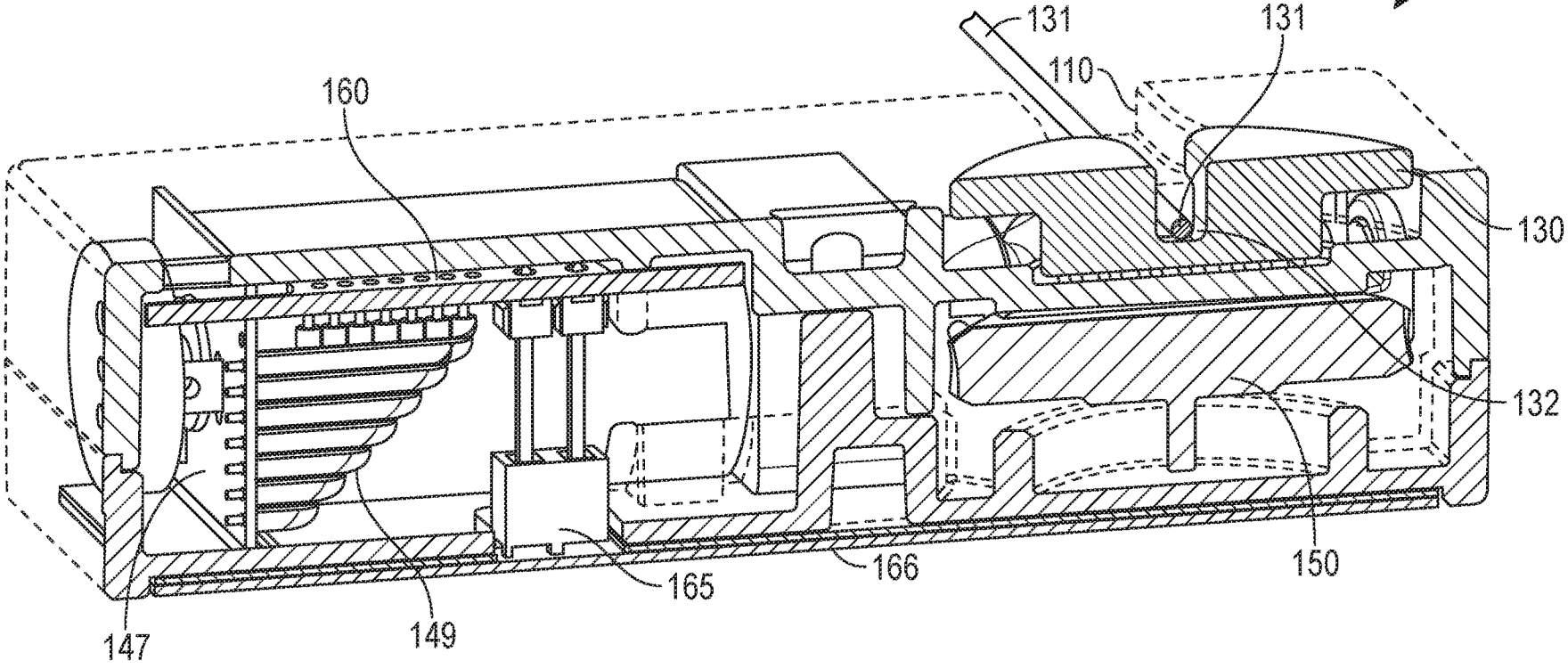
Figure 2H:
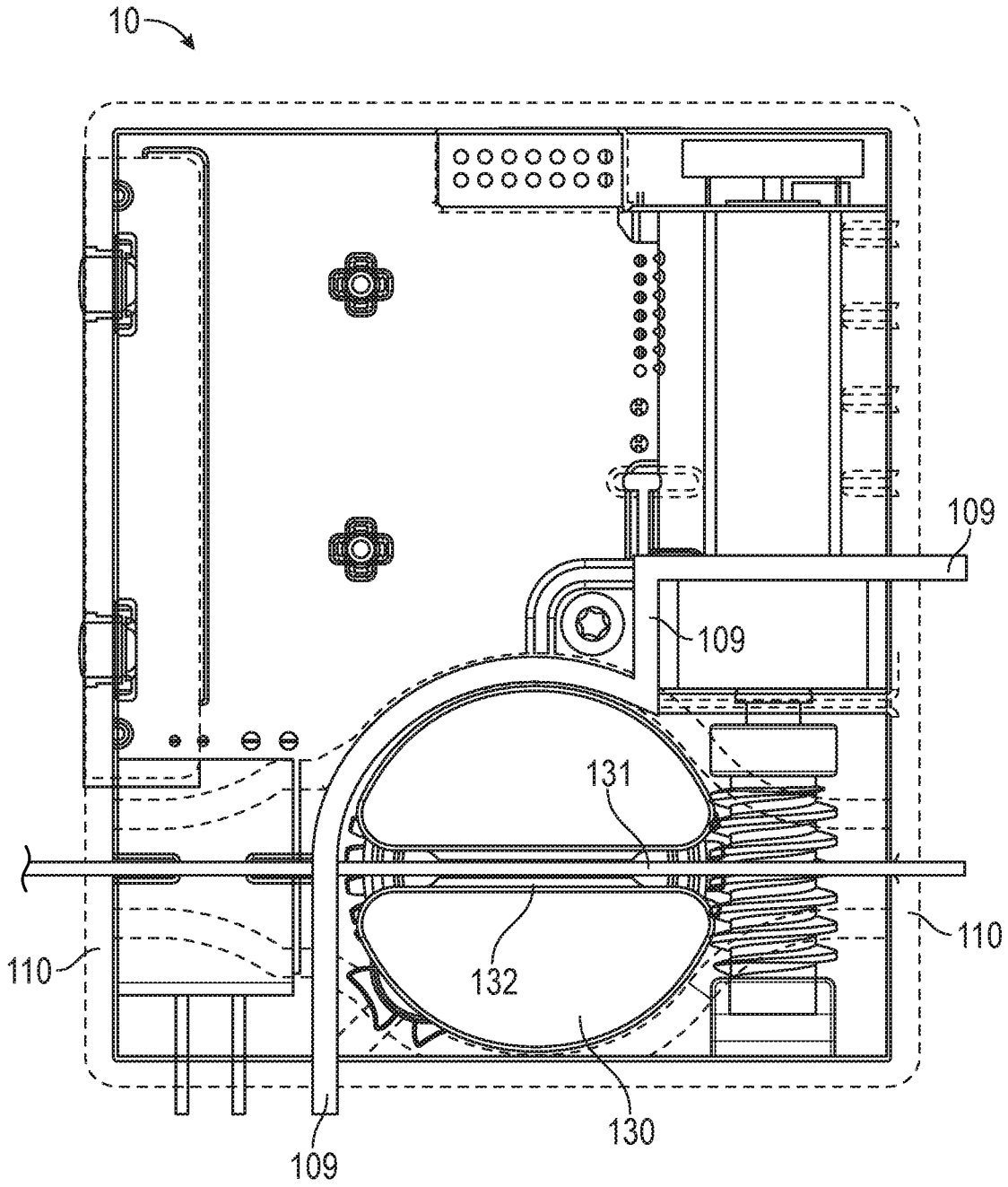
Figure 2I:
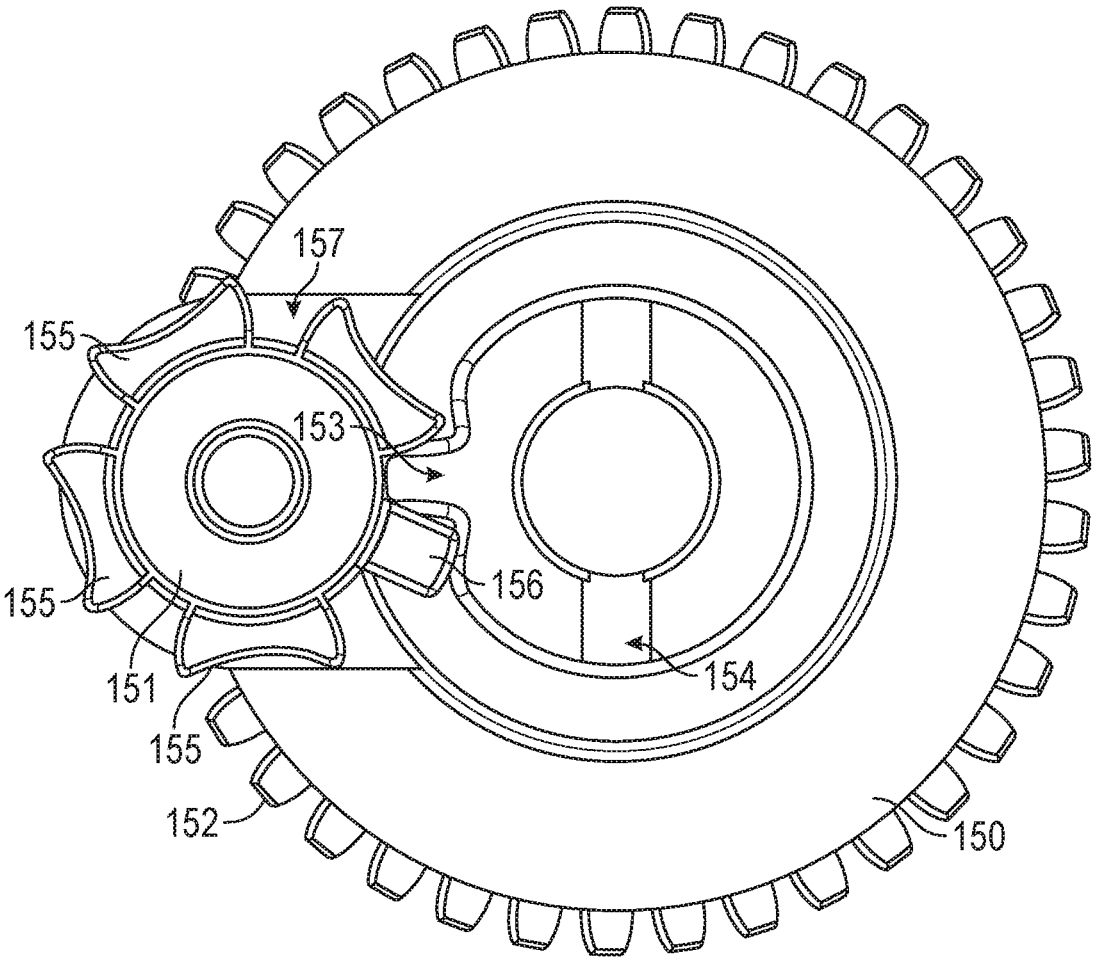
Figure 2J:
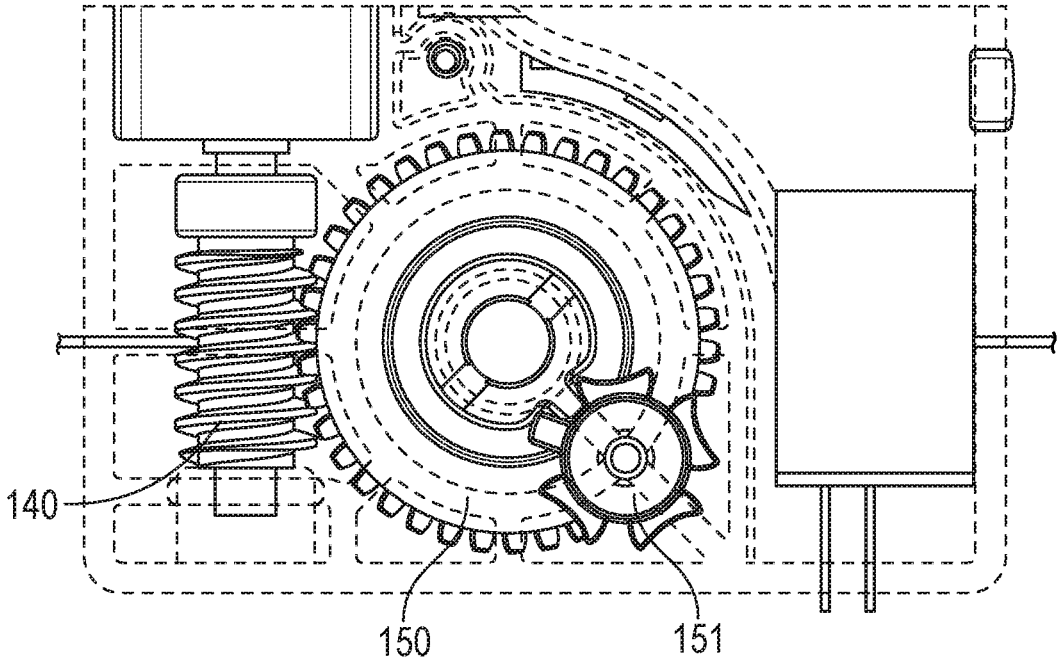
Figure 2K:
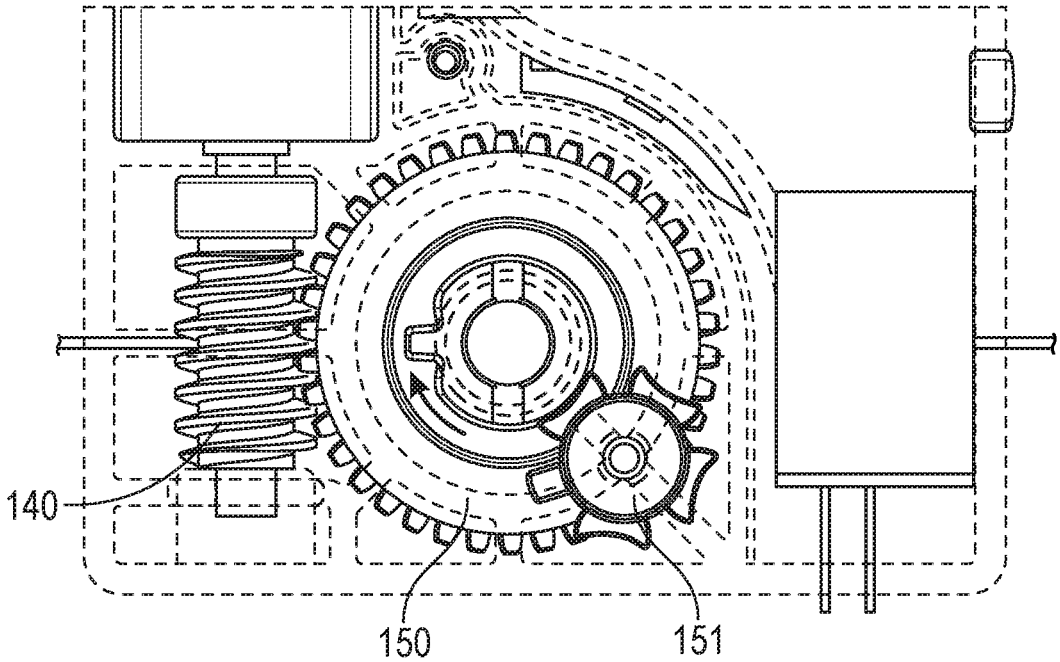
Figure 2L:
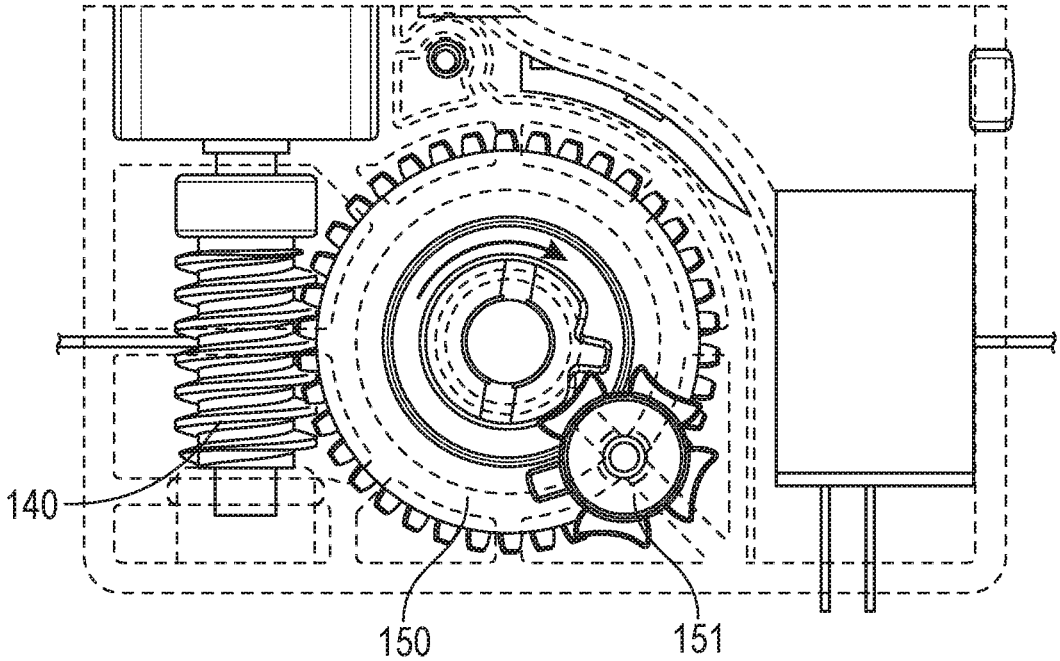
Figure 2M:
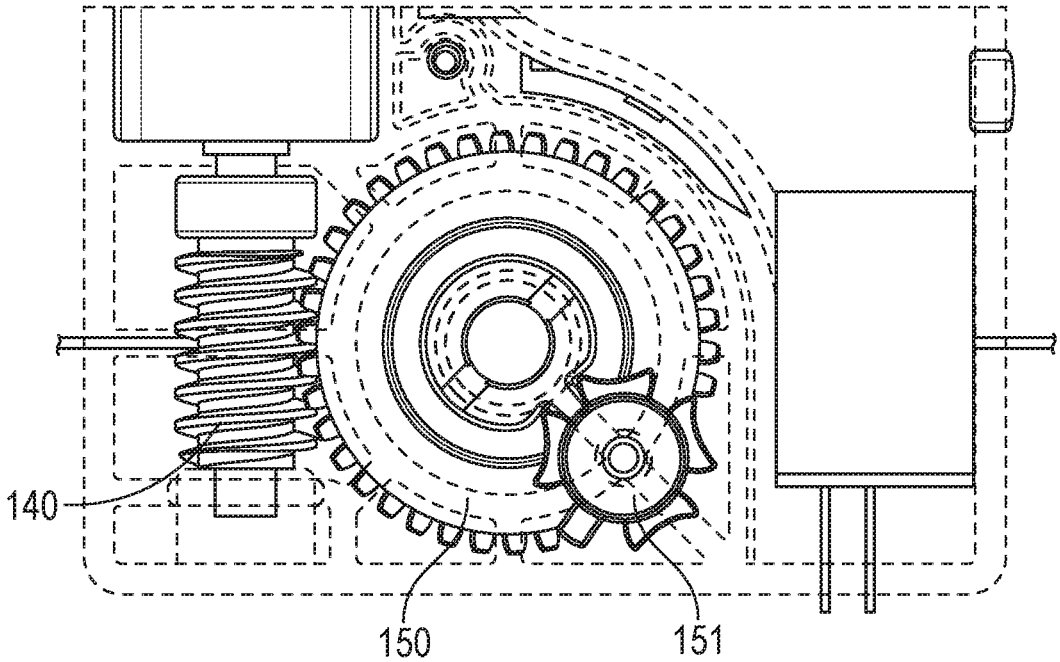
Figure 2N:
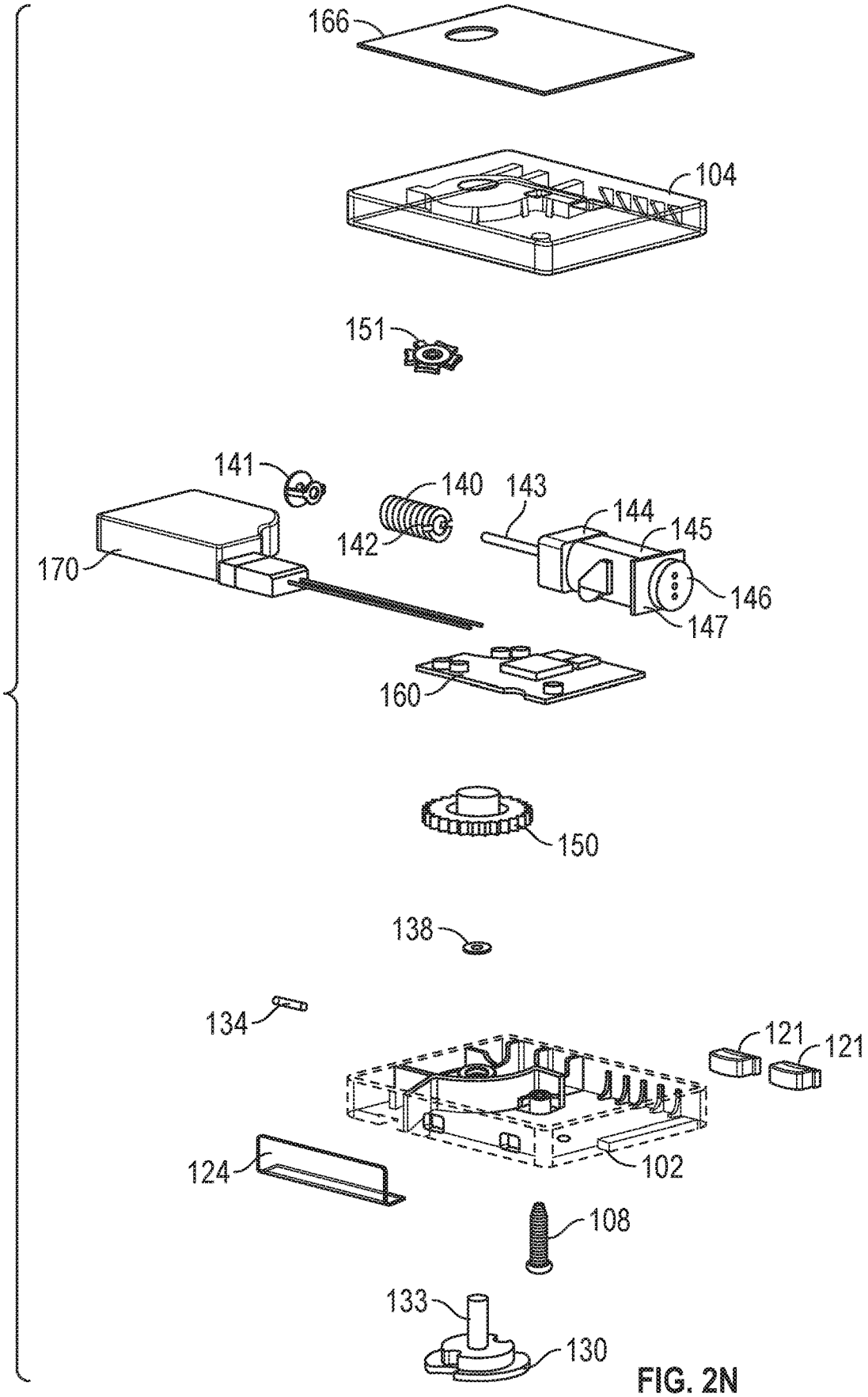

Examples of the lacing engine 10 are described in detail in reference to FIGS. 2A-2N. Examples of the actuator 30 are described in detail in reference to FIGS. 3A-3D. Examples of the mid-sole plate 40 are described in detail in reference to FIGS. 4A-4D. Various additional details of the motorized lacing system 1 are discussed throughout the remainder of the description.

FIGS. 2A-2N are diagrams and drawings illustrating a motorized lacing engine, according to some example embodiments. FIG. 2A introduces various external features of an example lacing engine 10, including a housing structure 100, case screw 108, lace channel 110 (also referred to as lace guide relief 110), lace channel wall 112, lace channel transition 114, spool recess 115, button openings 120, buttons 121, button membrane seal 124, programming header 128, spool 130, and lace grove 132. Additional details of the housing structure 100 are discussed below in reference to FIG. 2B.

In an example, the lacing engine 10 is held together by one or more screws, such as the case screw 108. The case screw 108 is positioned near the primary drive mechanisms to enhance structural integrity of the lacing engine 10. The case screw 108 also functions to assist the assembly process, such as holding the case together for ultra-sonic welding of exterior seams.

In this example, the lacing engine 10 includes a lace channel 110 to receive a lace or lace cable once assembled into the automated footwear platform. The lace channel 110 can include a lace channel wall 112. The lace channel wall 112 can include chamfered edges to provide a smooth guiding surface for a lace cable to run in during operation. Part of the smooth guiding surface of the lace channel 110 can include a channel transition 114, which is a widened portion of the lace channel 110 leading into the spool recess 115. The spool recess 115 transitions from the channel transition 114 into generally circular sections that conform closely to the profile of the spool 130. The spool recess 115 assists in retaining the spooled lace cable, as well as in retaining position of the spool 130. However, other aspects of the design provide primary retention of the spool 130. In this example, the spool 130 is shaped similarly to half of a yo-yo with a lace grove 132 running through a flat top surface and a spool shaft 133 (not shown in FIG. 2A) extending inferiorly from the opposite side. The spool 130 is described in further detail below in reference of additional figures.

The lateral side of the lacing engine 10 includes button openings 120 that enable buttons 121 for activation of the mechanism to extend through the housing structure 100. The buttons 121 provide an external interface for activation of switches 122, illustrated in additional figures discussed below. In some examples, the housing structure 100 includes button membrane seal 124 to provide protection from dirt and water. In this example, the button membrane seal 124 is up to a few mils (thousandth of an inch) thick clear plastic (or similar material) adhered from a superior surface of the housing structure 100 over a corner and down a lateral side. In another example, the button membrane seal 124 is a 2 mil thick vinyl adhesive backed membrane covering the buttons 121 and button openings 120.

FIG. 2B is an illustration of housing structure 100 including top section 102 and bottom section 104. In this example, the top section 102 includes features such as the case screw 108, lace channel 110, lace channel transition 114, spool recess 115, button openings 120, and button seal recess 126. The button seal recess 126 is a portion of the top section 102 relieved to provide an inset for the button membrane seal 124. In this example, the button seal recess 126 is a couple mil recessed portion on the lateral side of the superior surface of the top section 104 transitioning over a portion of the lateral edge of the superior surface and down the length of a portion of the lateral side of the top section 104.

In this example, the bottom section 104 includes features such as wireless charger access 105, joint 106, and grease isolation wall 109. Also illustrated, but not specifically identified, is the case screw base for receiving case screw 108 as well as various features within the grease isolation wall 109 for holding portions of a drive mechanism. The grease isolation wall 109 is designed to retain grease or similar compounds surrounding the drive mechanism away from the electrical components of the lacing engine 10 including the gear motor and enclosed gear box.

FIG. 2C is an illustration of various internal components of lacing engine 10, according to example embodiments. In this example, the lacing engine 10 further includes spool magnet 136. O-ring seal 138, worm drive 140, bushing 141, worm drive key 142, gear box 144, gear motor 145, motor encoder 146, motor circuit board 147, worm gear 150, circuit board 160, motor header 161, battery connection 162, and wired charging header 163. The spool magnet 136 assists in tracking movement of the spool 130 though detection by a magnetometer (not shown in FIG. 2C). The o-ring seal 138 functions to seal out dirt and moisture that could migrate into the lacing engine 10 around the spool shaft 133.

In this example, major drive components of the lacing engine 10 include worm drive 140, worm gear 150, gear motor 145 and gear box 144. The worm gear 150 is designed to inhibit back driving of worm drive 140 and gear motor 145, which means the major input forces coming in from the lacing cable via the spool 130 are resolved on the comparatively large worm gear and worm drive teeth. This arrangement protects the gear box 144 from needing to include gears of sufficient strength to withstand both the dynamic loading from active use of the footwear platform or tightening loading from tightening the lacing system. The worm drive 140 includes additional features to assist in protecting the more fragile portions of the drive system, such as the worm drive key 142. In this example, the worm drive key 142 is a radial slot in the motor end of the worm drive 140 that interfaces with a pin through the drive shaft coming out of the gear box 144. This arrangement prevents the worm drive 140 from imparting any axial forces on the gear box 144 or gear motor 145 by allowing the worm drive 140 to move freely in an axial direction (away from the gear box 144) transferring those axial loads onto bushing 141 and the housing structure 100.

FIG. 2D is an illustration depicting additional internal components of the lacing engine 10. In this example, the lacing engine 10 includes drive components such as worm drive 140, bushing 141, gear box 144, gear motor 145, motor encoder 146, motor circuit board 147 and worm gear 150. FIG. 2D adds illustration of battery 170 as well as a better view of some of the drive components discussed above.

FIG. 2E is another illustration depicting internal components of the lacing engine 10. In FIG. 2E the worm gear 150 is removed to better illustrate the indexing wheel 151 (also referred to as the Geneva wheel 151). The indexing wheel 151, as described in further detail below, provides a mechanism to home the drive mechanism in case of electrical or mechanical failure and loss of position. In this example, the lacing engine 10 also includes a wireless charging interconnect 165 and a wireless charging coil 166, which are located inferior to the battery 170 (which is not shown in this figure). In this example, the wireless charging coil 166 is mounted on an external inferior surface of the bottom section 104 of the lacing engine 10.

FIG. 2F is a cross-section illustration of the lacing engine 10, according to example embodiments. FIG. 2F assists in illustrating the structure of the spool 130 as well as how the lace grove 132 and lace channel 110 interface with lace cable 131. As shown in this example, lace 131 runs continuously through the lace channel 110 and into the lace grove 132 of the spool 130. The cross-section illustration also depicts lace recess 135, which is where the lace 131 will build up as it is taken up by rotation of the spool 130. The lace 131 is captured by the lace groove 132 as it runs across the lacing engine 10, so that when the spool 130 is turned, the lace 131 is rotated onto a body of the spool 130 within the lace recess 135.

As illustrated by the cross-section of lacing engine 10, the spool 130 includes a spool shaft 133 that couples with worm gear 150 after running through an O-ring 138. In this example, the spool shaft 133 is coupled to the worm gear via keyed connection pin 134. In some examples, the keyed connection pin 134 only extends from the spool shaft 133 in one axial direction, and is contacted by a key on the worm gear in such a way as to allow for an almost complete revolution of the worm gear 150 before the keyed connection pin 134 is contacted when the direction of worm gear 150 is reversed. A clutch system could also be implemented to couple the spool 130 to the worm gear 150. In such an example, the clutch mechanism could be deactivated to allow the spool 130 to run free upon de-lacing (loosening). In the example of the keyed connection pin 134 only extending is one axial direction from the spool shaft 133, the spool is allowed to move freely upon initial activation of a de-lacing process, while the worm gear 150 is driven backward. Allowing the spool 130 to move freely during the initial portion of a de-lacing process assists in preventing tangles in the lace 131 as it provides time for the user to begin loosening the footwear, which in turn will tension the lace 131 in the loosening direction prior to being driven by the worm gear 150.

FIG. 2G is another cross-section illustration of the lacing engine 10, according to example embodiments. FIG. 2G illustrates a more medial cross-section of the lacing engine 10, as compared to FIG. 2F, which illustrates additional components such as circuit board 160, wireless charging interconnect 165, and wireless charging coil 166. FIG. 2G is also used to depict additional detail surround the spool 130 and lace 131 interface.

FIG. 2H is a top view of the lacing engine 10, according to example embodiments. FIG. 2H emphasizes the grease isolation wall 109 and illustrates how the grease isolation wall 109 surrounds certain portions of the drive mechanism, including spool 130, worm gear 150, worm drive 140, and gear box 145. In certain examples, the grease isolation wall 109 separates worm drive 140 from gear box 145. FIG. 2H also provides a top view of the interface between spool 130 and lace cable 131, with the lace cable 131 running in a medial-lateral direction through lace groove 132 in spool 130.

FIG. 2I is a top view illustration of the worm gear 150 and index wheel 151 portions of lacing engine 10, according to example embodiments. The index wheel 151 is a variation on the well-known Geneva wheel used in watchmaking and film projectors. A typical Geneva wheel or drive mechanism provides a method of translating continuous rotational movement into intermittent motion, such as is needed in a film projector or to make the second hand of a watch move intermittently. Watchmakers used a different type of Geneva wheel to prevent over-winding of a mechanical watch spring, but using a Geneva wheel with a missing slot (e.g., one of the Geneva slots 157 would be missing). The missing slot would prevent further indexing of the Geneva wheel, which was responsible for winding the spring and prevents over-winding. In the illustrated example, the lacing engine 10 includes a variation on the Geneva wheel, indexing wheel 151, which includes a small stop tooth 156 that acts as a stopping mechanism in a homing operation. As illustrated in FIGS. 2J-2M, the standard Geneva teeth 155 simply index for each rotation of the worm gear 150 when the index tooth 152 engages the Geneva slot 157 next to one of the Geneva teeth 155. However, when the index tooth 152 engages the Geneva slot 157 next to the stop tooth 156 a larger force is generated, which can be used to stall the drive mechanism in a homing operation. The stop tooth 156 can be used to create a known location of the mechanism for homing in case of loss of other positioning information, such as the motor encoder 146.

FIG. 2J-2M are illustrations of the worm gear 150 and index wheel 151 moving through an index operation, according to example embodiments. As discussed above, these figures illustrate what happens during a single full revolution of the worm gear 150 starting with FIG. 2J though FIG. 2M. In FIG. 2J, the index tooth 153 of the worm gear 150 is engaged in the Geneva slot 157 between a first Geneva tooth 155*a* of the Geneva teeth 155 and the stop tooth 156. FIG. 2K illustrates the index wheel 151 in a first index position, which is maintained as the index tooth 153 starts its revolution with the worm gear 150. In FIG. 2L, the index tooth 153 begins to engage the Geneva slot 157 on the opposite side of the first Geneva tooth 155*a*. Finally, in FIG. 2M the index tooth 153 is fully engaged within a Geneva lot 157 between the first Geneva tooth 155*a* and a second Geneva tooth 155*b*. The process shown in FIGS. 2J-2M continues with each revolution of the worm gear 150 until the index tooth 153 engages the stop tooth 156. As discussed above, wen the index tooth 153 engages the stop tooth 156, the increased forces can stall the drive mechanism.

FIG. 2N is an exploded view of lacing engine 10, according to example embodiments. The exploded view of the lacing engine 10 provides an illustration of how all the various components fit together. FIG. 2N shows the lacing engine 10 upside down, with the bottom section 104 at the top of the page and the top section 102 near the bottom. In this example, the wireless charging coil 166 is shown as being adhered to the outside (bottom) of the bottom section 104. The exploded view also provide a good illustration of how the worm drive 140 is assembled with the bushing 141, drive shaft 143, gear box 144 and gear motor 145. The illustration does not include a drive shaft pin that is received within the worm drive key 142 on a first end of the worm drive 140. As discussed above, the worm drive 140 slides over the drive shaft 143 to engage a drive shaft pin in the worm drive key 142, which is essentially a slot running transverse to the drive shaft 143 in a first end of the worm drive 140.

Figure 3A:
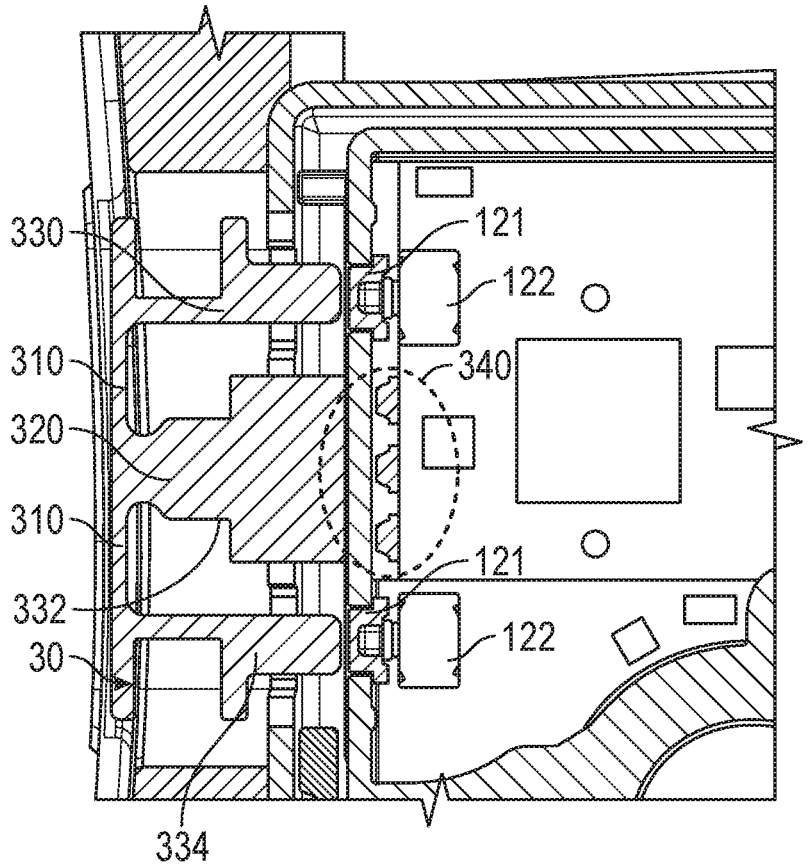
FIGS. 3A-3D are diagrams and drawings illustrating an actuator for interfacing with a motorized lacing engine, according to some example embodiments.

FIGS. 3A-3D are diagrams and drawings illustrating an actuator 30 for interfacing with a motorized lacing engine, according to an example embodiment. In this example, the actuator 30 includes features such as bridge 310, light pipe 320, posterior arm 330, central arm 332, and anterior arm 334. FIG. 3A also illustrates related features of lacing engine 10, such as LEDs 340 (also referenced as LED 340), buttons 121 and switches 122. In this example, the posterior arm 330 and anterior arm 334 each can separately activate one of the switches 122 through buttons 121. The actuator 30 is also designed to enable activation of both switches 122 simultaneously, for things like reset or other functions. The primary function of the actuator 30 is to provide tightening and loosening commands to the lacing engine 10. The actuator 30 also includes a light pipe 320 that directs light from LEDs 340 out to the external portion of the footwear platform (e.g., outsole 60). The light pipe 320 is structured to disperse light from multiple individual LED sources evening across the face of actuator 30.

In this example, the arms of the actuator 30, posterior arm 330 and anterior arm 334, include flanges to prevent over activation of switches 122 providing a measure of safety against impacts against the side of the footwear platform. The large central arm 332 is also designed to carry impact loads against the side of the lacing engine 10, instead of allowing transmission of these loads against the buttons 121.

Figure 3B:
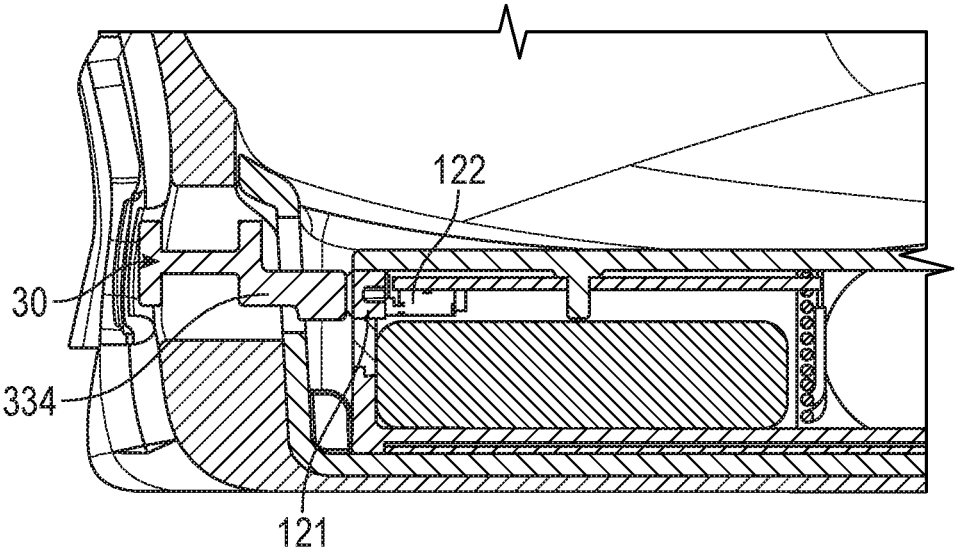
Figure 3C:
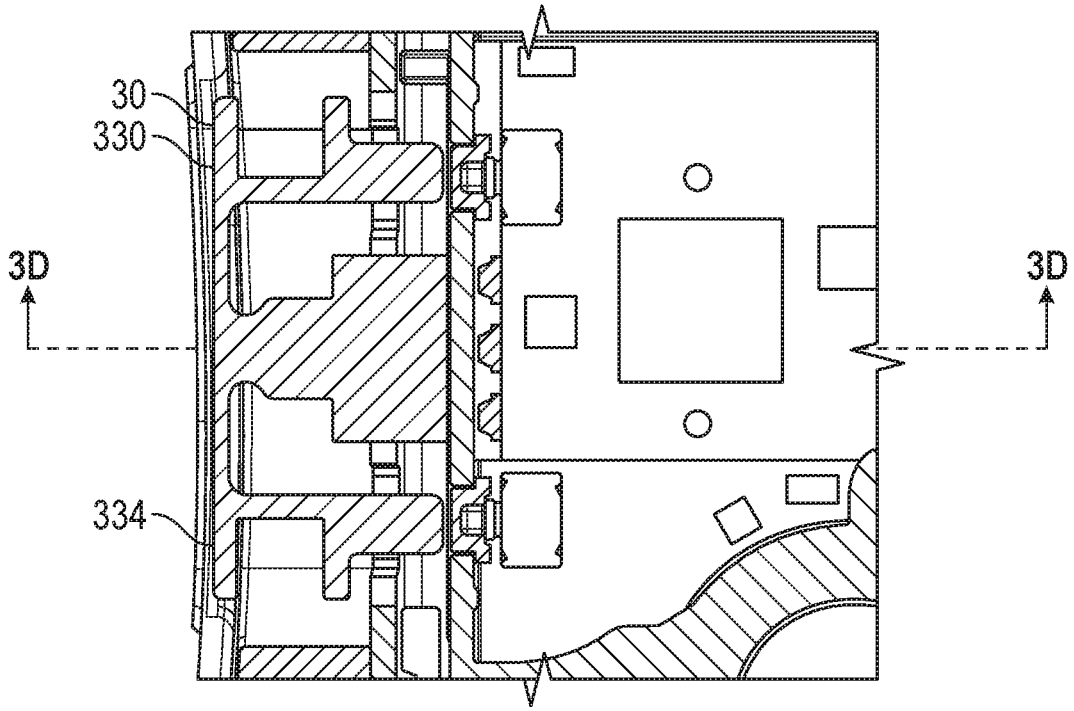
Figure 3D:
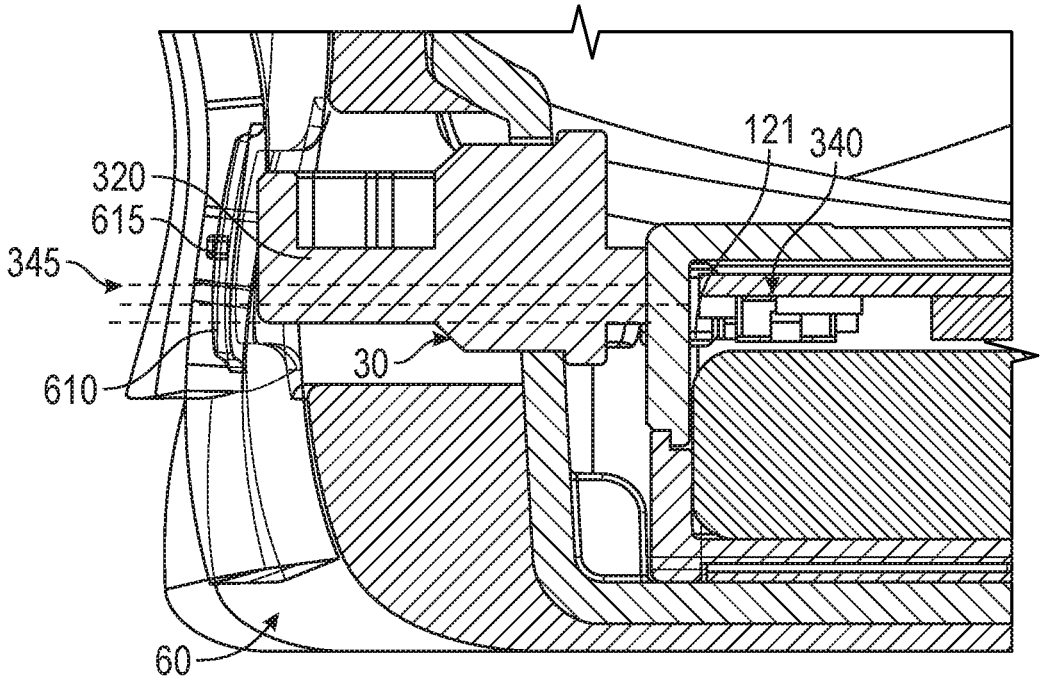

FIG. 3B provides a side view of the actuator 30, which further illustrates an example structure of anterior arm 334 and engagement with button 121. FIG. 3C is an additional top view of actuator 30 illustrating activation paths through posterior arm 330 and anterior arm 334. FIG. 3C also depicts section line A-A, which corresponds to the cross-section illustrated in FIG. 3D. In FIG. 3D, the actuator 30 is illustrated in cross-section with transmitted light 345 shown in dotted lines. The light pipe 320 provides a transmission medium for transmitted light 345 from LEDs 340. FIG. 3D also illustrates aspects of outsole 60, such as actuator cover 610 and raised actuator interface 615.

FIGS. 4A-4D are diagrams and drawings illustrating a mid-sole plate 40 for holding lacing engine 10, according to some example embodiments. In this example, the mid-sole plate 40 includes features such as lacing engine cavity 410, medial lace guide 420, lateral lace guide 421, lid slot 430, anterior flange 440, posterior flange 450, a superior surface 460, an inferior surface 470, and an actuator cutout 480. The lacing engine cavity 410 is designed to receive lacing engine 10. In this example, the lacing engine cavity 410 retains the lacing engine 10 is lateral and anterior/posterior directions, but does not include any built in feature to lock the lacing engine 10 in to the pocket. Optionally, the lacing engine cavity 410 can include detents, tabs, or similar mechanical features along one or more sidewalls that could positively retain the lacing engine 10 within the lacing engine cavity 410.

The medial lace guide 420 and lateral lace guide 421 assist in guiding lace cable into the lace engine pocket 410 and over lacing engine 10 (when present). The medial/lateral lace guides 420, 421 can include chamfered edges and inferiorly slated ramps to assist in guiding the lace cable into the desired position over the lacing engine 10. In this example, the medial/lateral lace guides 420, 421 include openings in the sides of the mid-sole plate 40 that are many times wider than the typical lacing cable diameter, in other examples the openings for the medial/lateral lace guides 420, 421 may only be a couple times wider than the lacing cable diameter.

In this example, the mid-sole plate 40 includes a sculpted or contoured anterior flange 440 that extends much further on the medial side of the mid-sole plate 40. The example anterior flange 440 is designed to provide additional support under the arch of the footwear platform. However, in other examples the anterior flange 440 may be less pronounced in on the medial side. In this example, the posterior flange 450 also includes a particular contour with extended portions on both the medial and lateral sides. The illustrated posterior flange 450 shape provides enhanced lateral stability for the lacing engine 10.

Figure 4A:
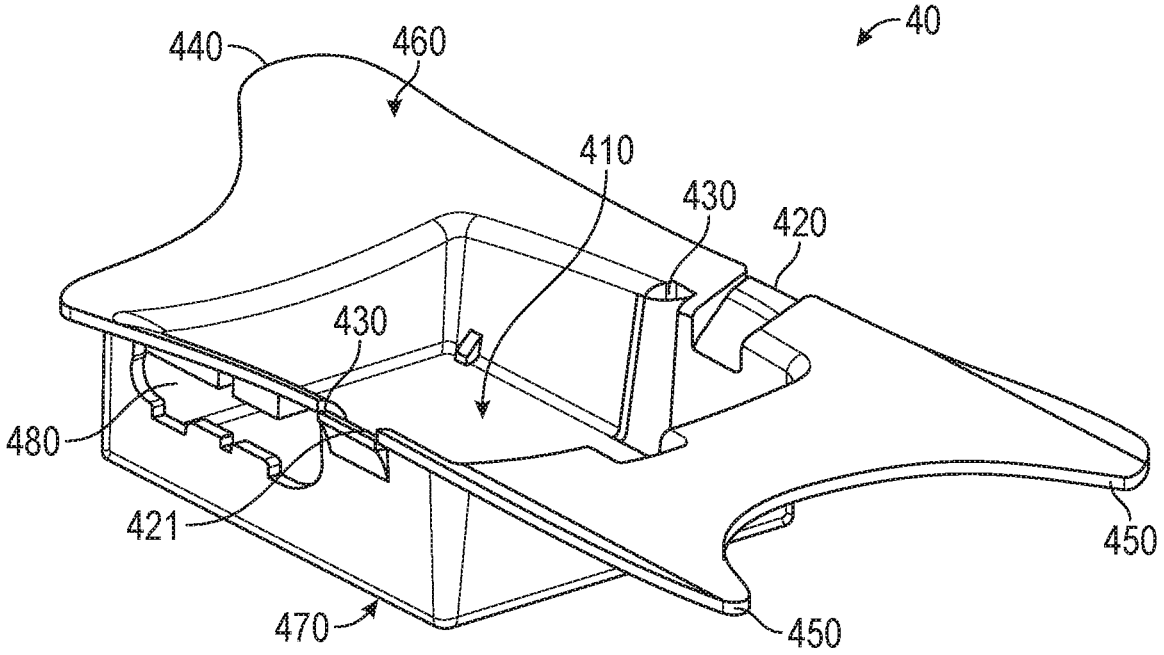
FIGS. 4A-4D are diagrams and drawings illustrating a mid-sole plate for holding a lacing engine, according to some example embodiments.
Figure 4B:
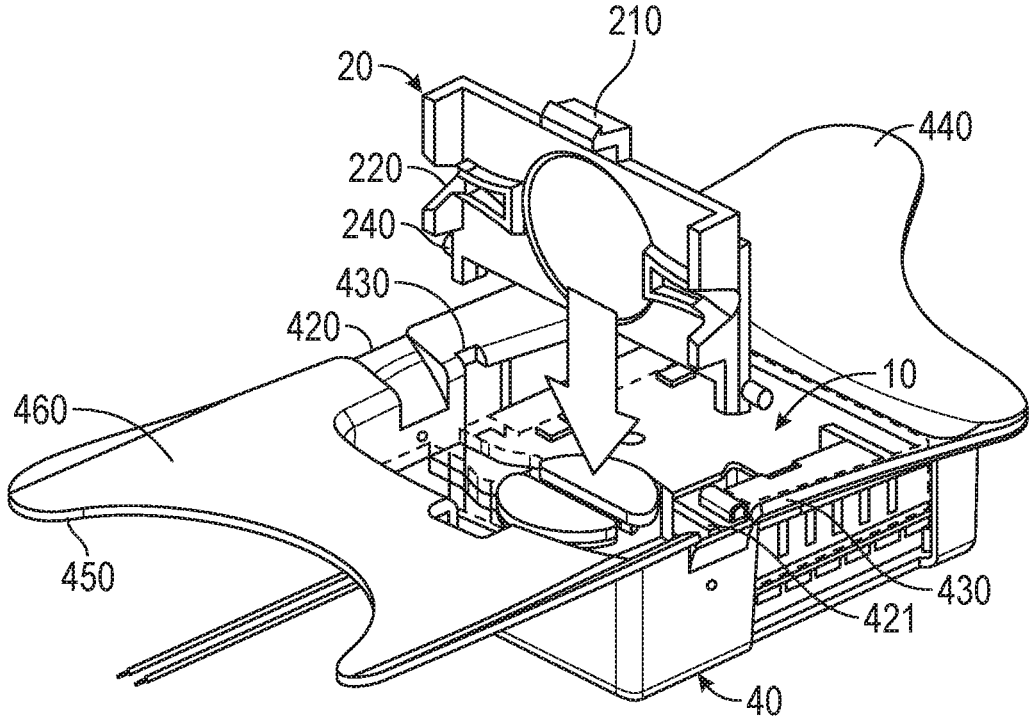
Figure 4C:
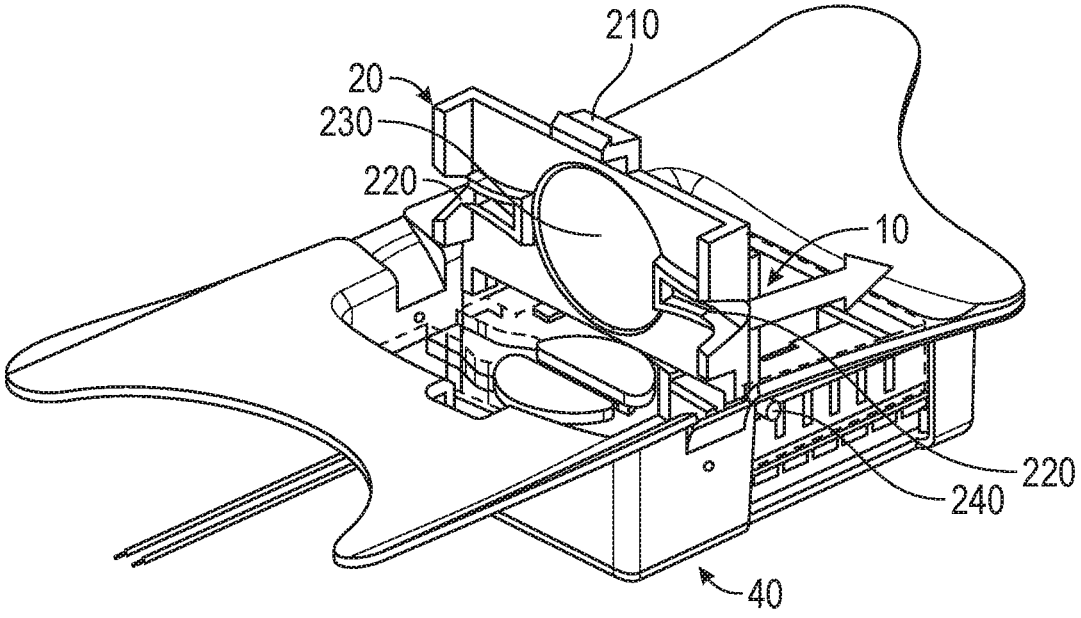
Figure 4D:
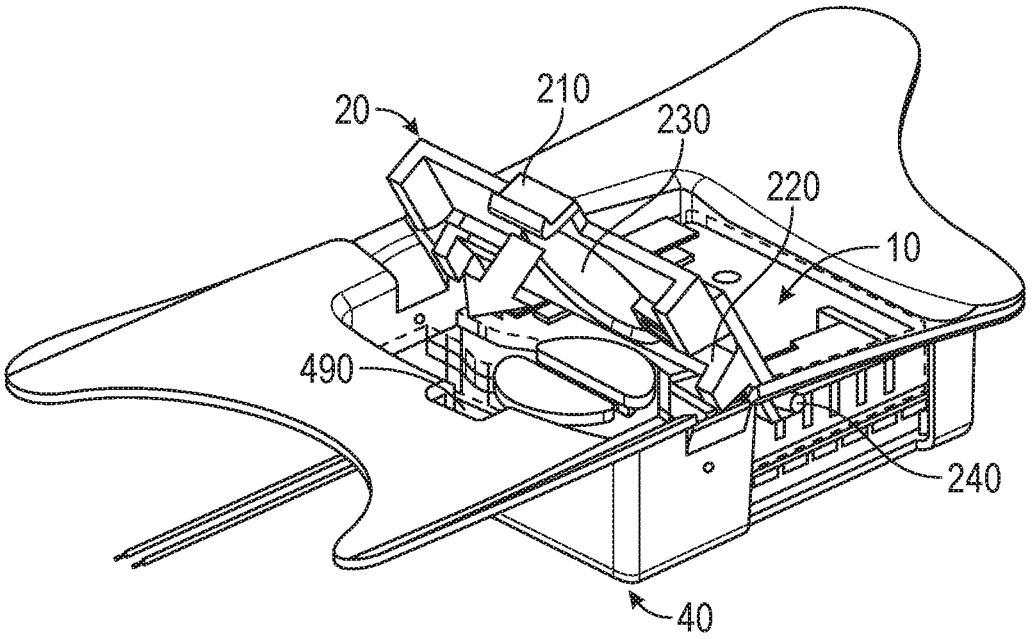

FIGS. 4B-4D illustrate insertion of the lid 20 into the mid-sole plate 40 to retain the lacing engine 10 and capture lace cable 131. In this example, the lid 20 includes features such as latch 210, lid lace guides 220, lid spool recess 230, and lid clips 240. The lid lace guides 220 can include both medial and lateral lid lace guides 220. The lid lace guides 220 assist in maintaining alignment of the lace cable 131 through the proper portion of the lacing engine 10. The lid clips 240 can also include both medial and lateral lid clips 240. The lid clips 240 provide a pivot point for attachment of the lid 20 to the mid-sole plate 40. As illustrated in FIG. 4B, the lid 20 is inserted straight down into the mid-sole plate 40 with the lid clips 240 entering the mid-sole plate 40 via the lid slots 430.

As illustrated in FIG. 4C, once the lid clips 240 are inserted through the lid slots 430, the lid 20 is shifted anteriorly to keep the lid clips 240 from disengaging from the mid-sole plate 40. FIG. 4D illustrates rotation or pivoting of the lid 20 about the lid clips 240 to secure the lacing engine 10 and lace cable 131 by engagement of the latch 210 with a lid latch recess 490 in the mid-sole plate 40. Once snapped into position, the lid 20 secures the lacing engine 10 within the mid-sole plate 40.

Figure 5A:
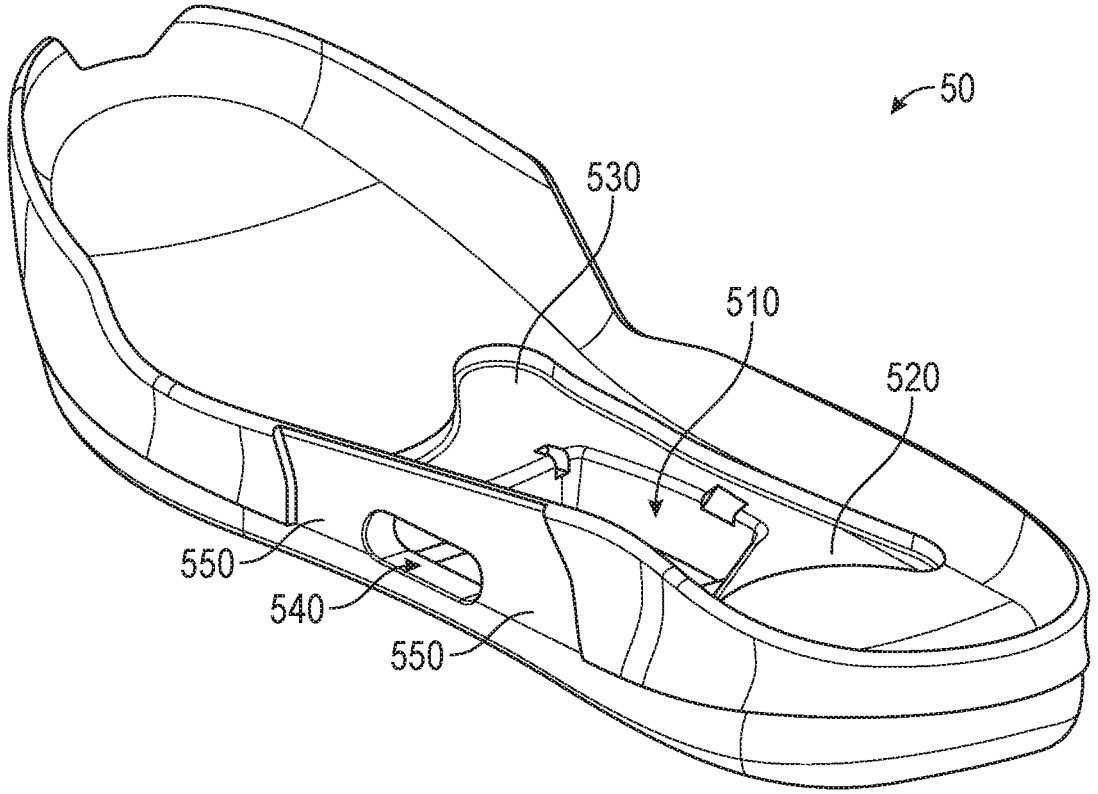
FIGS. 5A-5D are diagrams and drawings illustrating a mid-sole and out-sole to accommodate a lacing engine and related components, according to some example embodiments.
Figure 5B:
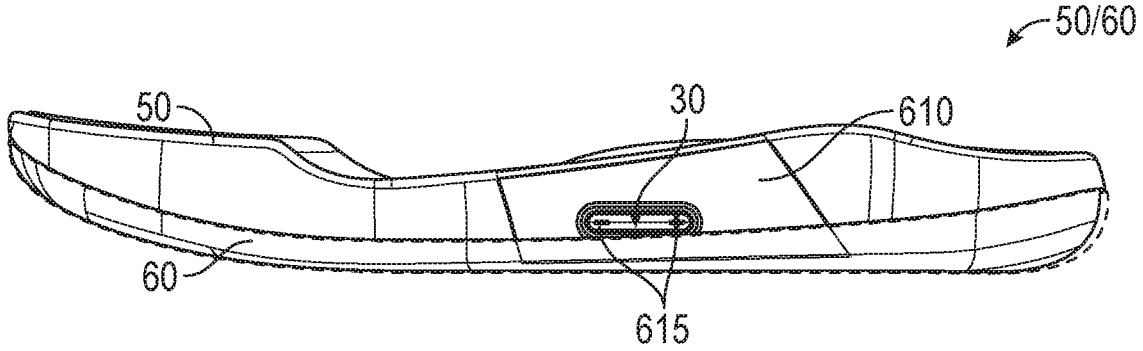
Figure 5C:
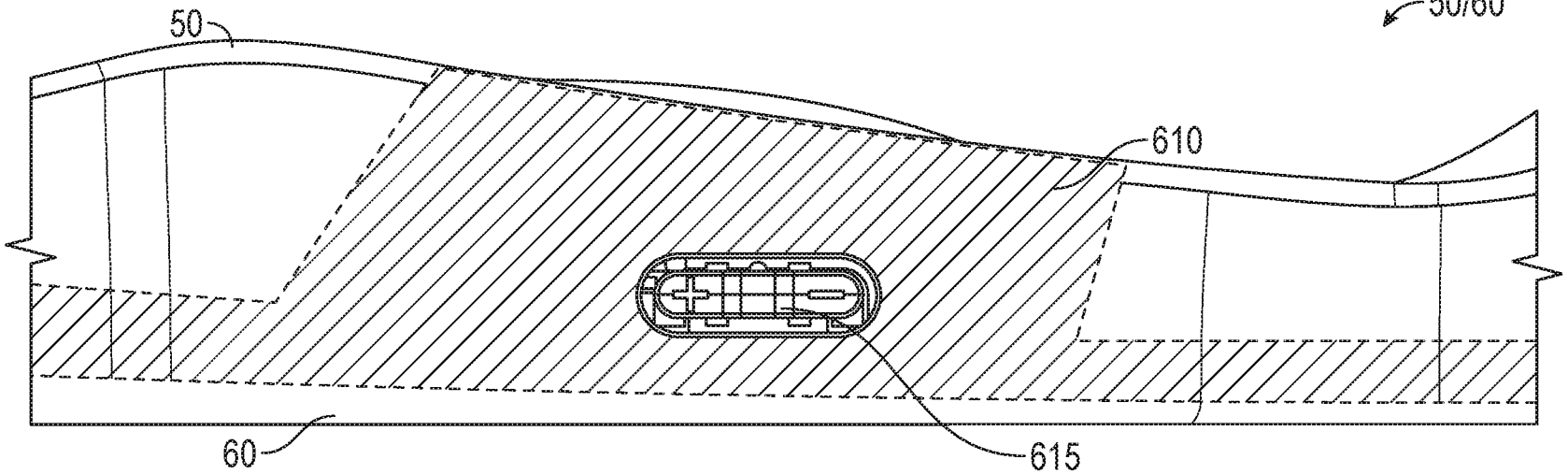

FIGS. 5A-5D are diagrams and drawings illustrating a mid-sole 50 and out-sole 60 configured to accommodate lacing engine 10 and related components, according to some example embodiments. The mid-sole 50 can be formed from any suitable footwear material and includes various features to accommodate the mid-sole plate 40 and related components. In this example, the mid-sole 50 includes features such as plate recess 510, anterior flange recess 520, posterior flange recess 530, actuator opening 540 and actuator cover recess 550. The plate recess 510 includes various cutouts and similar features to match corresponding features of the mid-sole plate 40. The actuator opening 540 is sized and positioned to provide access to the actuator 30 from the lateral side of the footwear platform 1. The actuator cover recess 550 is a recessed portion of the mid-sole 50 adapted to accommodate a molded covering to protect the actuator 30 and provide a particular tactile and visual look for the primary user interface to the lacing engine 10, as illustrated in FIGS. 5B and 5C.

FIGS. 5B and 5C illustrate portions of the mid-sole 50 and out-sole 60, according to example embodiments. FIG. 5B includes illustration of exemplary actuator cover 610 and raised actuator interface 615, which is molded or otherwise formed into the actuator cover 610. FIG. 5C illustrates an additional example of actuator 610 and raised actuator interface 615 including horizontal striping to disperse portions of the light transmitted to the out-sole 60 through the light pipe 320 portion of actuator 30.

Figure 5D:
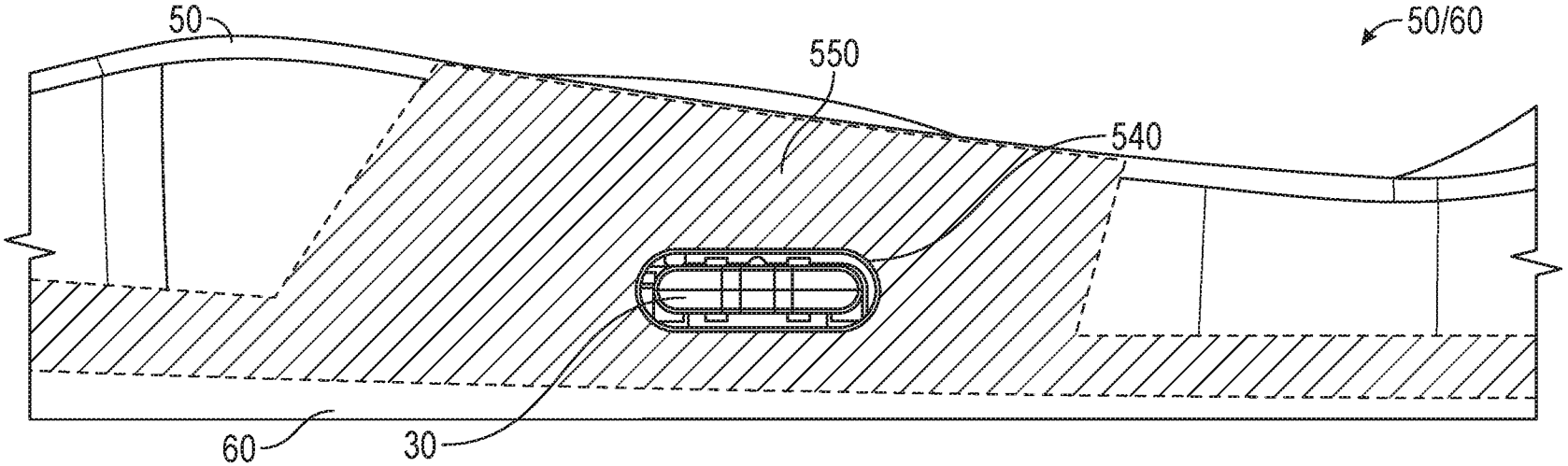

FIG. 5D further illustrates actuator cover recess 550 on mid-sole 50 as well as positioning of actuator 30 within actuator opening 540 prior to application of actuator cover 610. In this example, the actuator cover recess 550 is designed to receive adhesive to adhere actuator cover 610 to the mid-sole 50 and out-sole 60.

Figure 6A:
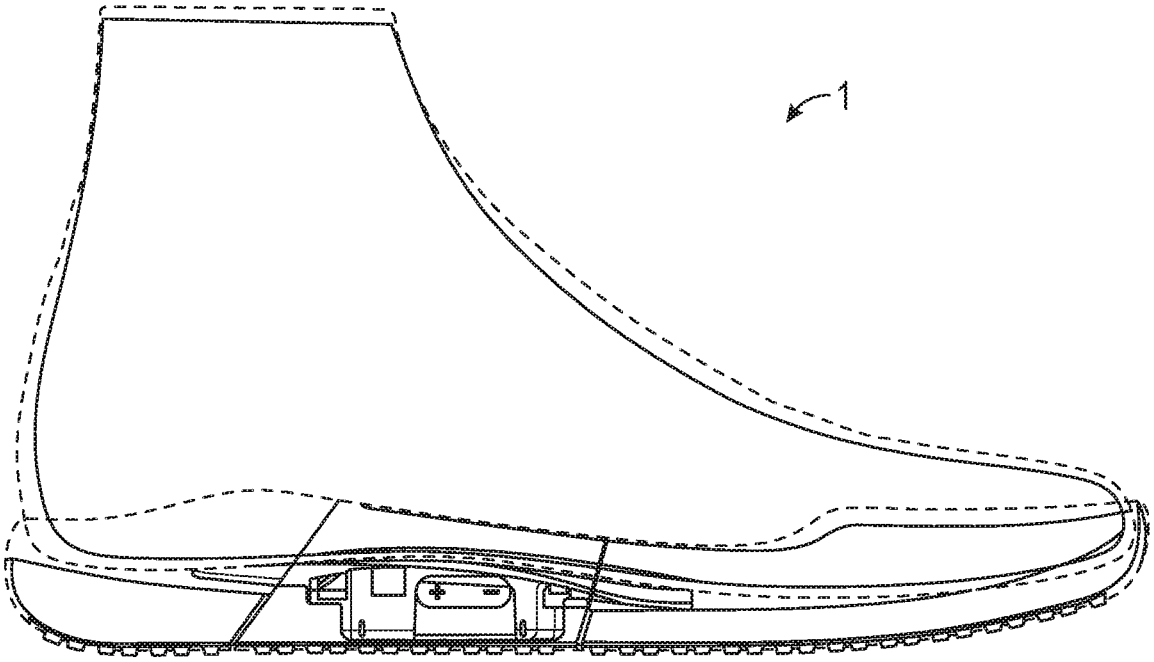
FIGS. 6A-6D are illustrations of a footwear assembly including a motorized lacing engine, according to some example embodiments.
Figure 6B:
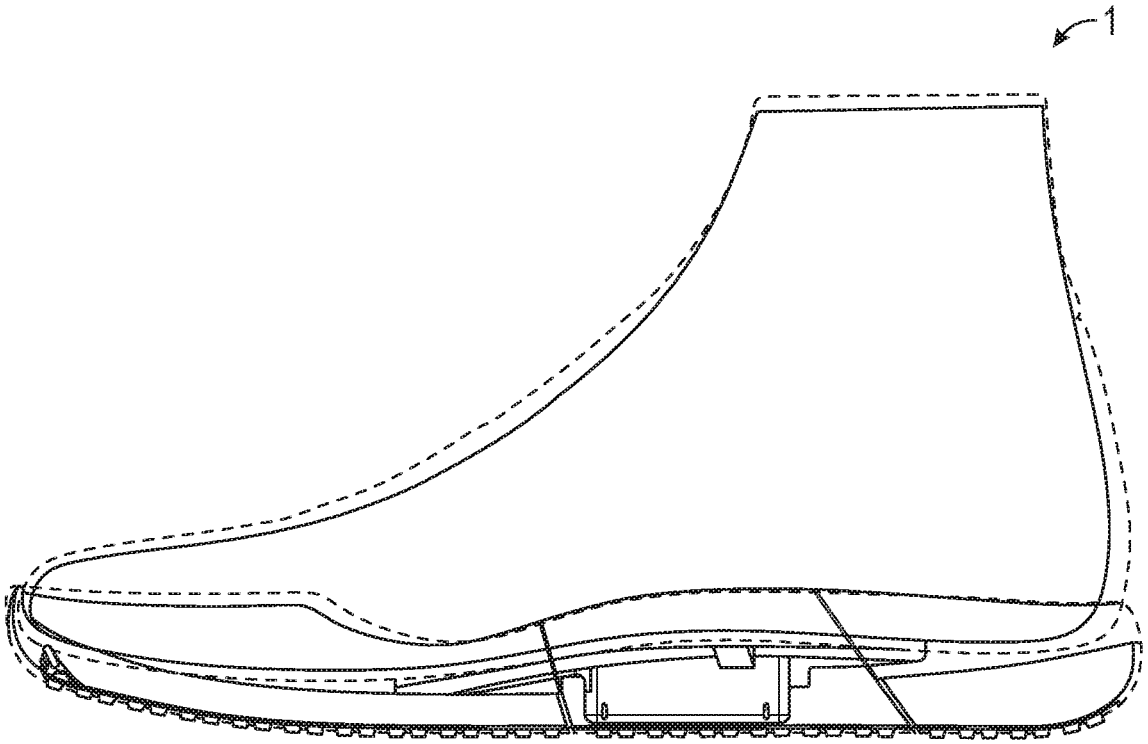
Figure 6C:
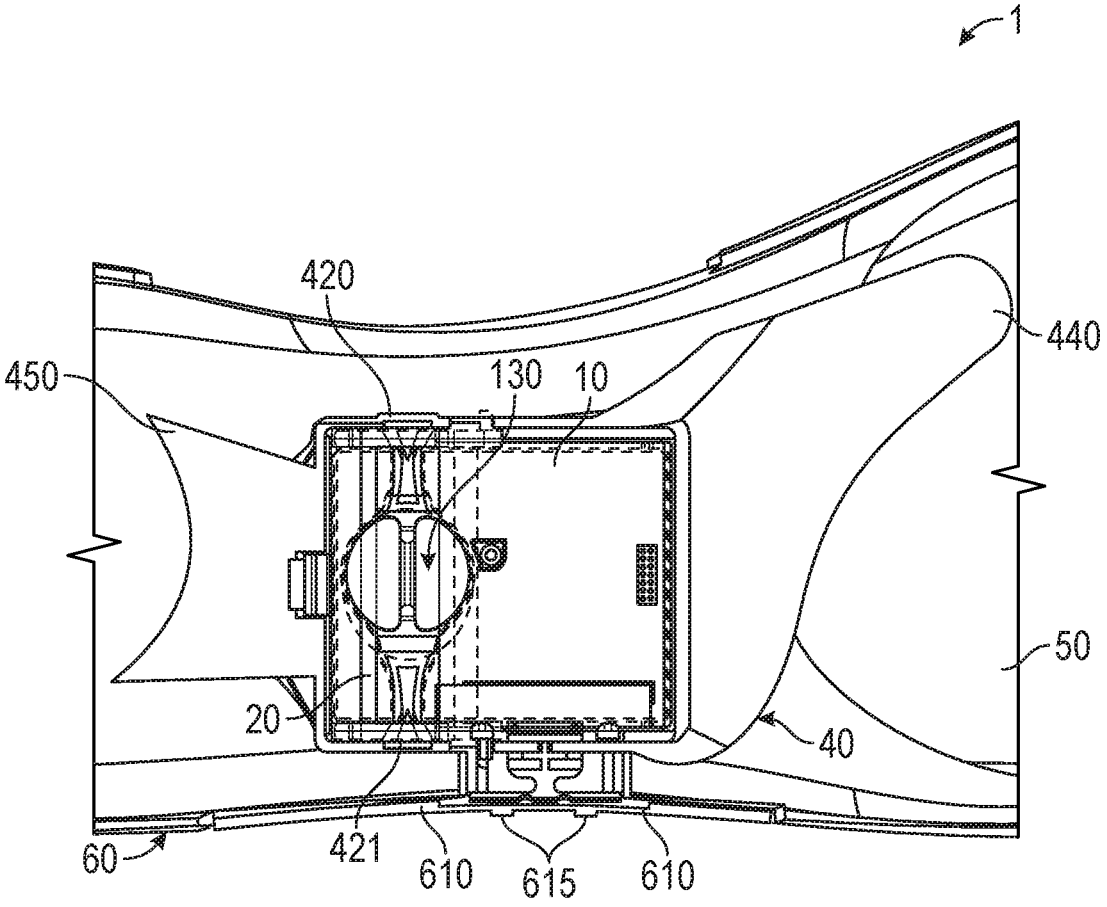

FIGS. 6A-6D are illustrations of a footwear assembly 1 including a motorized lacing engine 10, according to some example embodiments. In this example, FIGS. 6A-6C depict transparent examples of an assembled automated footwear platform 1 including a lacing engine 10, a mid-sole plate 40, a mid-sole 50, and an out-sole 60. FIG. 6A is a lateral side view of the automated footwear platform 1. FIG. 6B is a medial side view of the automated footwear platform 1. FIG. 6C is a top view, with the upper portion removed, of the automated footwear platform 1. The top view demonstrates relative positioning of the lacing engine 10, the lid 20, the actuator 30, the mid-sole plate 40, the mid-sole 50, and the out-sole 60. In this example, the top view also illustrates the spool 130, the medial lace guide 420 the lateral lace guide 421, the anterior flange 440, the posterior flange 450, the actuator cover 610, and the raised actuator interface 615.

Figure 6D:
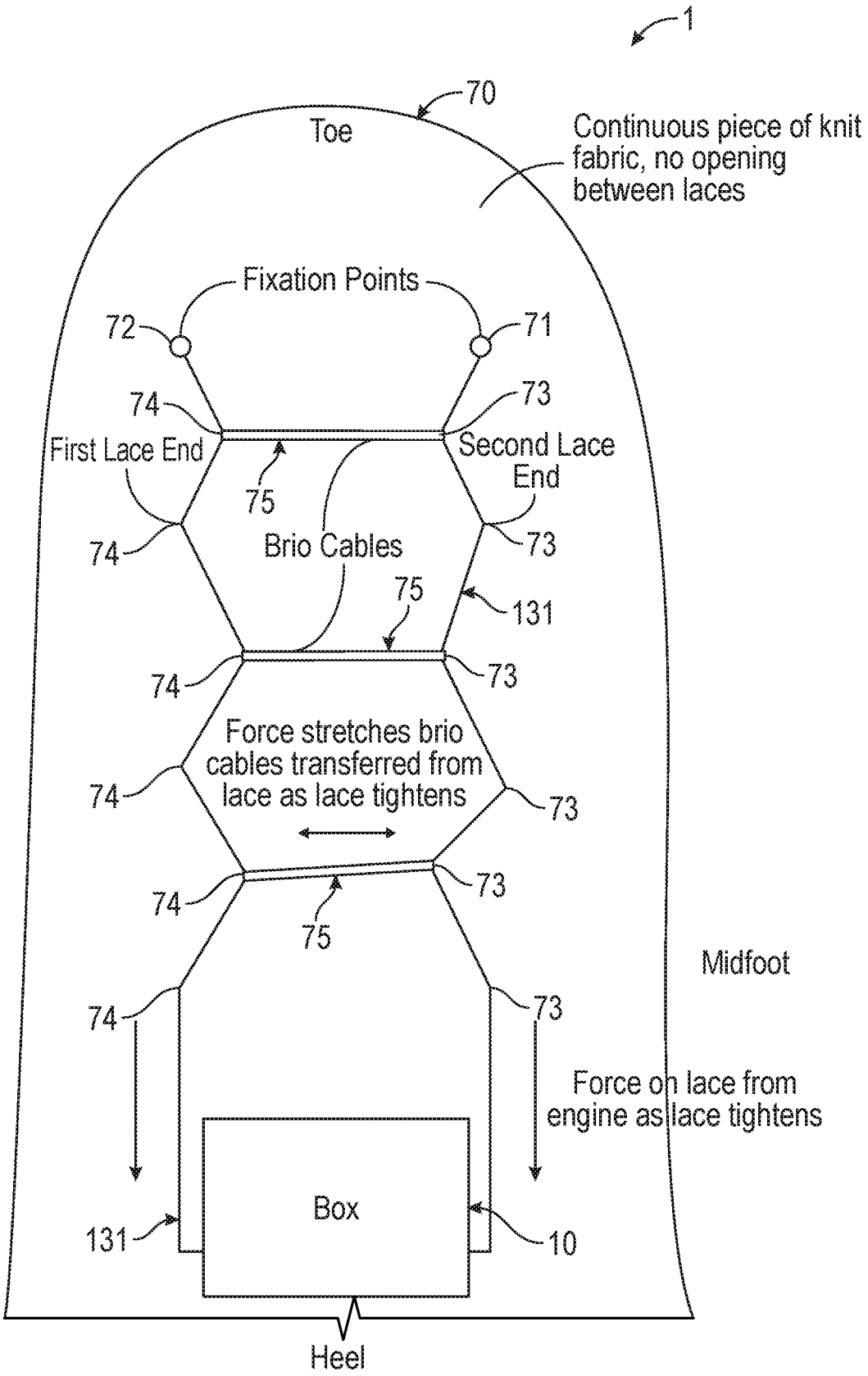

FIG. 6D is a top view diagram of upper 70 illustrating an example lacing configuration, according to some example embodiments. In this example, the upper 70 includes lateral lace fixation 71, medial lace fixation 72, lateral lace guides 73, medial lace guides 74, and brio cables 75, in additional to lace 131 and lacing engine 10. The example illustrated in FIG. 6D includes a continuous knit fabric upper 70 with diagonal lacing pattern involving non-overlapping medial and lateral lacing paths. The lacing paths are created starting at the lateral lace fixation running through the lateral lace guides 73 through the lacing engine 10 up through the medial lace guides 74 back to the medial lace fixation 72. In this example, lace 131 forms a continuous loop from lateral lace fixation 71 to medial lace fixation 72. Medial to lateral tightening is transmitted through brio cables 75 in this example. In other examples, the lacing path may crisscross or incorporate additional features to transmit tightening forces in a medial-lateral direction across the upper 70. Additionally, the continuous lace loop concept can be incorporated into a more traditional upper with a central (medial) gap and lace 131 crisscrossing back and forth across the central gap.

Assembly Processes

Figure 7:
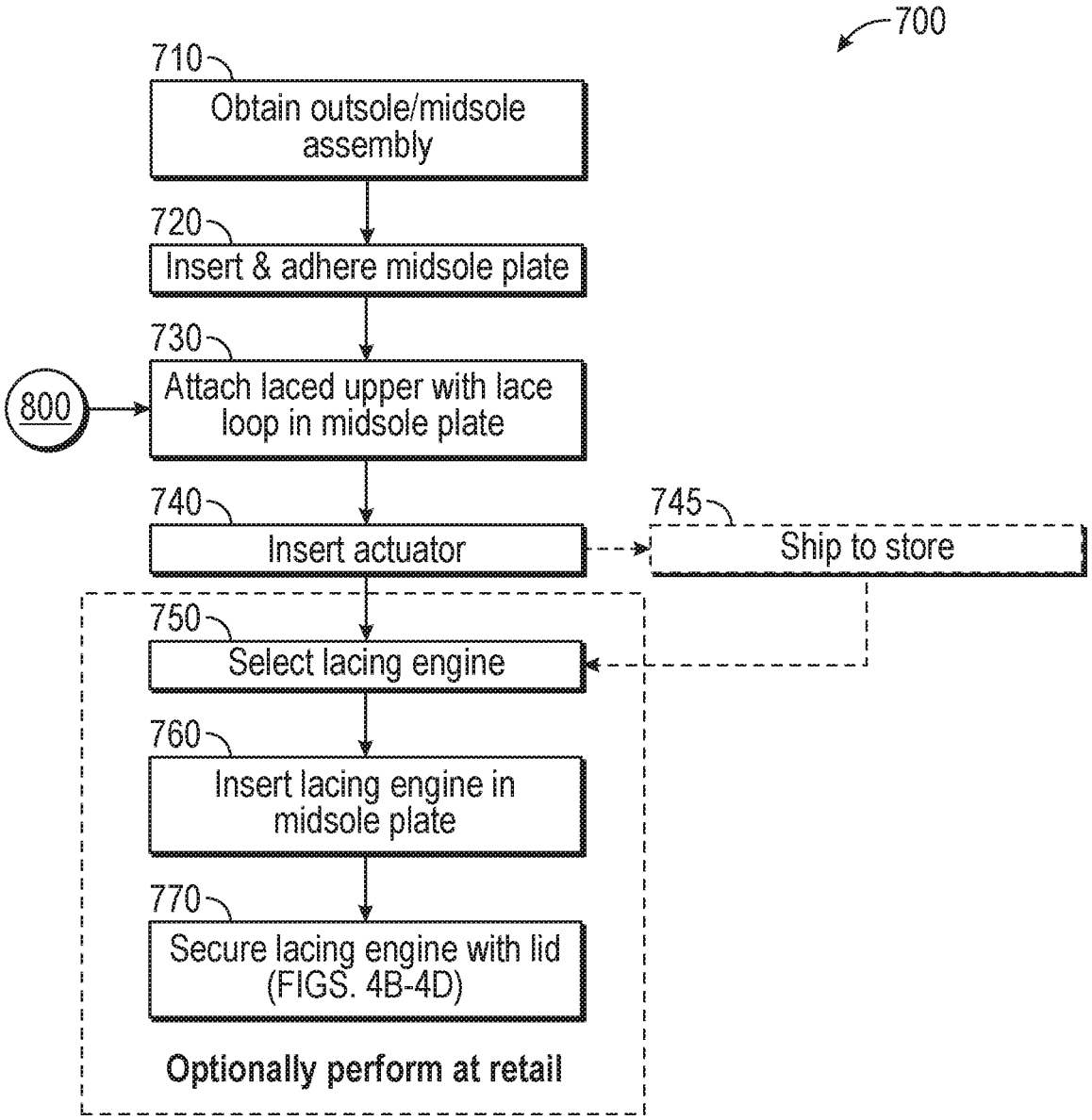
FIG. 7 is a flowchart illustrating a footwear assembly process for assembly of footwear including a lacing engine, according to some example embodiments.

FIG. 7 is a flowchart illustrating a footwear assembly process for assembly of an automated footwear platform 1 including lacing engine 10, according to some example embodiments. In this example, the assembly process includes operations such as: obtaining an outsole/midsole assembly at 710, inserting and adhering a mid-sole plate at 720, attaching laced upper at 730, inserting actuator at 740, optionally shipping the subassembly to a retail store at 745, selecting a lacing engine at 750, inserting a lacing engine into the mid-sole plate at 760, and securing the lacing engine at 770. The process 700 described in further detail below can include some or all of the process operations described and at least some of the process operations can occur at various locations (e.g., manufacturing plant versus retail store). In certain examples, all of the process operations discussed in reference to process 700 can be completed within a manufacturing location with a completed automated footwear platform delivered directly to a consumer or to a retain location for purchase.

In this example, the process 700 begins at 710 with obtaining an out-sole and mid-sole assembly, such as mid-sole 50 adhered to out-sole 60. At 720, the process 700 continues with insertion of a mid-sole plate, such as mid-sole plate 40, into a plate recess 510. In some examples, the mid-sole plate 40 includes a layer of adhesive on the inferior surface to adhere the mid-sole plate into the mid-sole. In other examples, adhesive is applied to the mid-sole prior to insertion of a mid-sole plate. In still other examples, the mid-sole is designed with an interference fit with the mid-sole plate, which does not require adhesive to secure the two components of the automated footwear platform.

At 730, the process 700 continues with a laced upper portion of the automated footwear platform being attached to the mid-sole. Attachment of the laced upper portion is done through any known footwear manufacturing process, with the addition of positioning a lower lace loop into the mid-sole plate for subsequent engagement with a lacing engine, such as lacing engine 10. For example, attaching a laced upper to mid-sole 50 with mid-sole plate 40 inserted, the lower lace loop is positioned to align with medial lace guide 420 and lateral lace guide 421, which position the lace loop properly to engage with lacing engine 10 when inserted later in the assembly process. Assembly of the upper portion is discussed in greater detail in reference to FIGS. 8A-8B below.

At 740, the process 700 continues with insertion of an actuator, such as actuator 30, into the mid-sole plate. Optionally, insertion of the actuator can be done prior to attachment of the upper portion at operation 730. In an example, insertion of actuator 30 into the actuator cutout 480 of mid-sole plate 40 involves a snap fit between actuator 30 and actuator cutout 480. Optionally, process 700 continues at 745 with shipment of the subassembly of the automated footwear platform to a retail location or similar point of sale. The remaining operations within process 700 can be performed without special tools or materials, which allows for flexible customization of the product sold at the retail level without the need to manufacture and inventory every combination of automated footwear subassembly and lacing engine options.

At 750, the process 700 continues with selection of a lacing engine, which may be an optional operation in cases where only one lacing engine is available. In an example, lacing engine 10, a motorized lacing engine, is chosen for assembly into the subassembly from operations 710-740. However, as noted above, the automated footwear platform is designed to accommodate various types of lacing engines from fully automatic motorized lacing engines to human-power manually activated lacing engines. The subassembly built up in operations 710-740, with components such as out-sole 60, mid-sole 50, and mid-sole plate 40, provides a modular platform to accommodate a wide range of optional automation components.

At 760, the process 700 continues with insertion of the selected lacing engine into the mid-sole plate. For example, lacing engine 10 can be inserted into mid-sole plate 40, with the lacing engine 10 slipped underneath the lace loop running through the lacing engine cavity 410. With the lacing engine 10 in place and the lace cable engaged within the spool of the lacing engine, such as spool 130, a lid (or similar component) can be installed into the mid-sole plate to secure the lacing engine 10 and lace. An example of install of lid 20 into mid-sole plate 40 to secure lacing engine 10 is illustrated in FIGS. 4B-4D and discussed above. With the lid secured over the lacing engine, the automated footwear platform is complete and ready for active use.

Figure 8A:
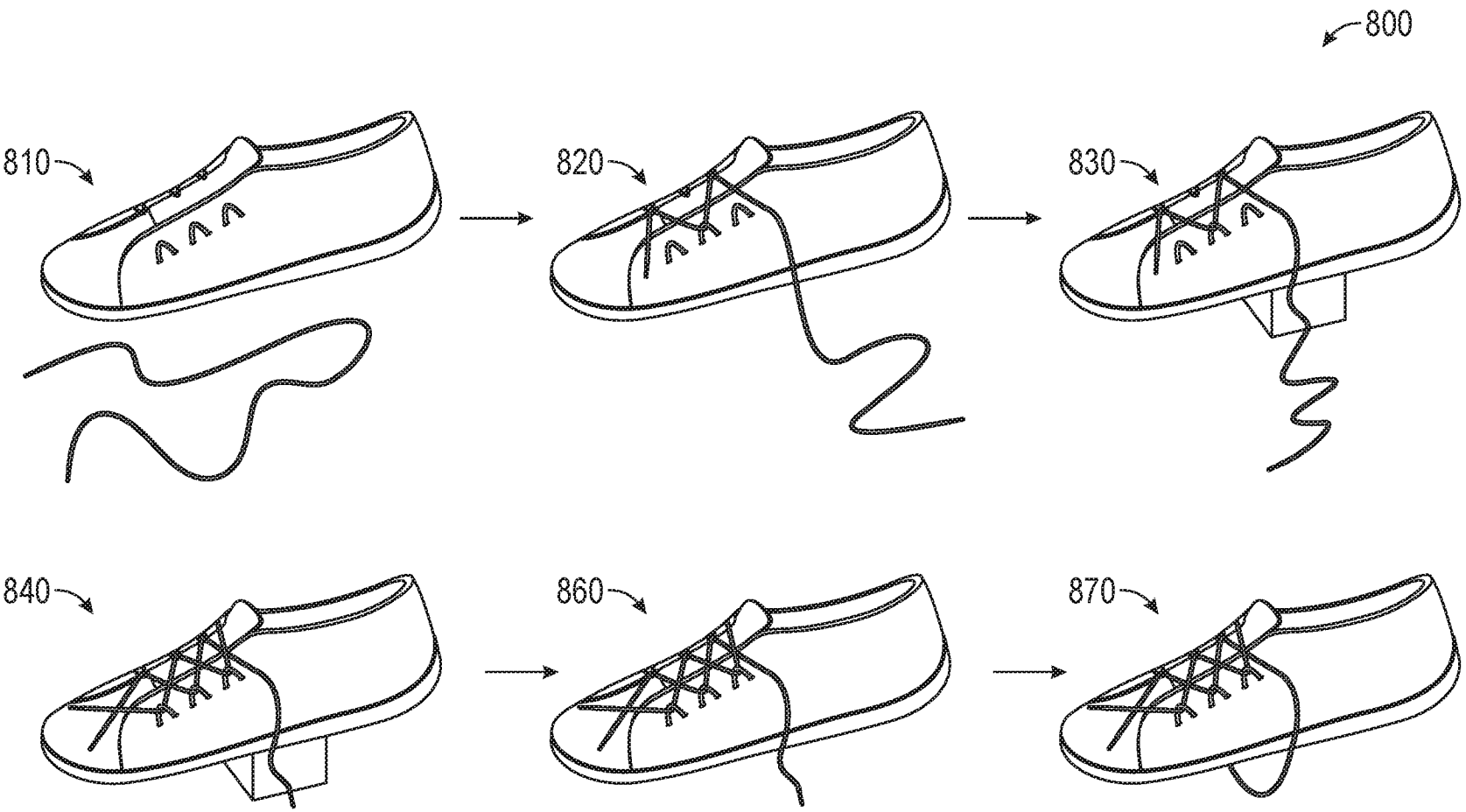
FIGS. 8A-8B is a drawing and a flowchart illustrating an assembly process for assembly of a footwear upper in preparation for assembly to mid-sole, according to some example embodiments.
Figure 8B:
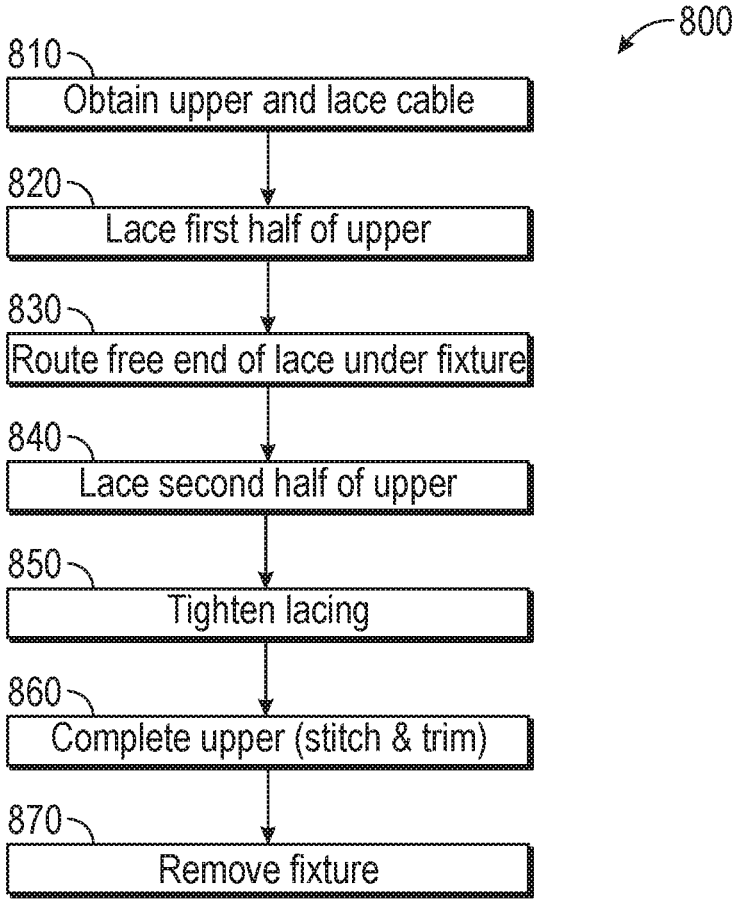

FIGS. 8A-8B include flowcharts illustrating generally an assembly process 800 for assembly of a footwear upper in preparation for assembly to a mid-sole, according to some example embodiments.

FIG. 8A visually depicts a series of assembly operations to assembly a laced upper portion of a footwear assembly for eventual assembly into an automated footwear platform, such as though process 700 discussed above. Process 800 illustrated in FIG. 8A starts with operation 1, which involves obtaining a knit upper and a lace (lace cable). Next, a first half of the knit upper is laced with the lace. In this example, lacing the upper involves threading the lace cable through a number of eyelets and securing one end to an anterior section of the upper. Next, the lace cable is routed under a fixture supporting the upper and around to the opposite side. Then, at operation 2.6, the other half of the upper is laced, while maintaining a lower loop of lace around the fixture. At 2.7, the lace is secured and trimmed and at 3.0 the fixture is removed to leave a laced knit upper with a lower lace loop under the upper portion.

FIG. 8B is a flowchart illustrating another example of process 800 for assembly of a footwear upper. In this example, the process 800 includes operations such as obtaining an upper and lace cable at 810, lacing the first half of the upper at 820, routing the lace under a lacing fixture at 830, lacing the second half of the upper at 840, tightening the lacing at 850, completing upper at 860, and removing the lacing fixture at 870.

The process 800 begins at 810 by obtaining an upper and a lace cable to being assembly. Obtaining the upper can include placing the upper on a lacing fixture used through other operations of process 800. At 820, the process 800 continues by lacing a first half of the upper with the lace cable. Lacing operation can include routing the lace cable through a series of eyelets or similar features built into the upper. The lacing operation at 820 can also include securing one end of the lace cable to a portion of the upper. Securing the lace cable can include sewing, tying off, or otherwise terminating a first end of the lace cable to a fixed portion of the upper.

At 830, the process 800 continues with routing the free end of the lace cable under the upper and around the lacing fixture. In this example, the lacing fixture is used to create a proper lace loop under the upper for eventual engagement with a lacing engine after the upper is joined with a mid-sole/out-sole assembly (see discussion of FIG. 7 above). The lacing fixture can include a groove or similar feature to at least partially retain the lace cable during the sequent operations of process 800.

At 840, the process 800 continues with lacing the second half of the upper with the free end of the lace cable. Lacing the second half can include routing the lace cable through a second series of eyelets or similar features on the second half of the upper. At 850, the process 800 continues by tightening the lace cable through the various eyelets and around the lacing fixture to ensure that the lower lace loop is properly formed for proper engagement with a lacing engine. The lacing fixture assists in obtaining a proper lace loop length, and different lacing fixtures can be used for different size or styles of footwear. The lacing process is completed at 860 with the free end of the lace cable being secured to the second half of the upper. Completion of the upper can also include additional trimming or stitching operations. Finally, at 870, the process 800 completes with removal of the upper from the lacing fixture.

Figure 9:
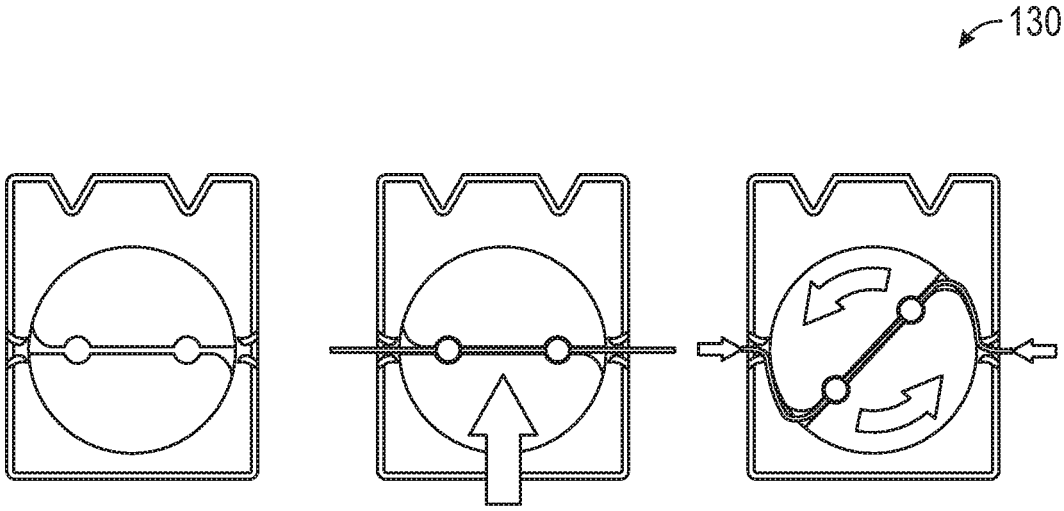
FIG. 9 is a drawing illustrating a mechanism for securing a lace within a spool of a lacing engine, according to some example embodiments.

FIG. 9 is a drawing illustrating a mechanism for securing a lace within a spool of a lacing engine, according to some example embodiments. In this example, spool 130 of lacing engine 10 receives lace cable 131 within lace grove 132. FIG. 9 includes a lace cable with ferrules and a spool with a lace groove that include recesses to receive the ferrules. In this example, the ferrules snap (e.g., interference fit) into recesses to assist in retaining the lace cable within the spool. Other example spools, such as spool 130, do not include recesses and other components of the automated footwear platform are used to retain the lace cable in the lace groove of the spool.

Figure 10A:
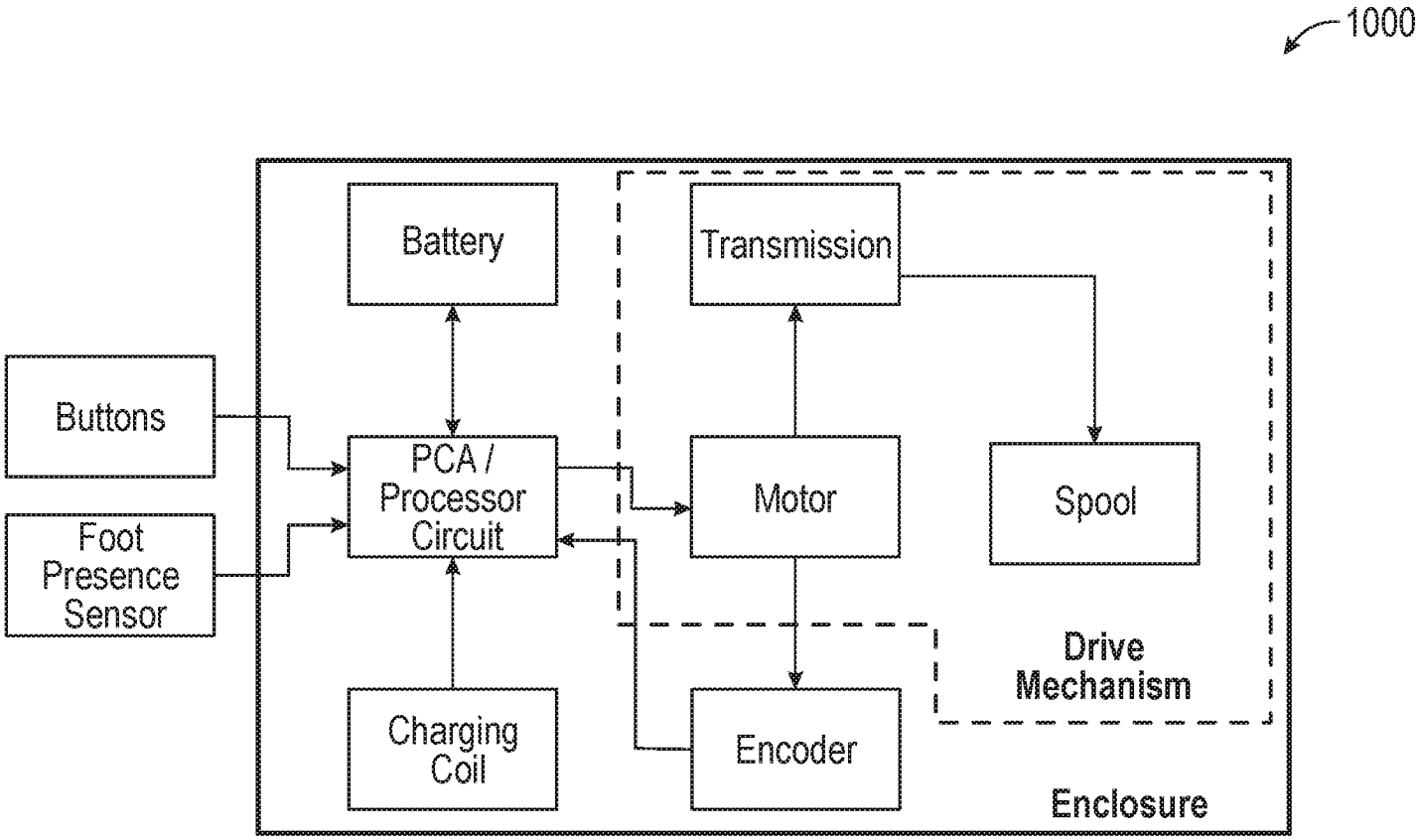
FIG. 10A is a block diagram illustrating components of a motorized lacing system, according to some example embodiments.

FIG. 10A is a block diagram illustrating components of a motorized lacing system for footwear, according to some example embodiments. The system 1000 illustrates basic components of a motorized lacing system such as including interface buttons, foot presence sensor(s), a printed circuit board assembly (PCA) with a processor circuit, a battery, a charging coil, an encoder, a motor, a transmission, and a spool. In this example, the interface buttons and foot presence sensor(s) communicate with the circuit board (PCA), which also communicates with the battery and charging coil. The encoder and motor are also connected to the circuit board and each other. The transmission couples the motor to the spool to form the drive mechanism.

In an example, the processor circuit controls one or more aspects of the drive mechanism. For example, the processor circuit can be configured to receive information from the buttons and/or from the foot presence sensor and/or from the battery and/or from the drive mechanism and/or from the encoder, and can be further configured to issue commands to the drive mechanism, such as to tighten or loosen the footwear, or to obtain or record sensor information, among other functions.

Figure 10B:
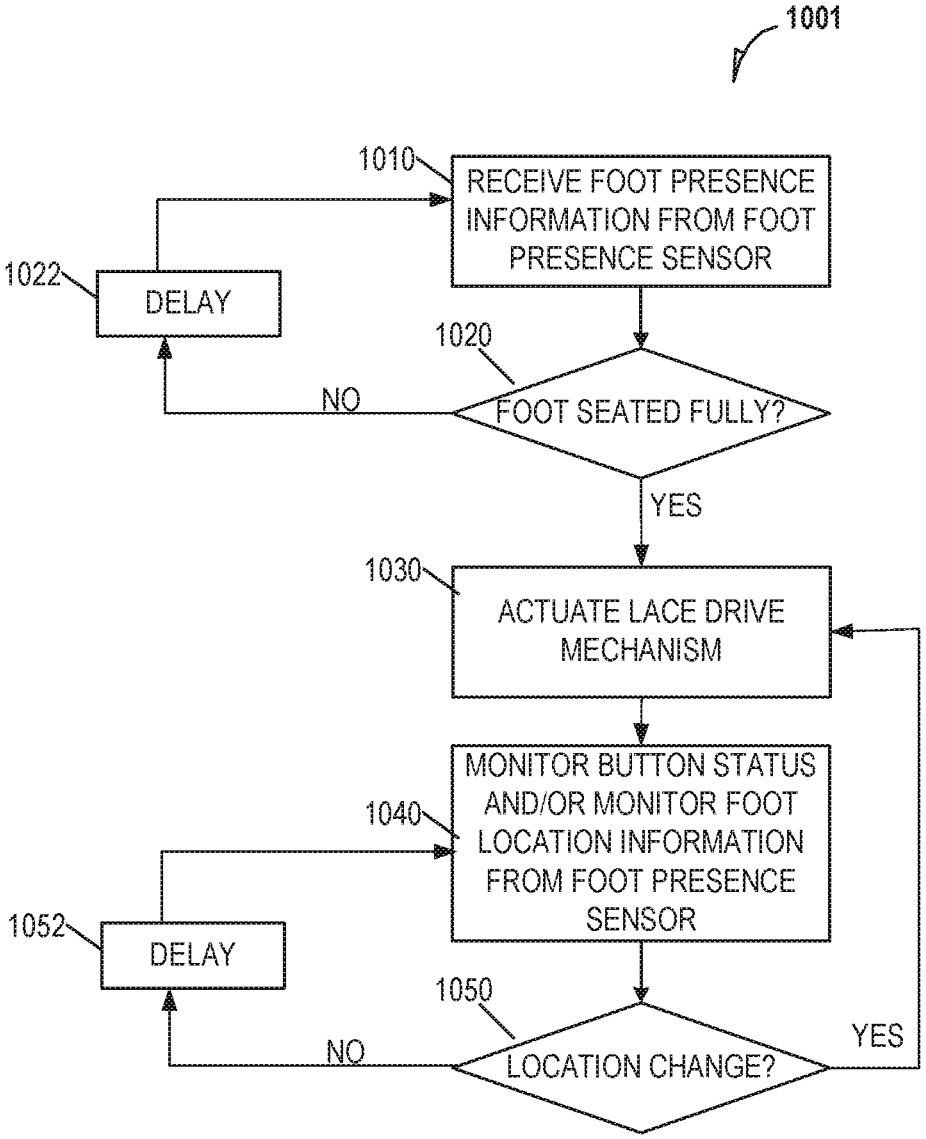
FIG. 10B is a flowchart illustrating an example of using foot presence information from a sensor.

FIG. 10B illustrates generally an example of a method 1001 that can include using information from a foot presence sensor to actuate a drive mechanism. At 1010, the example includes receiving foot presence information from a foot presence sensor. The foot presence information can include binary information about whether or not a foot is present, or can include an indication of a likelihood that a foot is present in a footwear article. The information can include an electrical signal provided from the sensor to the processor circuit. In an example, the foot presence information includes qualitative information about a location of a foot relative to one or more sensors in the footwear.

At 1020, the example includes determining whether a foot is fully seated in the footwear. If the sensor signal indicates that the foot is fully seated, then the example can continue at 1030 with actuating a lace drive mechanism. For example, when a foot is fully seated, the lace drive mechanism can be engaged to tighten footwear laces via a spool mechanism, as described above. If the sensor signal indicates that the foot is not fully seated, then the example can continue at 1022 by delaying or idling for some specified interval (e.g., 1-2 seconds, or more). After the delay elapses, the example can return to operation 1010, and the processor circuit can re-sample information from the foot presence sensor to determine again whether the foot is fully seated.

After the lace drive mechanism is actuated at 1030, the processor circuit can be configured to monitor foot location information at operation 1040. For example, the processor circuit can be configured to periodically or intermittently monitor information from the foot presence sensor about an absolute or relative position of a foot in the footwear. In an example, monitoring foot location information at 1040 and the receiving foot presence information at 1010 can include receiving information from the same or different foot position sensor. At 1040, the example includes monitoring information from one or more buttons associated with the footwear, such as can indicate a user instruction to disengage (loosen) the laces, such as when a user wishes to remove the footwear. In an example, lace tension information can be additionally or alternatively monitored or used as feedback information for actuating a drive motor or tensioning laces. For example, lace tension information can be monitored by measuring a drive motor current. The tension can be characterized at the factory or preset by the user, and can be correlated to a monitored or measured drive motor current level.

At 1050, the example includes determining whether a foot location has changed in the footwear. If no change in foot location is detected by the processor circuit, for example by analyzing foot presence signals from one or more foot presence sensors, then the example can continue with a delay 1052. After a specified delay interval, the example can return to 1040 to re-sample information from the foot presence sensor(s) to again determine whether a foot position has changed. The delay 1052 can be in the range of several milliseconds to several seconds, and can optionally be specified by a user.

In an example, the delay 1052 can be determined automatically by the processor circuit, such as in response to determining a footwear use characteristic. For example, if the processor circuit determines that a wearer is engaged in strenuous activity (e.g., running, jumping, etc.), then the processor circuit can decrease the delay 1052. If the processor circuit determines that the wearer is engaged in non-strenuous activity (e.g., walking or sitting), then the processor circuit can increase the delay 1052, such as to increase battery longevity by deferring sensor sampling events. In an example, if a location change is detected at 1050, then the example can continue by returning to operation 1030, for example, to actuate the lace drive mechanism, such as to tighten or loosen the footwear's laces. In an example, the processor circuit includes or incorporates a hysteretic controller for the drive mechanism to help avoid unwanted lace spooling.

Motor Control Scheme

Figure 11A:
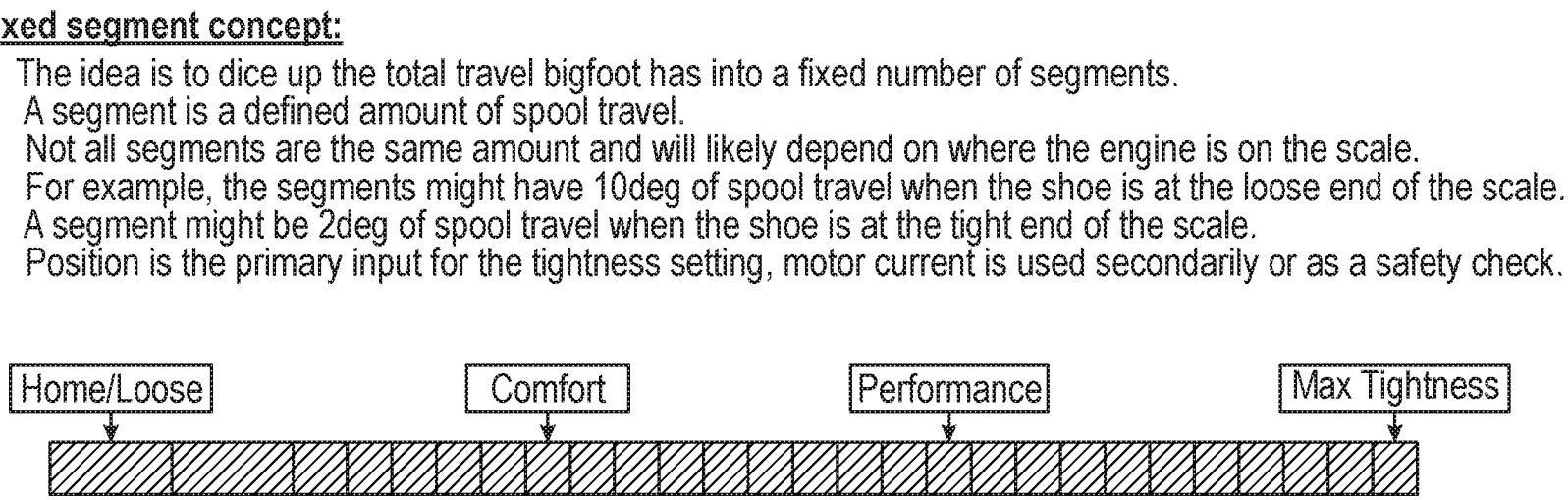

FIG. 11A-11D are diagrams illustrating a motor control scheme 1100 for a motorized lacing engine, according to some example embodiments. In this example, the motor control scheme 1100 involves dividing up the total travel, in terms of lace take-up, into segments, with the segments varying in size based on position on a continuum of lace travel (e.g., between home/loose position on one end and max tightness on the other). As the motor is controlling a radial spool and will be controlled, primarily, via a radial encoder on the motor shaft, the segments can be sized in terms of degrees of spool travel (which can also be viewed in terms of encoder counts). On the loose side of the continuum, the segments can be larger, such as 10 degrees of spool travel, as the amount of lace movement is less critical. However, as the laces are tightened each increment of lace travel becomes more and more critical to obtain the desired amount of lace tightness. Other parameters, such as motor current, can be used as secondary measures of lace tightness or continuum position. FIG. 11A includes an illustration of different segment sizes based on position along a tightness continuum.

Figure 11C:
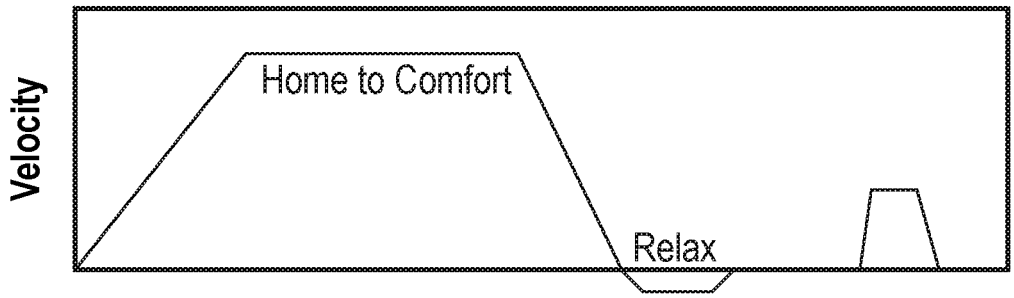

FIG. 11B illustrates using a tightness continuum position to build a table of motion profiles based on current tightness continuum position and desired end position. The motion profiles can then be translated into specific inputs from user input buttons. The motion profile include parameters of spool motion, such as acceleration (Accel (deg/s/s)), velocity (Vel (deg/s)), deceleration (Dec (deg/s/s)), and angle of movement (Angle (deg)). FIG. 11C depicts an example motion profile plotted on a velocity over time graph.

Figure 11D:
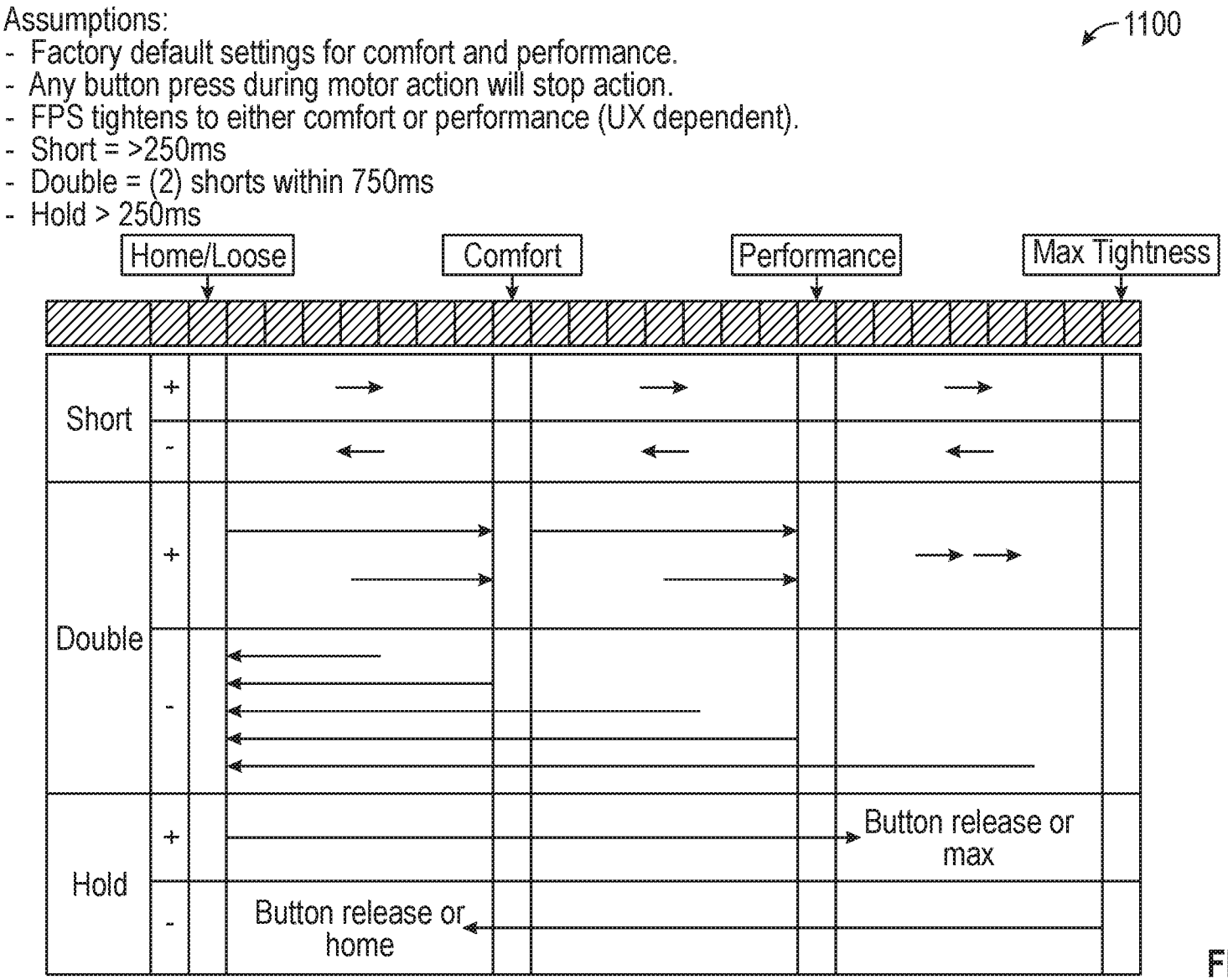

FIG. 11D is a graphic illustrating example user inputs to activate various motion profiles along the tightness continuum.

Anti-Tangle Box Lace Channel Shape

Figure 12A:
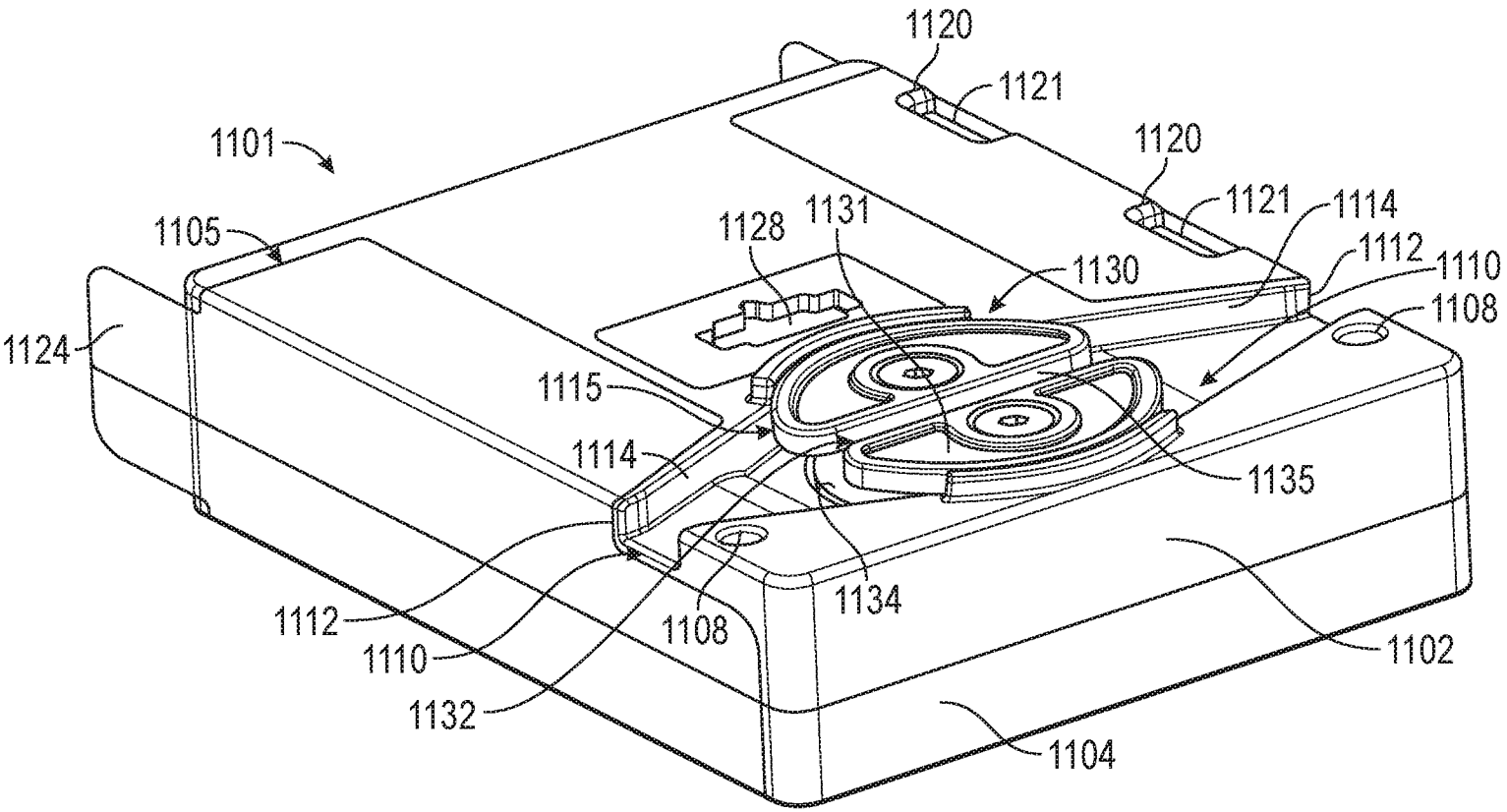
FIG. 12A is a perspective view illustration of a motorized lacing system having an anti-tangle lacing channel, according to some example embodiments.
Figure 12B:
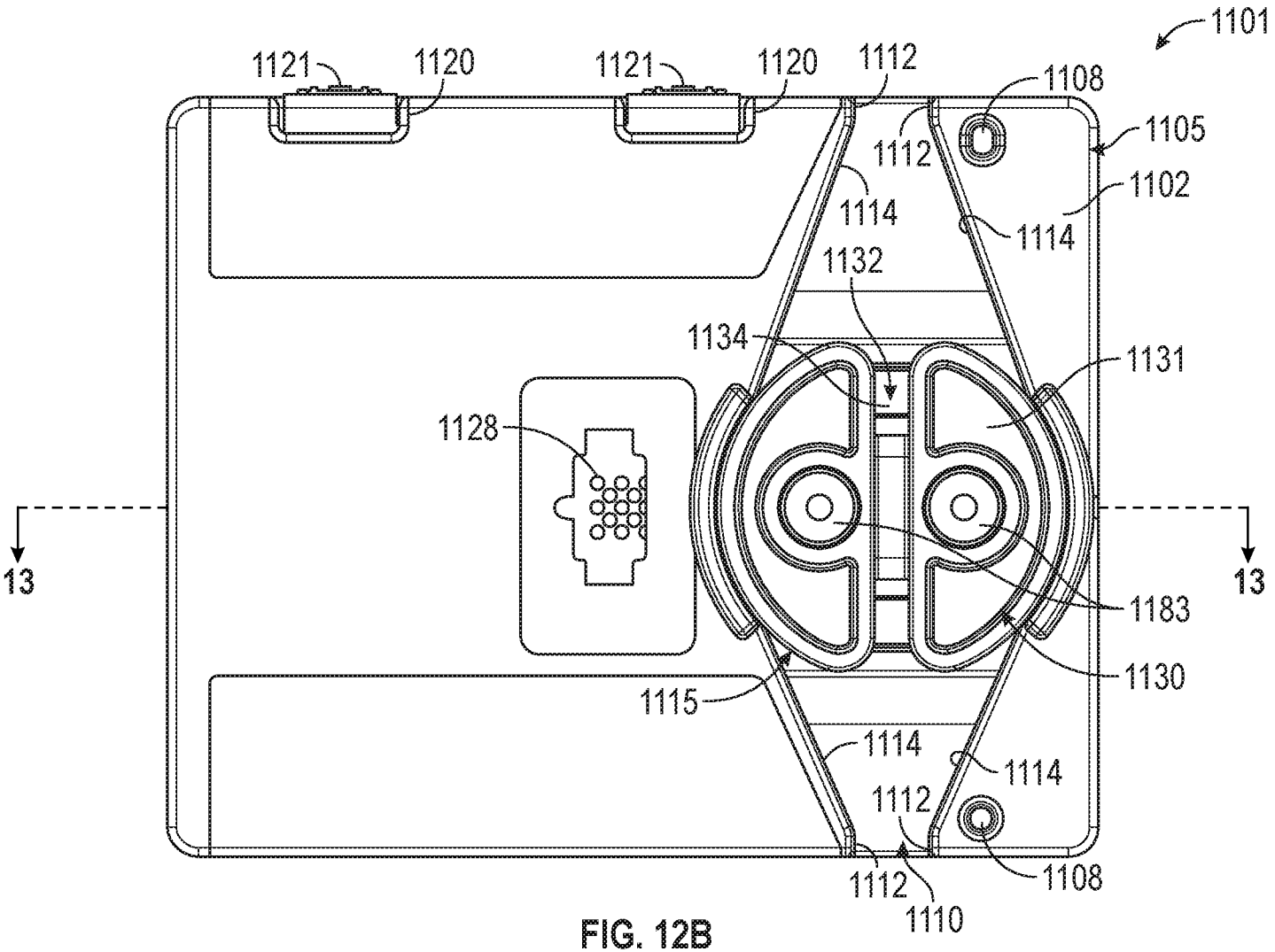
FIG. 12B is a top view of the motorized lacing system of FIG. 12A showing a winding channel through a spool aligned with the anti-tangle lacing channel through a housing.

FIG. 12A is a perspective view illustration of a motorized lacing system 1101 having anti-tangle lacing channel 1110, according to some example embodiments. FIG. 12B is a top view of the motorized lacing system 1101 of FIG. 12A showing winding channel 1132 extending through modular spool 1130 and aligned with lacing channel 1110 through housing structure 1105. Similar to spool 130 discussed above, modular spool 1130 provides a storage location for a lace, such as lace or cable 131 (FIG. 2F), when modular spool 1130 is wound to cinch lace 131 down on an article of footwear upper. Modular spool 1130 can be assembled from an assortment of components, such as upper plate 1131 and lower plate 1134.

Modular spool 1130 can be positioned within spool recess 1115 of lacing channel 1110. Lacing channel 1110 is shaped to optimize or improve performance of modular spool 1130 in winding and unwinding lace 131 from housing structure 1105. In particular, as discussed below, lacing channel 1110 can include lace channel transitions 1114, and other shapes, geometries and surfaces, that can help prevent lace 131 from jamming within spool recess 1115, such as by bird's nesting. Lace channel transitions 1114 can provide lacing channel 1110 with adequate volume to store lace 131 without having to compress or entangle lace 131.

An example lacing engine 1101 can include upper component 1102 and lower component 1104 of housing structure 1105, case screws 1108, lacing channel 1110 (also referred to as lace guide relief 1110), lace channel walls 1112, lace channel transitions 1114, spool recess 1115, button openings 1120, buttons 1121, button membrane seal 1124, programming header 1128, modular spool 1130, and winding channel (lace grove) 1132.

Figure 12C:
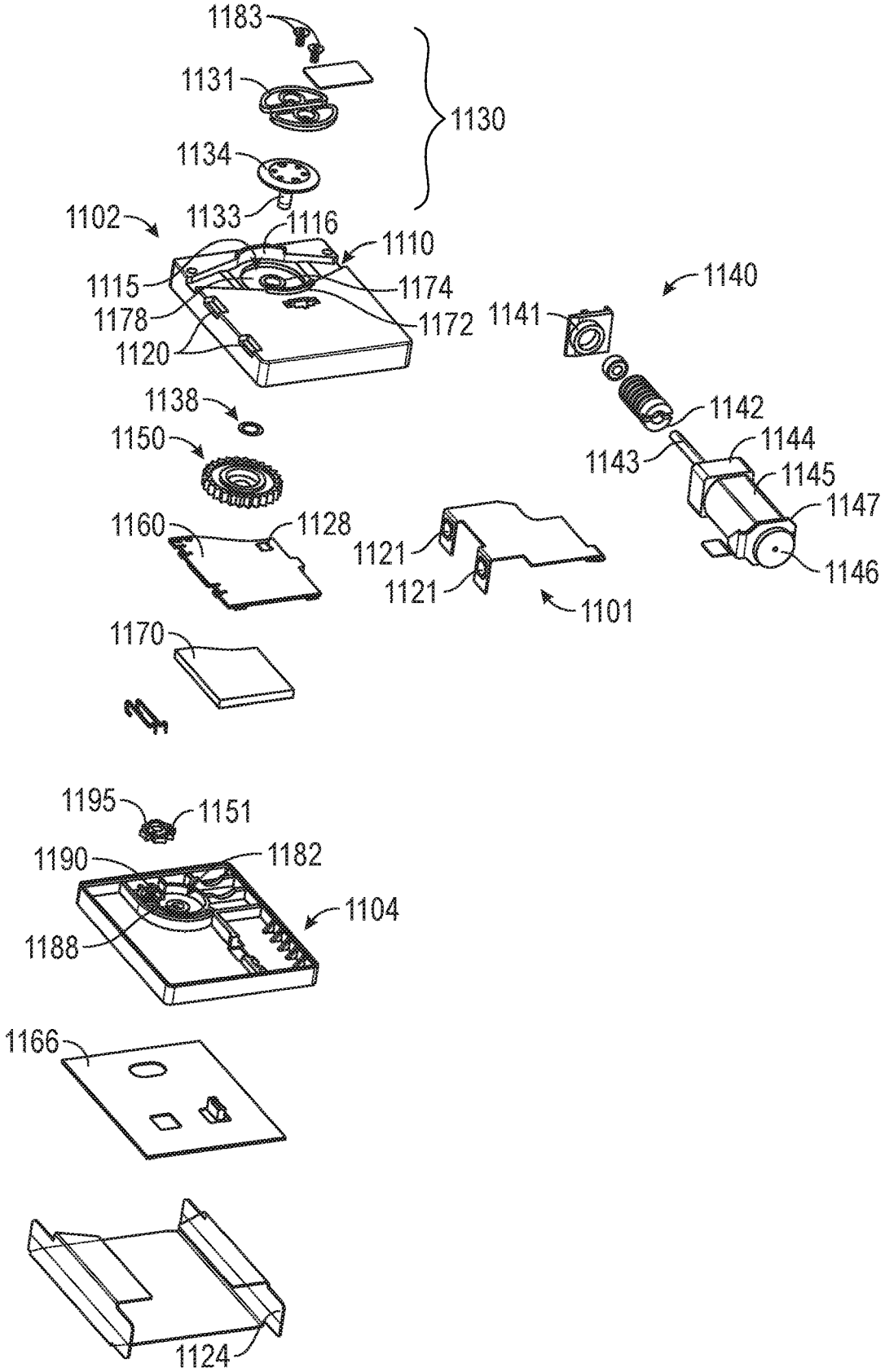
FIG. 12C is an exploded view illustration of the motorized lacing system of FIG. 12A showing components of the motorized lacing system.

Housing structure 1105 is configured to provide a compact lacing engine for insertion into a sole of an article of footwear, as described herein, for example. Case screws 1108 can be used to hold upper component 1102 and lower component 1104 in engagement. Together, upper component 1102 and lower component 1104 provide an interior space for placement of components of motorized lacing system 1101, such as components of modular spool 1130 and worm drive 1140 (FIG. 12C). Lace channel walls 1112 can be shaped to guide lace 131 into and out of housing structure 1105 and lace channel transitions 1114 can be shaped to guide lace into and out of modular spool 1130. In an example, lace channel walls 1112 extend generally parallel to the major axis of lacing channel 1110, while lace channel transitions 1114 extend oblique to the major axis of lacing channel 1110 in extending between lace channel walls 1112 and spool recess 1115. Spool recess 1115 can comprise a partial cylindrical socket for receiving modular spool 1130.

Lace 131 (FIG. 2F) can be positioned to extend into across lacing channel 1110 and winding channel 1132. As modular spool 1130 is rotated by worm drive 1140, lace 131 is wound around drum 1135 (shown more clearly in FIG. 15B) between upper plate 1131 and lower plate 1134. Buttons 1121 can extend through button openings 1120 and can be used to actuate worm drive 1140 to rotate modular spool 1130 in clockwise and counterclockwise directions. Programming header 1128 can permit circuit board 1160 (FIG. 12C) of lacing engine 1101 to be connected to external computing systems in order to characterize the lacing action provided by buttons 1121 and the operation of worm drive 1140, for example.

FIG. 12C is an exploded view illustration of motorized lacing system 1101 of FIG. 12A showing various components of motorized lacing system 1101 relative to anti-tangle lacing channel 1110. Motorized lacing system 1101 can comprise upper and lower components 1102 and 1104 of housing structure 1105 (FIG. 12A), modular spool 1130, worm gear 1150, indexing wheel 1151, circuit board 1160, battery 1170, wireless charging coil 1166, button membrane seal 1124, buttons 1121 and worm drive 1140.

Housing structure 1105 can comprise upper component 1102 and lower component 1104. Upper component 1102 can include lacing channel 1110 and spool recess 1115. Modular spool 1130 can comprise upper plate 1131, winding channel 1132, spool shaft 1133 and lower plate 1134. Lower component 1104 can include gear receptacle 1182, shaft socket 1188 and wheel post 1190.

Worm drive 1140 can comprise bushing 1141, key 1142, drive shaft 1143, gear box 1144, gear motor 1145, motor encoder 1146 and motor circuit board 1147. Worm drive 1140, circuit board 1160, wireless charging coil 1166 and battery 1170 can operate in a similar manner as worm drive 140, circuit board 160, wireless charging coil 166 and battery 170 described herein and further description is not provided here for brevity.

Fasteners 1183 can be used to secure upper plate 1131 to lower plate 1134 to form an assembled modular spool 1130. Seal 1138 can be positioned between upper plate 1131 and lower plate 1134 when assembled. Modular spool 1130 can be positioned into spool recess 1115 so that spool shaft 1133 is inserted into shaft bearing 1174. Lower plate 1134 can be configured to thereby seat in counterbore 1178 while upper plate 1131 is positioned adjacent spool flanges 1172 extending from spool walls 1116. Spool shaft 1133 can extend through shaft bearing 1174 and pass through engage worm gear 1150 at socket 1152 to engage shaft socket 1188.

Worm gear 1150 can be positioned within gear receptacle 1182 of lower component 1104. The distal tip of spool shaft 1133 can be inserted into socket 1188. Bore 1195 in indexing wheel 1151 can be positioned around wheel post 1190 such that indexing wheel 1151 is rotatable partially within socket 1188. With worm gear 1150 resting in gear receptacle 1182 and indexing wheel 1151 positioned on wheel post 1190, teeth of indexing wheel 1151 can mate with a tooth, such as tooth 153 (FIG. 2I) on the bottom side of worm gear 1150, as discussed herein, to provide appropriate indexing action. Thus, worm drive 1140 can drive worm gear 1150 to cause direct rotation of spool shaft 1133, such as by spool shaft 1133 being force fit or splined into socket 1152. As discussed above, indexing wheel 1151 can be configured to arrest rotation of worm gear 1150 after a certain number of revolutions of worm gear 1150 by the indexing action.

When modular spool is 1130 is seated in counterbore 1178 within lacing channel 1110, modular spool 1130 defines a lace volume and lacing channel 1110 defines a storage volume. For example, modular spool 1130 can include a lace volume that is defined by the space between upper plate 1131 and lower plate 1134 and that extends from a central axis of modular spool 1130 to, at its further extent, the outer diameter edge of upper plate 1131. For example, lacing channel 1110 can include a storage volume that is defined by the spaces between lace wall transitions 1114 and that extends between lace channel walls 1112 and the lace volume. In various embodiments, the storage volume is greater than the lace volume.

Figure 13:
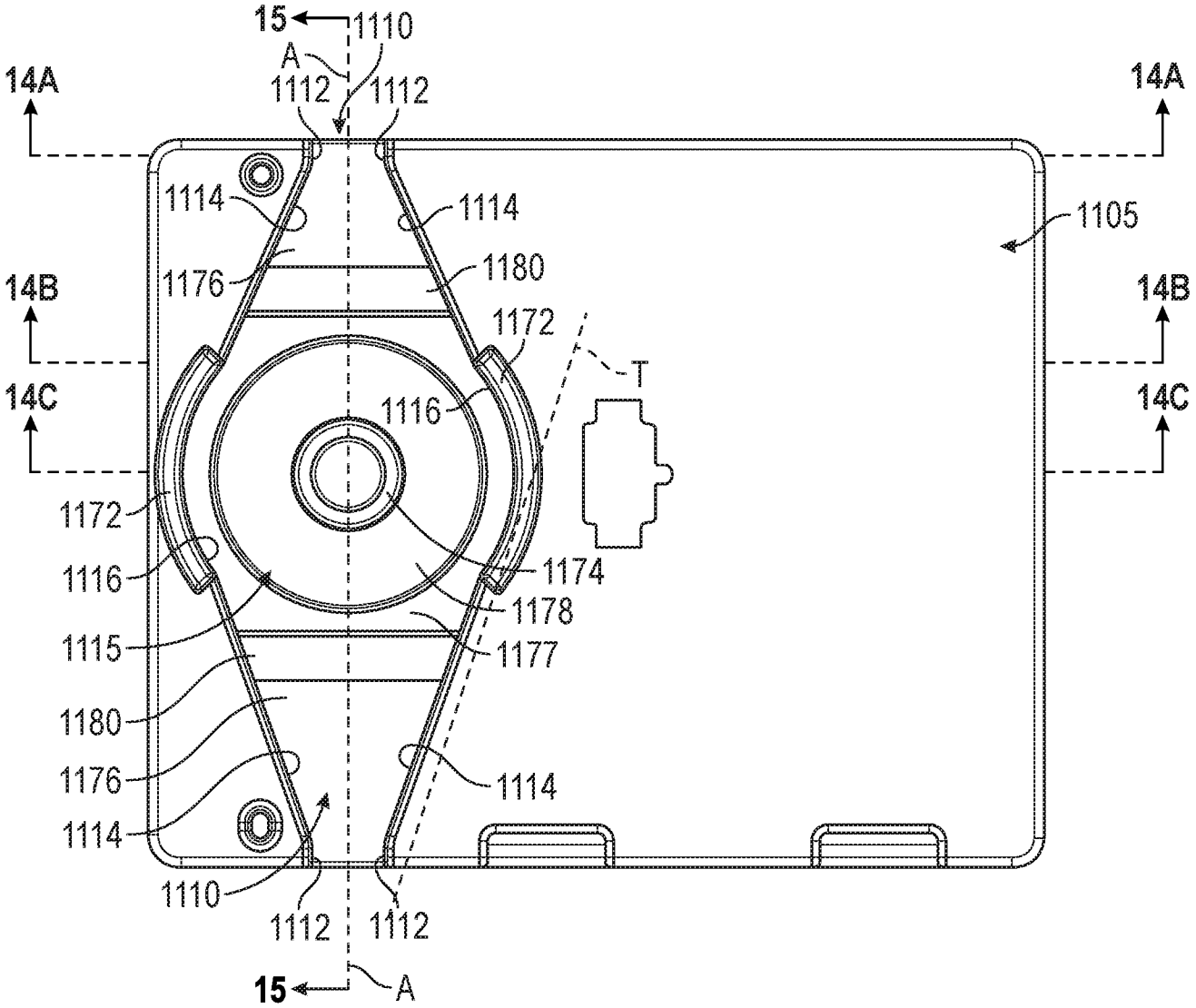
FIG. 13 is a top plan view of the housing of FIG. 12B illustrating inlets of the anti-tangle lacing channel and buffer zones proximate a spool recess.

FIG. 13 is a top plan view of the housing of FIG. 12B illustrating inlets of lacing channel 1110 defined by lace channel walls 1112, and buffer zones proximate spool recess 1115 defined by lace channel transitions 1114.

Upper component 1102 can include lacing channel 1110, channel walls (inlets) 1112, channel transitions (relief/buffer areas) 1114, spool walls 1116 for spool recess 1115, spool flanges 1172, shaft bearing 1174, channel floors 1176, floor 1177, counterbore 1178 and channel lips 1180.

Lace channel walls 1112 can comprise planar segments that extend perpendicular to axis A defined by lacing channel 1110. In FIG. 13, axis A is coincident with the section line 15-15. Spool recess 1115 can comprise a partial cylindrical space within upper component 1102 that can be centered on axis A and centered half way between lace channel walls 1112 on opposite sides of spool recess 1115. Counterbore 1178 can comprise a circular shape and can be centered within spool recess 1115. Shaft bearing 1174 can comprise a circular flange through which spool shaft 1133 can extend. Shaft bearing 1174 can be centered within counterbore 1178. Spool walls 1116 can comprise arcuate segments that partially surround spool recess 1115. Spool flanges 1172 can comprise arcuate bodies that can extend up (with respect to the orientation of FIG. 13) from spool walls 1116. In an example, each of spool walls 1116 and spool flanges 1172 can extend over an arc distance of approximately eighty degrees.

Channel transitions 1114 can comprise planar walls that can extend straight between channel walls 1112 and spool walls 1116. In the illustrated embodiment, channel transitions 1114 are joined to channel walls 1112 at their distal ends to form an angle therebetween. In other embodiments, a small curved surface or a radius can be positioned between channel transitions 1114 and channel walls 1112. In the illustrated embodiment, channel transitions 1114 are joined to spool walls 1116 at their proximal ends to from an angle therebetween. In other embodiments, channel transitions 1114 can be tangent to the curve of spool walls 1116, as shown by line T. In such embodiments, inlets formed by channel walls 1112 can or cannot be used. This can help maximize the volume of the aforementioned storage volume. In the illustrated embodiment, channel transitions 1114 extend to an inside corner of spool flanges 1172.

Figure 15A:
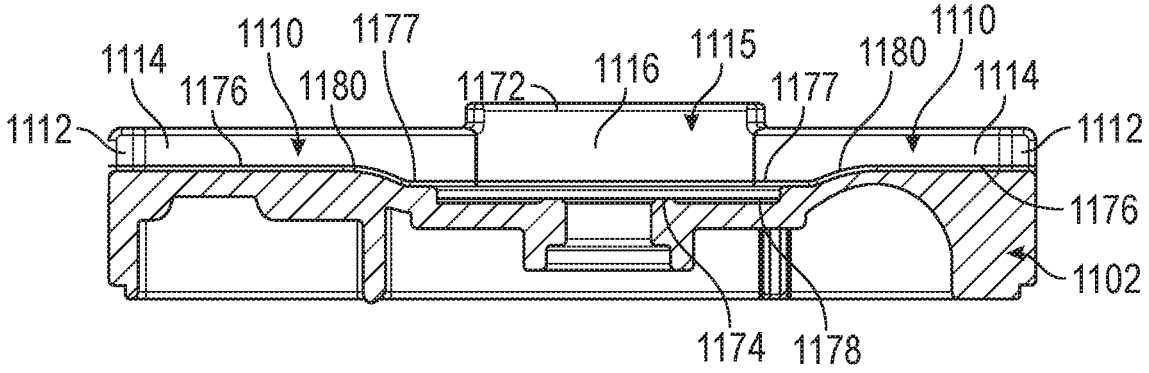
FIG. 15A is a lengthwise cross-sectional view through the anti-tangle lacing channel showing contouring of the lacing channel from inlets to the spool recess.

Channel floors 1176 can comprise flat or planar surfaces that extend between channel walls 1112 and channel lips 1180. Floor 1177 can comprise a flat surface extending partially within lacing channel 1110 and partially within spool recess 1115. Floor 1177 can be lower (with respect to the orientation of FIG. 13) within upper component 1102 than channel floors 1176. Channel lips 1180 can comprise arcuate or curved surfaces that extend between channel floors 1176 and floor 1177. In other examples, channel lips 1180 can comprise flat or planar surfaces that are angled between channel floors 1176 and floor 1177. In an example, channel lips 1180 can have a uniform cross-sectional shape such that anywhere between opposite channel transitions 1114 they have the same curvature, as can be seen in FIG. 15A.

Figure 14A:
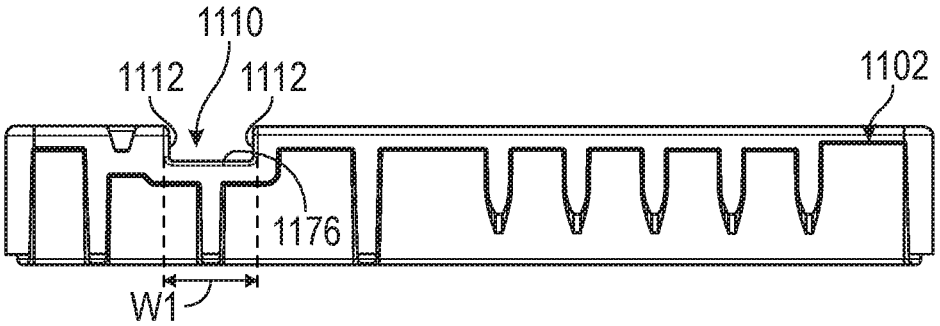
FIG. 14A is a side cross-sectional view through the anti-tangle lacing channel of FIG. 13 taken at section 14C-14C illustrating a width of the lacing channel at an inlet to the lacing channel.

FIG. 14A is a side cross-sectional view through anti-tangle lacing channel 1110 of FIG. 13 taken at section 14A-14A illustrating width W1 of lacing channel 1110. Width W1 corresponds to a width of an inlet to lacing channel 1110 formed at opposing channel walls 1112. As shown, channel walls 1112 and channel floor 1176 are flat to form a rectilinear inlet. Channel walls 1112 are approximately parallel to each other, while being approximately perpendicular to channel floor 1176. Width W1 can be wider than the height of channel walls 1112, and width W1 can be several times larger than the cross-section of a lace (e.g., lace 131) intended to be used in lacing channel 1110. Such an aspect ratio can allow the lace to feed into upper component 1102 approximately near the center of lacing channel 1110 in order to lower the propensity to snarl, while also allowing the lace to move side-to-side as winding channel 1132 of spool 1130 rotates.

Figure 14B:
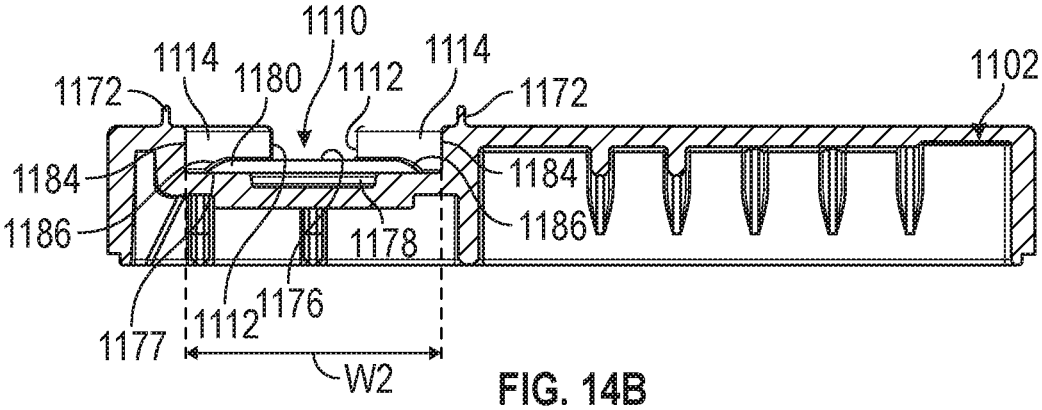
FIG. 14B is a side cross-sectional view through the anti-tangle lacing channel of FIG. 13 taken at section 14B-14BA illustrating a width of the lacing channel at an inlet to the spool recess.

FIG. 14B is a side cross-sectional view through anti-tangle lacing channel 1110 of FIG. 13 taken at section 14B-14BA illustrating width W2 of lacing channel 1110 at an inlet to spool recess 1115. Opposing channel transitions 1114 can form a relief area within lacing channel 1110. Opposing channel transitions 1114 face each other to generally form a V-shape. Channel transitions 1114 are oblique such that planes extending through each channel transition 1114 intersect along an axis extending out of the plane of FIG. 14B. Thus, channel transitions 1114 can gently funnel lace 131 toward channel walls 1112 during an unwinding procedure, while also providing space to allow for unfurling of lace 131 from spool 1130. As discussed previously, channel transitions 1114 contact spool walls 1116 proximate spool flanges 1172 to form edges 1184, but can in other embodiments be tangent with spool walls 1116 such that edges 1184 are replaced with a smooth transition. Channel transitions 1114 extend past channel lips 1180. Channel transitions 1114 can be larger than channel lips 1180 such that channel lips 1180 have curved side edges 1186. Channel transitions 1114 terminate at spool recess 1115 proximate counterbore 1178.

Figure 14C:
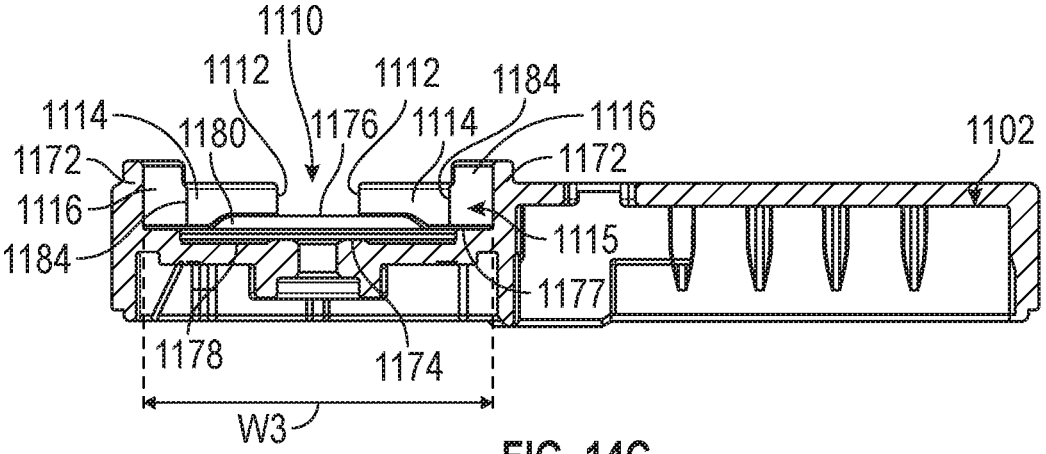
FIG. 14C is a side cross-sectional view through the anti-tangle lacing channel of FIG. 13 taken at section 14A-14A illustrating a width of the lacing channel at the spool recess.

FIG. 14C is a side cross-sectional view through anti-tangle lacing channel 1110 of FIG. 13 taken at section 14C-14C illustrating width W3 of lacing channel 1110 at the spool recess 1115. At the center of spool recess 1115, opposing spool walls 1116 are spaced to width W3 to form spool recess 1115. Width W3 can be wider than counterbore 1178 to at least partially form floor 1177. Width W3 can be wider than counterbore 1178 where lower plate 1134 of spool 1130 sits to provide additional space for the aforementioned lace volume. Spool flanges 1172 can provide clearance for modular spool 1130 to facilitate rotation. That is, flanges 1172 can shield modular spool 1130 from a cover or lid structure, e.g., lid 20 of FIG. 1, positioned over modular spool 1130 and lacing channel 1110 so that the cover or lid structure does not interfere with rotation of modular spool 1130. Spool flanges 1172 can also comprise ribs or other barriers to prevent ingress of lace 131 into spaces within housing structure 1105. Spool flanges 1172 can also reduce friction on lace 131, such as by providing clearance above lacing channel 1110 from elements of a sole structure.

Figure 15B:
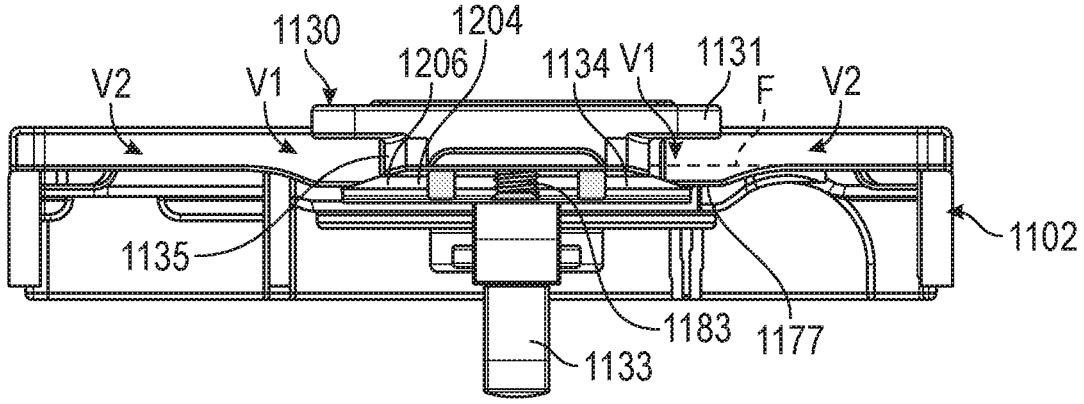
FIG. 15B shows the cross-sectional view of FIG. 15A with the spool inserted in the lacing channel.

FIG. 15A is a lengthwise cross-sectional view through anti-tangle lacing channel 1110 showing contouring of lacing channel 1110 between inlets at channel walls 1112 and spool recess 1115. FIG. 15A shows the relative elevation of channel floors 1176, channel lips 1180, floor 1177 and counterbore 1178. As shown, channel floors 1176 can provide the highest (with respect to the orientation of FIG. 15A) portions of lacing channel 1110, which corresponds to the shallowest portions of lacing channel 1110. Channel lips 1180 lower lacing channel 1110 down from channel floors 1176 to floor 1177. Channel lips 1180 provide a smooth transition to reduce or eliminate sharp edges that can potentially damage a lace. Floor 1177 transitions lacing channel 1110 into spool recess 1115 and surrounds counterbore 1178 between spool walls 1116. Counterbore 1178 is centered within floor 1117 and forms the lowest portion of lacing channel 1110. Counterbore 1178 is, however, substantially filled in by lower plate 1134 of spool 1130, as shown in FIG. 15B. Thus, floor 1177 forms the shallowest portion of lacing channel 1110 during operation. The contouring of lacing channel 1110 in the cross-section of FIG. 15A allows lace 131 to be gently funneled toward channel walls 1112 during an unwinding procedure, while also providing space to allow for unfurling of lace 131 from spool 1130, similar to channel transitions 1114 but in a transverse plane. Thus, lacing channel 1110 is funnel shaped in two planes to provide anti-tangling relief space for storage of lacing or cables.

FIG. 15B shows the cross-sectional view of FIG. 15A with spool 1130 inserted in lacing channel 1110. Contouring of lacing channel 1110 can facilitate feeding of lace 131 into spool 1130. For example, channel floors 1176 can be configured to approximately align with the center of lace volume V1 of spool 1130, as shown by dashed line F.

Lower plate 1134 of spool 1130 can include disk portion 1204 and bevel 1206. Bevel 1206 can have a tapered end that can align with floor 1177 to provide a smooth transition between upper component 1102 and disk portion 1204 of lower plate 1134 in order to help prevent damage to lace 131. Disk portion 1204 and bevel 1206 can also help prevent ingress of lace 131 into spaces within housing structure 1105.

FIG. 15B illustrates lace volume V1 of spool 1130 and storage volume V2 of lacing channel 1110. Lace volume V1 can be defined as the space between upper plate 1131 and lower plate 1132 and extends from drum 1135 of spool 1130 to the outer diameter edges of upper plate 1131 and lower plate 1132. Thus, lace volume V1 can comprise a ring-shaped space with a semi-trapezoidal cross-section. Lace volume V1 can also be defined to extend all the way out to the outer diameter of upper plate 1131 at lower plate 1132 to encompass space above floor 1177. Storage volume V2 can be defined as the space between the upper edges of channel walls 1112 and channel transitions 1114 at an upper edge, by channel floors 1176, channel lips 1180 and floor 1177 at a lower edge, and can extend from channel walls 1112 to lace volume V1. Storage volume V2 is compact to permit a lace or cable to collect within lacing channel 1110 while still allowing housing structure 1105 to fit within a sole structure for an article of footwear, but is sufficiently large to prevent the lace or cable from becoming jumbled, or bird's nested, such as by being tightly pushed into itself and compressed. In various embodiments, storage volume V2 is larger than lace volume V1. The various aspects of lacing channel 1110 described herein allow a lace to be efficiently pulled into housing structure 1105 for storage on spool 1130, and pushed out of housing structure 1105 by spool 1130 without becoming snarled, knotted, or compressed to such a degree that the lace cannot be gently pulled from housing structure 1105 from the exterior, all while avoiding subjecting the lace to sharp edges or potential pinch points between the sole structure and housing structure 1105 and between housing structure 1105 and spool 1130.

EXAMPLES

Example 1 can include or use subject matter such as a footwear lacing apparatus that can comprise: a housing structure that can comprise: a first inlet; a second inlet; and a lacing channel extending between the first and second inlets, the lacing channel can comprise: a spool receptacle located between the first and second inlets; a first relief area located between the spool receptacle and the first inlet; and a second relief area located between the spool receptacle and the second inlet; wherein the first and second relief areas are linearly tapered between the spool receptacle and the first and second inlets, respectively; a spool disposed in the spool receptacle of the lacing channel; and a drive mechanism coupling with the spool and adapted to rotate the spool to wind or unwind a lace cable extending through the lacing channel and through the spool.

Example 2 can include, or can optionally be combined with the subject matter of Example 1, to optionally include first and second relief areas that can comprise planar sidewalls extending from the spool receptacle to form passageways that taper from the spool receptacle to the first and second inlets, respectively.

Example 3 can include, or can optionally be combined with the subject matter of one or any combination of Examples 1 or 2 to optionally include planar sidewalls that can be tangent to the spool receptacle.

Example 4 can include, or can optionally be combined with the subject matter of one or any combination of Examples 1 through 3 to optionally include first and second relief areas form trapezoidal shaped passageways between the spool receptacle and the first and second inlets, respectively.

Example 5 can include, or can optionally be combined with the subject matter of one or any combination of Examples 1 through 4 to optionally include a storage capacity of the spool that is less than a storage capacity of the relief areas combined.

Example 6 can include, or can optionally be combined with the subject matter of one or any combination of Examples 1 through 5 to optionally include a spool receptacle that can comprise a pair of opposing arcuate sidewalls.

Example 7 can include, or can optionally be combined with the subject matter of one or any combination of Examples 1 through 6 to optionally include a spool receptacle that can further comprise: a shaft socket; and a counterbore surrounding the shaft socket.

Example 8 can include, or can optionally be combined with the subject matter of one or any combination of Examples 1 through 7 to optionally include a spool receptacle that can further comprise: a pair of opposing arcuate flanges extending above the spool receptacle.

Example 9 can include, or can optionally be combined with the subject matter of one or any combination of Examples 1 through 8 to optionally include first and second inlets that can comprise rectangular openings in the housing structure.

Example 10 can include, or can optionally be combined with the subject matter of one or any combination of Examples 1 through 9 to optionally include first and second inlets that can further comprise planar sidewalls forming rectangular passageways, respectively.

Example 11 can include, or can optionally be combined with the subject matter of one or any combination of Examples 1 through 10 to optionally include first and second relief areas that can include curved lips at junctures with the spool receptacle.

Example 12 can include, or can optionally be combined with the subject matter of one or any combination of Examples 1 through 11 to optionally include a spool that can comprise: a lower plate; a shaft extending from the lower plate; an upper plate; a drum positioned between the upper and lower plates; and a winding channel extending through the drum.

Example 13 can include or use subject matter such as a housing structure for a footwear lacing apparatus, the housing structure can comprise: a body that can comprise: a top surface; a bottom surface; a first sidewall connecting the top surface and the bottom surface; and a second sidewall connecting the top surface and the bottom surface; an internal compartment between the top and bottom surfaces and the first and second sidewalls; and a lacing channel extending from the first sidewall to the second sidewall the lacing channel can comprise: a first inlet in the first sidewall; a second inlet in the second sidewall; a spool receptacle located between the first and second inlets; a first relief area located between the spool receptacle and the first inlet; and a second relief area located between the spool receptacle and the second inlet; wherein the first and second relief areas are linearly tapered between the spool receptacle and the first and second inlets, respectively.

Example 14 can include, or can optionally be combined with the subject matter of Example 13, to optionally include first and second relief areas that can comprise planar sidewalls extending from the spool receptacle to form passageways that taper from the spool receptacle to the first and second inlets, respectively.

Example 15 can include, or can optionally be combined with the subject matter of one or any combination of Examples 13 or 14 to optionally include a spool receptacle that can comprise a pair of opposing arcuate sidewalls.

Example 16 can include, or can optionally be combined with the subject matter of one or any combination of Examples 13 through 15 to optionally include planar sidewalls that can be tangent to the arcuate sidewalls of the spool receptacle.

Example 17 can include, or can optionally be combined with the subject matter of one or any combination of Examples 13 through 16 to optionally include first and second relief areas that can form trapezoidal shaped passageways between the spool receptacle and the first and second inlets, respectively.

Example 18 can include, or can optionally be combined with the subject matter of one or any combination of Examples 13 through 17 to optionally include a spool receptacle that can further comprise: a pair of opposing arcuate flanges extending above the spool receptacle.

Example 19 can include, or can optionally be combined with the subject matter of one or any combination of Examples 13 through 18 to optionally include each of the first and second inlets that can comprise: a rectangular opening in the body; and planar sidewalls forming a rectangular passageway.

Example 20 can include, or can optionally be combined with the subject matter of one or any combination of Examples 13 through 19 to optionally include a body that can comprise an upper component and a lower component.

Example 21 can include, or can optionally be combined with the subject matter of one or any combination of Examples 13 through 20 to optionally include a lacing channel that can penetrates through the top surface of the body.

Example 22 can include or use subject matter such as a method of unwinding a spool in a footwear lacing apparatus, the method can comprise: rotating a spool with a drive mechanism to reduce tension in a lace cable wrapped around the spool; pushing lace cable from the spool into a lacing channel within a housing of the footwear lacing apparatus; collecting lace cable within relief areas of the lacing channel; and permitting lace cable to loosely exit the lacing channel from the relief areas to unwind the lace cable from the spool.

Example 23 can include, or can optionally be combined with the subject matter of Example 22, to optionally include preventing tangling of the lace cable within the relief areas by permitting the lace cable to freely collect in the relief areas.

Example 24 can include, or can optionally be combined with the subject matter of one or any combination of Examples 22 or 23 to optionally include emptying the spool into the relief areas.

Example 25 can include, or can optionally be combined with the subject matter of one or any combination of Examples 22 through 24 to optionally include pulling the lace cable from the relief areas without tangling.

Additional Notes

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Although an overview of the inventive subject matter has been described with reference to specific example embodiments, various modifications and changes may be made to these embodiments without departing from the broader scope of embodiments of the present disclosure. Such embodiments of the inventive subject matter may be referred to herein, individually or collectively, by the term "invention" merely for convenience and without intending to voluntarily limit the scope of this application to any single disclosure or inventive concept if more than one is, in fact, disclosed.

The embodiments illustrated herein are described in sufficient detail to enable those skilled in the art to practice the teachings disclosed. Other embodiments may be used and derived therefrom, such that structural and logical substitutions and changes may be made without departing from the scope of this disclosure. The disclosure, therefore, is not to be taken in a limiting sense, and the scope of various embodiments includes the full range of equivalents to which the disclosed subject matter is entitled.

As used herein, the term "or" may be construed in either an inclusive or exclusive sense. Moreover, plural instances may be provided for resources, operations, or structures described herein as a single instance. Additionally, boundaries between various resources, operations, modules, engines, and data stores are somewhat arbitrary, and particular operations are illustrated in a context of specific illustrative configurations. Other allocations of functionality are envisioned and may fall within a scope of various embodiments of the present disclosure. In general, structures and functionality presented as separate resources in the example configurations may be implemented as a combined structure or resource. Similarly, structures and functionality presented as a single resource may be implemented as separate resources. These and other variations, modifications, additions, and improvements fall within a scope of embodiments of the present disclosure as represented by the appended claims. The specification and drawings are, accordingly, to be regarded in an illustrative rather than a restrictive sense.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A." and "A and B." unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second." and "third." etc, are used merely as labels, and are not intended to impose numerical requirements on their objects.

Method examples described herein, such as the motor control examples, can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. An Abstract, if provided, is included to comply with 37 C.F.R. § 1.72(b), to allow the reader to quickly ascertain the nature of the technical disclosure. It is submitted with the understanding that it will not be used to interpret or limit the scope or meaning of the claims. Also, in the above Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A housing structure for a footwear lacing apparatus, the housing structure comprising:

- a first inlet defined by a first pair of opposing channel walls of the housing structure;
- a second inlet defined by a second pair of opposing channel walls of the housing structure; and
- a lacing channel extending between the first and second inlets, the lacing channel comprising:
  - a spool receptacle defined by a counterbore in a floor of the housing structure located between the first and second inlets;
  - a first relief area defined by a pair of angled channel transition walls of the housing structure extending from the spool receptacle to the first inlet; and
  - a second relief area defined by a pair of angled channel transition walls of the housing structure extending from the spool receptacle to the second inlet;

wherein the first and second relief areas are linearly tapered between the spool receptacle and the first and second inlets, respectively.

2. The housing structure of claim 1, wherein the pairs of angled channel transition walls of the first and second relief areas comprise planar sidewalls extending from the spool receptacle to form passageways that taper from the spool receptacle to the first and second inlets, respectively.

3. The housing structure of claim 2, wherein the planar sidewalls are tangent to the spool receptacle.

4. The housing structure of claim 2, wherein the pairs of angled channel transition walk of the first and second relief areas form trapezoidal shaped passageways between the spool receptacle and the first and second inlets, respectively.

5. The housing structure of claim 1, wherein the spool receptacle further comprises a pair of opposing arcuate sidewalls.

6. The housing structure of claim 5, wherein the spool receptacle further comprises:

a shaft socket surrounded by the counterbore.

7. The housing structure of claim 5, wherein the spool receptacle further comprises:

a pair of opposing arcuate flanges extending above the spool receptacle.

8. The housing structure of claim 1, wherein the first and second pairs of opposing channel walls of the first and second inlets comprise rectangular openings in the housing structure.

9. The housing structure of claim 8, wherein the first and second pairs of opposing channel walls of the first and second inlets comprise planar sidewalls forming rectangular passageways, respectively.

10. The housing structure of claim 1, wherein the first and second relief areas further comprise curved lips at junctures with the spool receptacle.

11. A housing structure for a footwear lacing apparatus, the housing structure comprising:

a body comprising:

a top surface defined by an upper component;

a bottom surface defined by a lower component;

a first sidewall defined by the upper component connecting the top surface and the bottom surface; and a second sidewall defined by the upper component connecting the top surface and the bottom surface;

an internal compartment between the top and bottom surfaces and the first and second sidewalls; and a lacing channel extending from the first sidewall to the second sidewall, the lacing channel comprising:

a first inlet in the first sidewall defined by a first pair of opposing channel walls of the upper component;

a second inlet in the second sidewall defined by a second pair of opposing channel wall of the upper component;

a spool receptacle defined by a floor of the upper component located between the first and second inlets;

a first relief area defined by a pair of angled channel transition wall of the upper component located between the spool receptacle and the first inlet; and a second relief area defined by a pair of angled channel transition walls of the upper component located between the spool receptacle and the second inlet;

wherein the first and second relief areas are linearly tapered between the spool receptacle and the first and second inlets, respectively.

12. The housing structure of claim 11, wherein the pairs of angled channel transition walls of the first and second relief areas comprise planar sidewalls extending from the spool receptacle to form passageways that taper from the spool receptacle to the first and second inlets, respectively.

13. The housing structure of claim 12, wherein the spool receptacle further comprises a pair of opposing arcuate sidewalls.

14. The housing structure of claim 13, wherein the planar sidewalk are tangent to the arcuate sidewalls of the spool receptacle.

15. The housing structure of claim 13, wherein the pairs of angled channel transition walls of the first and second relief areas form trapezoidal shaped passageways between the spool receptacle and the first and second inlets, respectively.

16. The housing structure of claim 13, wherein the spool receptacle further comprises: a pair of opposing arcuate flanges extending above the spool receptacle.

17. The housing structure of claim 11, wherein each of the first and second pairs of opposing channel walls of the first and second inlets comprises:

a rectangular opening in the body; and planar sidewalk forming a rectangular passageway.

18. The housing structure of claim 11, wherein the upper component and the lower component are coupled together to form the housing body.

19. The housing structure assembly of claim 11, wherein the lacing channel penetrates through the top surface of the body.

20. A housing for a footwear lacing apparatus, the housing comprising:

a housing structure comprising:

a top surface defined by the housing structure;

a first sidewall defined by the housing structure and extending from the top surface; and a second sidewall, defined by the housing structure and extending from the top surface; and a lacing channel extending through the top surface, the lacing channel comprising:

a channel floor comprising:

a first portion defined by the housing structure and extending from the first sidewall; and a second portion defined by the housing structure and extending from the second sidewall; and a spool floor located between the first portion and the second portion of the channel floor;

wherein the spool floor is located a first distance below the top surface and the channel floor is located a second distance below the top surface, the first distance being greater than the second distance.

21. The housing of claim 20, further comprising a pair of opposing arcuate flanges extending from the top surface proximate the spool floor.

22. The housing of claim 20, further comprising a counterbore in the spool floor, wherein the counterbore is located a third distance below the top surface greater than the first distance.

23. The housing of claim 20, further comprising a channel lip connecting each of the first and second portions of the channel floor and the spool floor.

* * * * *